US009923271B2

(12) United States Patent
Hyde et al.

(10) Patent No.: US 9,923,271 B2
(45) Date of Patent: Mar. 20, 2018

(54) ANTENNA SYSTEM HAVING AT LEAST TWO APERTURES FACILITATING REDUCTION OF INTERFERING SIGNALS

(71) Applicant: Elwha LLC, Bellevue, WA (US)

(72) Inventors: Roderick A. Hyde, Redmond, WA (US); Jordin T. Kare, Seattle, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 236 days.

(21) Appl. No.: 14/059,188

(22) Filed: Oct. 21, 2013

(65) Prior Publication Data

US 2015/0109178 A1 Apr. 23, 2015

(51) Int. Cl.
*H01Q 3/44* (2006.01)
*H01Q 13/28* (2006.01)
(Continued)

(52) U.S. Cl.
CPC ..... *H01Q 3/44* (2013.01); *H01Q 13/28* (2013.01); *H01Q 15/0006* (2013.01)

(58) Field of Classification Search
CPC ..... H01Q 3/00; H01Q 3/44; H01Q 15/0006; H01Q 13/28
See application file for complete search history.

(56) References Cited

U.S. PATENT DOCUMENTS 3,001,193 A 9/1961 Marie
3,388,396 A 6/1968 Rope et al.
(Continued)

FOREIGN PATENT DOCUMENTS

JP 52-13751 A 2/1977
JP 2007-081825 A 3/2007
(Continued)

OTHER PUBLICATIONS

Amineh et al.; "Three-Dimensional Near-Field Microwave Holography for Tissue Imaging"; International Journal of Biomedical Imaging; Bearing a date of Dec. 21, 2011; pp. 1-11; vol. 2012, Article ID 291494; Hindawi Publishing Corporation.
(Continued)

*Primary Examiner* — Graham Smith
*Assistant Examiner* — Michael Bouizza
(74) *Attorney, Agent, or Firm* — Foley & Lardner LLP

(57) ABSTRACT

Described embodiments include an antenna system and method. The antenna system includes at least two surface scattering antenna segments. Each segment includes a respective electromagnetic waveguide structure, and a respective plurality of electromagnetic wave scattering elements. The wave scattering elements are distributed along the waveguide structure, have an inter-element spacing substantially less than a free-space wavelength of a highest operating frequency of the antenna segment, have a respective activatable electromagnetic response to a propagating guided wave, and are operable in combination to produce a controllable radiation pattern. A gain definition circuit defines a series of at least two radiation patterns selected to facilitate a convergence on an antenna radiation pattern that maximizes a radiation performance metric. An antenna controller sequentially establishes each radiation pattern. A receiver receives the desired field of view signal and the undesired field of view signal.

42 Claims, 29 Drawing Sheets

(51) Int. Cl.
*H01Q 15/00* (2006.01)
*H01Q 5/00* (2015.01)

(56) References Cited

U.S. PATENT DOCUMENTS 3,604,012 A 9/1971 Lindley
3,714,608 A 1/1973 Barnes et al.
3,757,332 A 9/1973 Tricoles
3,887,923 A 6/1975 Hendrix
4,195,262 A 3/1980 King
4,229,745 A 10/1980 Kruger
4,291,312 A 9/1981 Kaloi
4,305,153 A 12/1981 King
4,489,325 A 12/1984 Bauck et al.
4,509,209 A 4/1985 Itoh et al.
4,672,378 A 6/1987 Drabowitch et al.
4,701,762 A 10/1987 Apostolos
4,780,724 A 10/1988 Sharma et al.
4,832,429 A 5/1989 Nagler
4,874,461 A 10/1989 Sato et al.
4,920,350 A 4/1990 McGuire et al.
4,947,176 A 8/1990 Inatsune et al.
4,978,934 A 12/1990 Saad
5,198,827 A 3/1993 Seaton
5,455,590 A 10/1995 Collins et al.
5,512,906 A 4/1996 Speciale
5,734,347 A 3/1998 McEligot
5,841,543 A 11/1998 Guldi et al.
5,889,599 A 3/1999 Takemori
6,031,506 A 2/2000 Cooley et al.
6,061,023 A 5/2000 Daniel et al.
6,061,025 A 5/2000 Jackson et al.
6,075,483 A 6/2000 Gross
6,084,540 A 7/2000 Yu
6,114,834 A 9/2000 Parise
6,166,690 A 12/2000 Lin et al.
6,198,453 B1 3/2001 Chew
6,211,823 B1 4/2001 Herring
6,232,931 B1 5/2001 Hart
6,236,375 B1 5/2001 Chandler et al.
6,275,181 B1 8/2001 Kitayoshi
6,366,254 B1 4/2002 Sievenpiper et al.
6,384,797 B1 5/2002 Schaffner et al.
6,396,440 B1 5/2002 Chen
6,469,672 B1 10/2002 Marti-Canales et al.
6,545,645 B1 4/2003 Wu
6,552,696 B1 4/2003 Sievenpiper et al.
6,633,026 B2 10/2003 Tuominen
6,985,107 B2 1/2006 Anson et al.
7,068,234 B2 6/2006 Sievenpiper
7,151,499 B2 12/2006 Avakian et al.
7,154,451 B1 12/2006 Sievenpiper
7,253,780 B2 8/2007 Sievenpiper
7,295,146 B2 11/2007 McMakin et al.
7,307,596 B1 12/2007 West
7,339,521 B2 3/2008 Scheidemann et al.
7,428,230 B2 9/2008 Park
7,456,787 B2 11/2008 Manasson et al.
7,609,223 B2 10/2009 Manasson et al.
7,667,660 B2 2/2010 Manasson et al.
7,830,310 B1 11/2010 Sievenpiper et al.
7,834,795 B1 11/2010 Dudgeon et al.
7,864,112 B2 1/2011 Manasson et al.
7,911,407 B1 3/2011 Fong et al.
7,929,147 B1 4/2011 Fong et al.
7,995,000 B2 8/2011 Manasson et al.
8,009,116 B2 8/2011 Peichl et al.
8,014,050 B2 9/2011 McGrew
8,040,586 B2 10/2011 Smith et al.
8,059,051 B2 11/2011 Manasson et al.
8,134,521 B2 3/2012 Herz et al.
8,179,331 B1 5/2012 Sievenpiper
8,212,739 B2 7/2012 Sievenpiper
8,339,320 B2 12/2012 Sievenpiper
8,456,360 B2 6/2013 Manasson et al.
9,231,303 B2 1/2016 Edelmann et al.
9,268,016 B2 2/2016 Smith et al.
9,389,305 B2 7/2016 Boufounos
9,634,736 B2 4/2017 Mukherjee et al.
2002/0039083 A1 4/2002 Taylor et al.
2002/0167456 A1 11/2002 McKinzie, III
2003/0214443 A1 11/2003 Bauregger et al.
2004/0227668 A1 11/2004 Sievenpiper
2004/0263408 A1 12/2004 Sievenpiper et al.
2005/0031295 A1 2/2005 Engheta et al.
2005/0088338 A1* 4/2005 Masenten ..... H01Q 3/2611 342/368
2006/0065856 A1 3/2006 Diaz et al.
2006/0114170 A1 6/2006 Sievenpiper
2006/0116097 A1 6/2006 Thompson
2006/0132369 A1 6/2006 Robertson et al.
2006/0187126 A1 8/2006 Sievenpiper
2007/0085757 A1 4/2007 Sievenpiper
2007/0103381 A1 5/2007 Upton
2007/0159395 A1 7/2007 Sievenpiper et al.
2007/0159396 A1 7/2007 Sievenpiper et al.
2007/0182639 A1 8/2007 Sievenpiper et al.
2007/0200781 A1 8/2007 Ahn et al.
2007/0229357 A1 10/2007 Zhang et al.
2008/0020231 A1 1/2008 Yamada et al.
2008/0165079 A1 7/2008 Smith et al.
2008/0180339 A1 7/2008 Yagi
2008/0224707 A1 9/2008 Wisler et al.
2008/0259826 A1 10/2008 Struhsaker
2008/0268790 A1 10/2008 Shi et al.
2008/0316088 A1 12/2008 Pavlov et al.
2009/0002240 A1 1/2009 Sievenpiper et al.
2009/0045772 A1 2/2009 Cook et al.
2009/0109121 A1 4/2009 Herz et al.
2009/0147653 A1 6/2009 Waldman et al.
2009/0195361 A1* 8/2009 Smith ..... H01Q 3/00 340/10.1
2009/0251385 A1 10/2009 Xu et al.
2010/0066629 A1 3/2010 Sievenpiper
2010/0073261 A1 3/2010 Sievenpiper
2010/0079010 A1 4/2010 Hyde et al.
2010/0109972 A2 5/2010 Xu et al.
2010/0134370 A1 6/2010 Oh et al.
2010/0156573 A1 6/2010 Smith et al.
2010/0157929 A1 6/2010 Karabinis
2010/0188171 A1 7/2010 Mohajer-Iravani et al.
2010/0279751 A1 11/2010 Pourseyed et al.
2010/0328142 A1 12/2010 Zoughi et al.
2011/0098033 A1 4/2011 Britz et al.
2011/0117836 A1 5/2011 Zhang et al.
2011/0128714 A1 6/2011 Terao et al.
2011/0151789 A1 6/2011 Viglione et al.
2011/0267664 A1 11/2011 Kitamura et al.
2012/0026068 A1 2/2012 Sievenpiper
2012/0038317 A1 2/2012 Miyamoto et al.
2012/0112543 A1 5/2012 van Wageningen et al.
2012/0194399 A1 8/2012 Bily et al.
2012/0219249 A1 8/2012 Pitwon
2012/0268340 A1 10/2012 Capozzoli et al.
2012/0274147 A1 11/2012 Stecher et al.
2012/0280770 A1 11/2012 Abhari et al.
2012/0326660 A1 12/2012 Lu et al.
2013/0069865 A1 3/2013 Hart
2013/0082890 A1 4/2013 Wang et al.
2013/0237272 A1 9/2013 Prasad
2013/0249310 A1 9/2013 Hyde et al.
2013/0278211 A1 10/2013 Cook et al.
2013/0288617 A1 10/2013 Kim et al.
2013/0343208 A1 12/2013 Sexton et al.
2014/0128006 A1 5/2014 Hu
2014/0266946 A1 9/2014 Bily et al.
2015/0280444 A1 10/2015 Smith et al.
2017/0098961 A1 4/2017 Harpham

FOREIGN PATENT DOCUMENTS

JP 2008-054146 A 3/2008
JP 2010-187141 A 8/2010
KR 10-1045585 B1 6/2011

(56) References Cited

FOREIGN PATENT DOCUMENTS

| | | | |
|---|---|---|---|
| WO | WO 01/73891 | A1 | 10/2001 |
| WO | WO 2008-007545 | A1 | 1/2008 |
| WO | WO 2008/059292 | A2 | 5/2008 |
| WO | WO 2009/103042 | A2 | 8/2009 |
| WO | WO 2010/0021736 | | 2/2010 |
| WO | WO 2013/147470 | A1 | 10/2013 |

OTHER PUBLICATIONS

Belloni, Fabio; "Channel Sounding"; S-72.4210 PG Course in Radio Communications; Bearing a date of Feb. 7, 2006; pp. 1-25.
Diaz, Rudy; "Fundamentals of EM Waves"; Bearing a date of Apr. 4, 2013; 6 Total Pages; located at: http://www.microwaves101.com/encyclopedia/absorbingradar1.cfm.
Frenzel, Lou; "What's the Difference Between EM Near Field and Far Field?"; Electronic Design; Bearing a date of Jun. 8, 2012; 7 Total Pages; located at: http://electronicdesign.com/energy/what-s-difference -between-em-near-field-and-far-field.
Grbic, Anthony; "Electrical Engineering and Computer Science"; University of Michigan; Created on Mar. 18, 2014, printed on Jan. 27, 2014; pp. 1-2; located at: http://sitemaker.umich.edu/agrbic/projects.
Grbic et al.; "Metamaterial Surfaces for Near and Far-Field Applications"; 7th European Conference on Antennas and Propagation (EUCAP 2013); Bearing a date of 2013, Created on Mar. 18, 2014; pp. 1-5.
Imani, et al.; "A Concentrically Corrugated Near-Field Plate"; Bearing a date of 2010, Created on Mar. 18, 2014; pp. 1-4; IEEE.
Imani, et al.; "Design of a Planar Near-Field Plate"; Bearing a date of 2012, Created on Mar. 18, 2014; pp. 1-2; IEEE.
Imani, et al.; "Planar Near-Field Plates"; Bearing a date of 2013, Created on Mar. 18, 2014; pp. 1-10; IEEE.
Islam et al.; "A Wireless Channel Sounding System for Rapid Propagation Measurements"; Bearing a date of Nov. 21, 2012; 7 Total Pages.
Konishi, Yohei; "Channel Sounding Technique Using MIMO Software Radio Architecture"; 12th MCRG Joint Seminar; Bearing a date of Nov. 18, 2010; 28 Total Pages.
Lipworth et al.; "Magnetic Metamaterial Superlens for Increased Range Wireless Power Transfer"; Scientific Reports; Bearing a date of Jan. 10, 2014; pp. 1-6; vol. 4, No. 3642.
Manasson et al.; "Electronically Reconfigurable Aperture (ERA): A New Approach for Beam-Steering Technology"; Bearing dates of Oct. 12-15, 2010; pp. 673-679; IEEE.
Mitri, F.G.; "Quasi-Gaussian Electromagnetic Beams"; Physical Review A.; Bearing a date of Mar. 11, 2013; p. 1; vol. 87, No. 035804; (Abstract Only).
Sakakibara, Kunio; "High-Gain Millimeter-Wave Planar Array Antennas with Traveling-Wave Excitation"; Radar Technology; Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
Siciliano et al.; "25. Multisensor Data Fusion"; Springer Handbook of Robotics; Bearing a date of 2008, Created on Mar. 18, 2014; 27 Total Pages; Springer.
Thoma et al.; "MIMO Vector Channel Sounder Measurement for Smart Antenna System Evaluation"; Created on Mar. 18, 2014; pp. 1-12.
Umenei, A.E.; "Understanding Low Frequency Non-Radiative Power Transfer"; Bearing a date of Jun. 2011; 7 Total Pages; Fulton Innovation, LLC.
Wallace, John; "Flat 'Metasurface' Becomes Aberration-Free Lens"; Bearing a date of Aug. 28, 2012; 4 Total Pages; located at: http://www.laserfocusworld.com/articles/2012/08/flat-metasurface-becomes-aberration-free-lens.html.
Yoon et al.; "Realizing Efficient Wireless Power Transfer in the Near-Field Region Using Electrically Small Antennas"; Wireless Power Transfer; Principles and Engineering Explorations; Bearing a date of Jan. 25, 2012; pp. 151-172.
European Patent Office, Supplementary European Search Report, pursuant to Rule 62 EPC; App. No. EP 11 83 2873; dated May 15, 2014 (received by our Agent on May 21, 2014); 7 pages.
Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.
Colburn et al.; "Adaptive Artificial Impedance Surface Conformal Antennas"; in Proc. IEEE Antennas and Propagation Society Int. Symp.; 2009; p. 1-4.
Courreges et al.; "Electronically Tunable Ferroelectric Devices for Microwave Applications"; *Microwave and Millimeter Wave Technologies from Photonic Bandgap Devices to Antenna and Applications*; ISBN 978-953-7619-66-4; Mar. 2010; p. 185-204; InTech.
Cristaldi et al., Chapter 3 "Passive LCDs and Their Addressing Techniques" and Chapter 4 "Drivers for Passive-Matrix LCDs"; *Liquid Crystal Display Drivers: Techniques and Circuits*; ISBN 9048122546; Apr. 8, 2009; p. 75-143; Springer.
Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.
Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.
Evlyukhin, Andrey B. And Bozhevolnyi, Sergey I.; "Holographic evanescent-wave focusing with nanoparticle arrays"; Optics Express; Oct. 27, 2008; p. 17429-17440; vol. 16, No. 22; OSA.
Fong, Bryan H. et al.; "Scalar and Tensor Holographic Artificial Impedance Surfaces" IEEE Transactions on Antennas and Propagation; Oct. 2010; p. 3212-3221; vol. 58, No. 10; IEEE.
Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; Nov. 6-12, 1999; p. 1-9; PSW/PCIM; Chicago, IL.
Kim, David Y.; "A Design Procedure for Slot Arrays Fed by Single-Ridge Waveguide"; IEEE Transactions on Antennas and Propagation; Nov. 1988; p. 1531-1536; vol. 36, No. 11; IEEE.
Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; ; IEEE.
McLean et al.; "Interpreting Antenna Performance Parameters for EMC Applications: Part 2: Radiation Pattern, Gain, and Directivity"; Created on Apr. 1, 2014; pp. 7-17; TDK RF Solutions Inc.
Poplavlo, Yuriy et al.; "Tunable Dielectric Microwave Devices with Electromechanical Control"; *Passive Microwave Components and Antennas*; ISBN 978-953-307-083-4; Apr. 2010; p. 367-382; InTech.
PCT International Search Report; International App. No. PCT/US2011/001755; dated Mar. 22, 2012; pp. 1-5.
Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.
Sato, Kazuo et al.; "Electronically Scanned Left-Handed Leaky Wave Antenna for Millimeter-Wave Automotive Applications"; Antenna Technology Small Antennas and Novel Metamaterials; 2006; p. 420-423; IEEE.
Sievenpiper, Dan et al.; "Holographic Artificial Impedance Surfaces for Conformal Antennas"; Antennas and Propagation Society International Symposium; 2005; p. 256-259; vol. 1B; IEEE, Washington D.C.
Sievenpiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.
Soper,Taylor; "This startup figured out how to charge devices wirelessly through walls from 40 feet away"; GeekWire; bearing a

(56) References Cited

OTHER PUBLICATIONS date of Apr. 22, 2014 and printed on Apr. 24, 2014; pp. 1-12; located at http://wwx.geekwire com/2014/ossia-wireless-charging/#disqus_thread.
Utsumi, Yozo et al.; "Increasing the Speed of Microstrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.
"Wavenumber"; Microwave Encyclopedia; Bearing a date of Jan. 12, 2008; pp. 12; P-N Designs, Inc.
Weil, Carsten et al.; "Tunable Inverted-Microstrip Phase Shifter Device Using Nematic Liquid Crystals"; IEEE MTT-S Digest; 2002; p. 367-370; IEEE.
Yee, Hung Y.; "Impedance of a Narrow Longitudinal Shunt Slot in a Slotted Waveguide Array"; IEEE Transactions on Antennas and Propagation; Jul. 1974; p. 589-592; IEEE.
Zhong, S.S. et al.; "Compact ridge waveguide slot antenna array fed by convex waveguide divider"; Electronics Letters; Oct. 13, 2005; p. 1-2; vol. 41, No. 21; IEEE.
The State Intellectual Property Office of P.R.C.; Application No. 201180055705.8; May 6, 2015; (received by our Agent on May 11, 2015); pp. 1-11.
Intellectual Property Office of Singapore Examination Report; Application No. 2013027842; Feb. 27, 2015; (received by our Agent on Apr. 28, 2015); pp. 1-12.
The State Intellectual Property Office of P.R.C.; Application No. 201180055705.8; Nov. 4, 2015 (received by our Agent on Nov. 10, 2015; pp. 1-11.
PCT International Search Report; International App. No. PCT/US2014/069254; dated Nov. 27, 2015; pp. 1-4.
"Array Antenna with Controlled Radiation Pattern Envelope Manufacture Method"; ESA; Jan. 8, 2013; pp. 1-2; http://www.esa.int/Our_Activities/Technology/Array_antenna_with_controlled_radiation_pattern_envelope_manufacture_method.
Chen, Robert; *Liquid Crystal Displays*, Wiley, New Jersey 2011 (not provided).
Chin et al.; "An efficient broadband metamaterial wave retarder"; Optics Express; Apr. 27, 2009; pp. 7640-7647; vol. 17; No. 9; Optical Society of America.
Chu et al.; "Analytical Model of a Multilayered Meander-Line Polarizer Plate with Normal and Oblique Plane-Wave Incidence"; IEEE Transactions on Antennas and Propagation; Jun. 1987; pp. 652-661; vol. AP-35; No. 6; IEEE.
Crosslink; Summer 2002; pp. 1-56 vol. 3; No. 2; The Aerospace Corporation.
Den Boer, Wilem; *Active Matrix Liquid Crystal Displays*; Elsevier, Burlington, MA, 2009 (not provided).
Fan et al.; "Fast-response and scattering-free polymer network liquid crystals for infrared light modulators"; Applied Physics Letters; Feb. 23, 2004; pp. 1233-1235; vol. 84, No. 8; American Institute of Physics.
Kirschbaum et al.; "A Method of Producing Broad-Band Circular Polarization Employing an Anisotropic Dielectric"; IRE Transactions on Microwave Theory and Techniques; Jul. 1957; pp. 199-203.
Kuki et al.; "Microwave Variable Delay Line using a Membrane Impregnated with Liquid Crystal"; IEEE MTT-S Digest; 2002; pp. 363-366; IEEE.
Leveau et al.; "Anti-Jam Protection by Antenna"; GPS World; Feb. 1, 2013; pp. 1-11; North Coast Media LLC; http://gpsworld.com/anti-jam-protection-by-antenna/.
Luo et al.; "High-directivity antenna with small antenna aperture"; Applied Physics Letters; 2009; pp. 193506-1-193506-3; vol. 95; American Institute of Physics.
Smith, David R.; "Recent Progress in Metamaterial and Transformation Optical Design"; NAVAIR Nano/Meta Workshop; Feb. 2-3, 2011; pp. 1-32.
"Spectrum Analyzer"; Printed on Aug. 12, 2013; pp. 1-2; http://www.gpssource.com/faqs/15; GPS Source.
Sun et al.; "Maximum Signal-to-Noise Ratio GPS Anti-Jam Receiver with Subspace Tracking"; ICASSP; 2005; pp. IV-1085-IV-1088; IEEE.
Yan et al.; "A Novel Polarization Convert Surface Based on Artificial Magnetic Conductor"; APMC2005 Proceedings; 2005; pp. 1-2; IEEE.
Young et al.; "Meander-Line Polarizer"; IEEE Transactions on Antennas and Propagation; May 1973; pp. 376-378.
PCT International Search Report; International App. No. PCT/US2014/070645; dated Mar. 16, 2015; pp. 1-3.
Fan, Guo-Xin et al.; "Scattering from a Cylindrically Conformal Slotted Waveguide Array Antenna"; IEEE Transactions on Antennas and Propagation; Jul. 1997; pp. 1150-1159; vol. 45, No. 7; IEEE.
Jiao, Yong-Chang et al.; A New Low-Side-Lobe Pattern Synthesis Technique for Conformal Arrays; IEEE Transactions on Antennas and Propagation; Jun. 1993; pp. 824-831, vol. 41, No. 6; IEEE.
PCT International Search Report; International App. No. PCT/US2015/028781; dated Jul. 27, 2015; pp. 1-3.
PCT International Search Report; International App. No. PCT/US2014/061485; dated Jul. 27, 2015; pp. 1-3.
PCT International Search Report; International App. No. PCT/US2014/070650; dated Mar. 27, 2015; pp. 1-3.
Patent Office of the Russian Federation (Rospatent) Office Action; Application No. 2013119332/28(028599); dated Oct. 13, 2015 (received by our agent on Oct. 23, 2015); machine translation; pp. 1-5.
PCT International Search Report; International App. No. PCT/US2015/036638; dated Oct. 19, 2015; pp. 1-4.
Ovi et al.; "Symmetrical Slot Loading in Elliptical Microstrip Patch Antennas Partially Filled with Mue Negative Metamaterials"; PIERS Proceedings, Moscow, Russia; Aug. 19-23, 2012; pp. 542-545.
PCT International Search Report; International App. No. PCT/US2014/017454; dated Aug. 28, 2014; pp. 1-4.
IP Australia Patent Examination Report No. 1; Patent Application No. 2011314378; dated Mar. 4, 2016; pp. 1-4.
Chinese State Intellectual Property Office, Notification of Fourth Office Action, App. No. 2011/80055705.8 (Based on PCT Patent Application No. PCT/US2011/001755); dated May 20, 2016 (received by our Agent on May 30, 2016); pp. 1-4 (machine translation only).
Definition from Merriam-Webster Online Dictionary; "Integral"; Merriam-Webster Dictionary; cited and printed by Examiner on Dec. 8, 2015; pp. 1-5; located at: http://www.merriam-webster.com/dictonary/integral.
Varlamos et al.; "Electronic Beam Steering Using Switched Parasitic Smart Antenna Arrays"; Progress in Electromagnetics Research; PIER 36; bearing a date of 2002; pp. 101-119.
PCT International Search Report; International App. No. PCT/US2016/037667; dated Sep. 7, 2016; pp. 1-3.
Extended European Search Report; European App. No. EP 14 77 0686; dated Oct. 14, 2016 (received by our Agent on Oct. 12, 2016); pp. 1-7.
The State Intellectual Property Office of P.R.C., Fifth Office Action, App. No. 2011/80055705.8 (Based on PCT Patent Application No. PCT/US2011/001755); dated Nov. 16, 2016 (received by our Agent on Nov. 23, 2016); pp. 1-3 (machine translation, as provided).
Canadian Intellectual Property Office, Canadian Examination Search Report, Pursuant to Subsection 30(2); App. No. 2,814,635; dated Dec. 1, 2016 (received by our Agent on Dec. 6, 2016); pp. 1-3
European Search Report; European App. No. EP 11 832 873.1; dated Sep. 21, 2016; pp. 1-6.
Ayob et al.; "A Survey of Surface Mount Device Placement Machine Optimisation: Machine Classification"; Computer Science Technical Report No. NOTTCS-TR-2005-8; Sep. 2005; pp. 1-34.
"Aperture", Definition of Aperture by Merriam-Webster; located at http://www.merriam-webster.com/dictionary/aperture; printed by Examiner on Nov. 30, 2016; pp. 1-9; Merriam-Webster, Incorporated.
PCT International Preliminary Report on Patentability; International App. No. PCT/US2014/070645; dated Jun. 21, 2016; pp. 1-12.

(56) References Cited

OTHER PUBLICATIONS

Supplementary European Search Report, Pursuant to Rule 62 EPC; App. No. EP 14 87 2595; dated Jul. 3, 2017 (received by our Agent on Jul. 7, 2017); pp. 1-16.
Supplementary European Search Report, Pursuant to Rule 62 EPC; App. No. EP 14 87 2874; dated Jul. 3, 2017 (received by our Agent on Jul. 7, 2017); pp. 1-15.
European Patent Office, Supplementary European Search Report, Pursuant to Rule 62 EPC; App. No. EP 14891152; dated Jul. 20, 2017 (received by our Agent on Jul. 26, 2017); pp. 1-4.

* cited by examiner

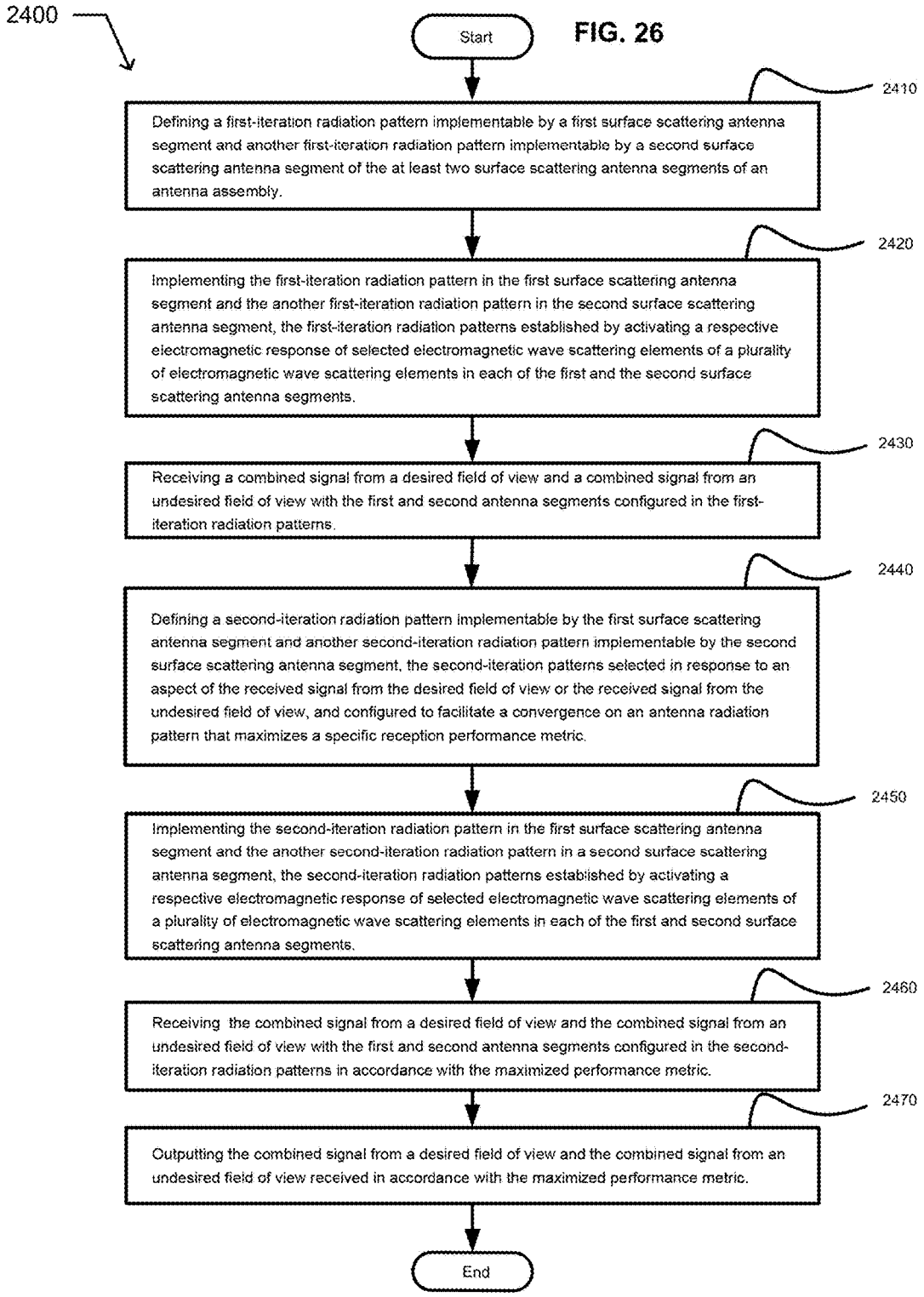
2400
Start
FIG. 26
2410
Defining a first-iteration radiation pattern implementable by a first surface scattering antenna segment and another first-iteration radiation pattern implementable by a second surface scattering antenna segment of the at least two surface scattering antenna segments of an antenna assembly.
2420
Implementing the first-iteration radiation pattern in the first surface scattering antenna segment and the another first-iteration radiation pattern in the second surface scattering antenna segment, the first-iteration radiation patterns established by activating a respective electromagnetic response of selected electromagnetic wave scattering elements of a plurality of electromagnetic wave scattering elements in each of the first and the second surface scattering antenna segments.
2430
Receiving a combined signal from a desired field of view and a combined signal from an undesired field of view with the first and second antenna segments configured in the first-iteration radiation patterns.
2440
Defining a second-iteration radiation pattern implementable by the first surface scattering antenna segment and another second-iteration radiation pattern implementable by the second surface scattering antenna segment, the second-iteration patterns selected in response to an aspect of the received signal from the desired field of view or the received signal from the undesired field of view, and configured to facilitate a convergence on an antenna radiation pattern that maximizes a specific reception performance metric.
2450
Implementing the second-iteration radiation pattern in the first surface scattering antenna segment and the another second-iteration radiation pattern in a second surface scattering antenna segment, the second-iteration radiation patterns established by activating a respective electromagnetic response of selected electromagnetic wave scattering elements of a plurality of electromagnetic wave scattering elements in each of the first and second surface scattering antenna segments.
2460
Receiving the combined signal from a desired field of view and the combined signal from an undesired field of view with the first and second antenna segments configured in the second-iteration radiation patterns in accordance with the maximized performance metric.
2470
Outputting the combined signal from a desired field of view and the combined signal from an undesired field of view received in accordance with the maximized performance metric.
End

FIG. 27

2500

2510 Means for defining a first-iteration radiation pattern implementable by a first surface scattering antenna segment and another first-iteration radiation pattern implementable by a second surface scattering antenna segment of the at least two surface scattering antenna segments of an antenna assembly.

2520 Means for implementing the first-iteration radiation pattern in the first surface scattering antenna segment and the another first-iteration radiation pattern in the second surface scattering antenna segment, the first-iteration radiation patterns established by activating respective electromagnetic response of selected electromagnetic wave scattering elements of a plurality of electromagnetic wave scattering elements in each of the first and the second surface scattering antenna segments.

2530 Means for receiving a combined signal from a desired field of view and a combined signal from an undesired field of view with the first and second antenna segments configured in the first-iteration radiation patterns.

2540 Means for defining a second-iteration radiation pattern implementable by the first surface scattering antenna segment and another second-iteration radiation pattern implementable by the second surface scattering antenna segment, the second-iteration patterns selected in response to an aspect of the received signal from the desired field of view or the received signal in the undesired field of view, and configured to facilitate a convergence on an antenna radiation pattern that maximizes a specific reception performance metric.

2550 Means for implementing the second-iteration radiation pattern in the first surface scattering antenna segment and the another second-iteration radiation pattern in a second surface scattering antenna segment, the second-iteration radiation patterns established by activating a respective electromagnetic response of selected electromagnetic wave scattering elements of a plurality of electromagnetic wave scattering elements in each of the first and second surface scattering antenna segments.

2560 Means for receiving the combined signal from a desired field of view and the combined signal from an undesired field of view with the first and second antenna segments configured in the second-iteration radiation patterns in accordance with the maximized performance metric.

2570 Means for outputting the combined signal in a desired field of view and the combined signal from an undesired field of view received in accordance with the maximized performance metric.

2580 The antenna assembly including at least two surface scattering antenna segments, each segment of the at least two surface scattering antenna segments including:
an electromagnetic waveguide structure; and
a plurality of electromagnetic wave scattering elements distributed along the waveguide structure and having an inter-element spacing substantially less than a free-space wavelength of a highest operating frequency band of the antenna segment, each electromagnetic wave scattering element of the plurality of electromagnetic wave scattering elements having a respective activatable electromagnetic response to a guided wave propagating in their respective waveguide structure, the plurality of electromagnetic wave scattering elements operable in combination to produce a controllable radiation pattern.

ANTENNA SYSTEM HAVING AT LEAST TWO APERTURES FACILITATING REDUCTION OF INTERFERING SIGNALS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)). In addition, the present application is related to the "Related Applications," if any, listed below.

PRIORITY APPLICATIONS

None.

SUBJECT-MATTER-RELATED APPLICATIONS

U.S. Patent Application No. 61/455,171, entitled SURFACE SCATTERING ANTENNAS, naming NATHAN KUNDTZ ET AL. as inventors, filed Oct. 15, 2010, is related to the present application.

U.S. patent application Ser. No. 13/317,338, entitled SURFACE SCATTERING ANTENNAS, naming ADAM BILY, ANNA K. BOARDMAN, RUSSELL J. HANNIGAN, JOHN HUNT, NATHAN KUNDTZ, DAVID R. NASH, RYAN ALLAN STEVENSON, AND PHILIP A. SULLIVAN as inventors, filed Oct. 14, 2011, is related to the present application.

U.S. patent application Ser. No. 13/838,934, entitled SURFACE SCATTERING ANTENNA IMPROVEMENTS, naming ADAM BILY, JEFF DALLAS, RUSSELL HANNIGAN, NATHAN KUNDTZ, DAVID R. NASH, and RYAN ALLAN STEVENSON as inventors, filed Mar. 15, 2013, is related to the present application.

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith. All subject matter of these Related Applications is incorporated herein by reference to the extent such subject matter is not inconsistent herewith.

SUMMARY

For example, and without limitation, an embodiment of the subject matter described herein includes an antenna system. The antenna system includes at least two surface scattering antenna segments. Each segment of the at least two surface scattering antenna segments includes a respective electromagnetic waveguide structure, and a respective plurality of electromagnetic wave scattering elements. The plurality of electromagnetic wave scattering elements are distributed along the waveguide structure and have an inter-element spacing substantially less than a free-space wavelength of a highest operating frequency of the antenna segment. Each electromagnetic wave scattering element of the plurality of electromagnetic wave scattering elements have a respective activatable electromagnetic response to a guided wave propagating in their respective waveguide structure. The plurality of electromagnetic wave scattering elements are operable in combination to produce a controllable radiation pattern. The antenna system includes a gain definition circuit configured to define a series of at least two radiation patterns implementable by the at least two surface scattering antenna segments. The series of at least two respective radiation patterns is selected to facilitate a convergence on an antenna radiation pattern that maximizes a radiation performance metric that includes reception of a signal from a desired field of view or rejection of a signal from an undesired field of view. The antenna system includes an antenna controller configured to sequentiall establish each radiation pattern of the series of at least two radiation patterns by activating the respective electromagnetic response of selected electromagnetic wave scattering elements of the plurality of electromagnetic wave scattering elements of the at least two surface scattering antenna segments. The antenna system includes a receiver signals from the desired field of view and signals from the undesired field of view. In an embodiment, a signal strength includes a signal amplitude or a signal phase.

In an embodiment, the antenna system includes a signal processing circuit configured to combine signals received from the at least two antenna segments and provide a cancellation of the signal from the undesired field of view.

For example, and without limitation, an embodiment of the subject matter described herein includes a method. The method includes defining a first-iteration radiation pattern implementable by a first surface scattering antenna segment and another first-iteration radiation pattern implementable by a second surface scattering antenna segment of at least two surface scattering antenna segments of an antenna assembly. The method includes implementing the first-iteration radiation pattern in the first surface scattering antenna segment and the another first-iteration radiation pattern in the second surface scattering antenna segment. The first-iteration radiation patterns established by activating a respective electromagnetic response of selected electromagnetic wave scattering elements of a plurality of electromagnetic wave scattering elements in each of the first and the second surface scattering antenna segments. The method includes receiving a combined signal in a desired field of view and a combined signal from an undesired field of view with the first and second antenna segments configured in the first-iteration radiation patterns. The method includes defining a second-iteration radiation pattern implementable by the first surface scattering antenna segment and another second-iteration radiation pattern implementable by the second surface scattering antenna segment. The second-iteration patterns selected in response to an aspect of the received signal in the desired field of view or the received signal in the undesired field of view, and configured to facilitate a convergence on an antenna radiation pattern that maximizes a radiation performance metric. The method includes implementing the second-iteration radiation pattern in the first surface scattering antenna segment and the another second-iteration radiation pattern in the second surface scattering antenna segment. The second-iteration radiation patterns established by activating a respective electromagnetic response of selected electromagnetic wave scattering elements of a plurality of electromagnetic wave scattering elements in each of the first and second surface scattering antenna segments. The method includes receiving the combined signal in a desired field of view and the combined signal from an undesired field of view with the first and second antenna segments configured in the second-iteration radiation patterns in accordance with the maximized performance metric. The method includes outputting the combined signal in a desired field of view and the combined signal from an undesired field of view received in accordance with the maximized performance metric.

The antenna assembly includes at least two surface scattering antenna segments. Each segment of the at least two surface scattering antenna segments respectively including an electromagnetic waveguide structure, and a plurality of electromagnetic wave scattering elements. The plurality of electromagnetic wave scattering elements are distributed along the waveguide structure and have an inter-element spacing substantially less than a free-space wavelength of a highest operating frequency of the antenna segment. Each electromagnetic wave scattering element of the plurality of electromagnetic wave scattering elements has a respective activatable electromagnetic response to a guided wave propagating in their respective waveguide structure. The plurality of electromagnetic wave scattering elements are operable in combination to produce a controllable radiation pattern.

For example, and without limitation, an embodiment of the subject matter described herein includes an antenna system. The antenna system includes means for defining a first-iteration radiation pattern implementable by a first surface scattering antenna segment and another first-iteration radiation pattern implementable by a second surface scattering antenna segment of at least two surface scattering antenna segments of an antenna assembly. The antenna system includes means for implementing the first-iteration radiation pattern in the first surface scattering antenna segment and the another first-iteration radiation pattern in the second surface scattering antenna segment. The first-iteration radiation patterns established by activating a respective electromagnetic response of selected electromagnetic wave scattering elements of a plurality of electromagnetic wave scattering elements in each of the first and the second surface scattering antenna segments. The antenna system includes means for receiving a combined signal in a desired field of view and a combined signal from an undesired field of view with the first and second antenna segments configured in the first-iteration radiation patterns. The antenna system includes means for defining a second-iteration radiation pattern implementable by the first surface scattering antenna segment and another second-iteration radiation pattern implementable by the second surface scattering antenna segment. The second-iteration patterns selected in response to an aspect of the received signal in the desired field of view or the received signal in the undesired field of view, and configured to facilitate a convergence on an antenna radiation pattern that maximizes a radiation performance metric. The antenna system includes means for implementing the second-iteration radiation pattern in the first surface scattering antenna segment and the another second-iteration radiation pattern in a second surface scattering antenna segment. The second-iteration radiation patterns established by activating a respective electromagnetic response of selected electromagnetic wave scattering elements of a plurality of electromagnetic wave scattering elements in each of the first and second surface scattering antenna segments. The antenna system includes means for receiving the combined signal in a desired field of view and the combined signal from an undesired field of view with the first and second antenna segments configured in the second-iteration radiation patterns in accordance with the maximized performance metric. The antenna system includes means for outputting the combined signal in a desired field of view and the combined signal from an undesired field of view received in accordance with the maximized performance metric.

The antenna assembly includes at least two surface scattering antenna segments. Each segment of the at least two surface scattering antenna segments respectively including an electromagnetic waveguide structure, and a plurality of electromagnetic wave scattering elements. The plurality of electromagnetic wave scattering elements are distributed along the waveguide structure and have an inter-element spacing substantially less than a free-space wavelength of a highest operating frequency of the antenna segment. Each electromagnetic wave scattering element of the plurality of electromagnetic wave scattering elements has a respective activatable electromagnetic response to a guided wave propagating in their respective waveguide structure. The plurality of electromagnetic wave scattering elements are operable in combination to produce a controllable radiation pattern.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 26 illustrates an example operational flow 2400; and

FIG. 27 illustrates an example system 2500.

DETAILED DESCRIPTION

Figure 1:
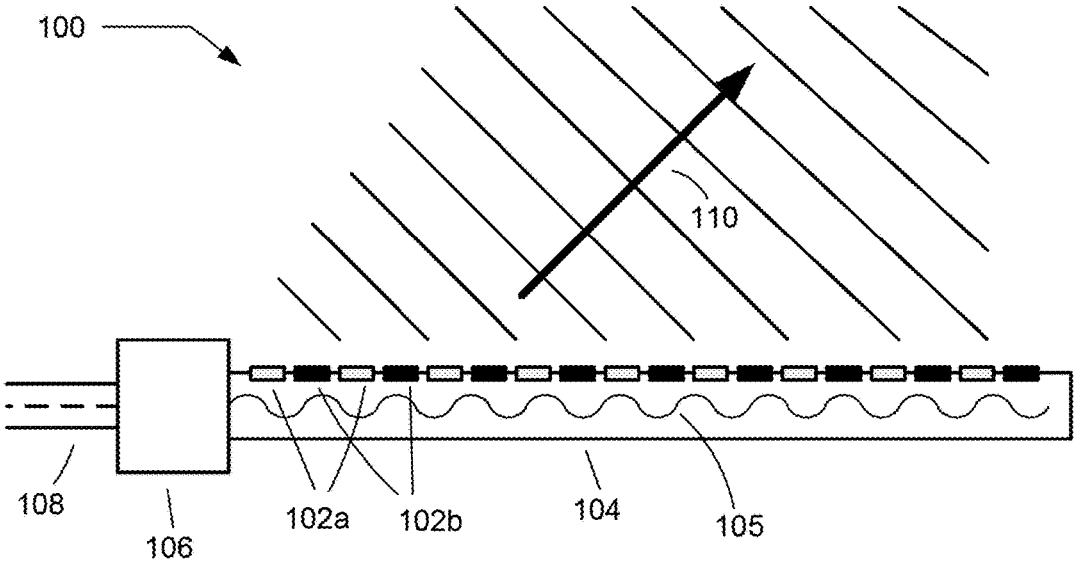
FIG. 1 is a schematic depiction of a surface scattering antenna.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

A schematic illustration of a surface scattering antenna is depicted in FIG. 1. The surface scattering antenna 100 includes a plurality of scattering elements 102*a*, 102*b* that are distributed along a wave-propagating structure 104. The wave propagating structure 104 may be a microstrip, a coplanar waveguide, a parallel plate waveguide, a dielectric slab, a closed or tubular waveguide, or any other structure capable of supporting the propagation of a guided wave or surface wave 105 along or within the structure. In an embodiment, the wave-propagating structure may be an energy feeding structure. The wavy line 105 is a symbolic depiction of the guided wave or surface wave, and this symbolic depiction is not intended to indicate an actual wavelength or amplitude of the guided wave or surface wave; moreover, while the wavy line 105 is depicted as within the wave-propagating structure 104 (e.g. as for a guided wave in a metallic waveguide), for a surface wave the wave may be substantially localized outside the wave-propagating structure (e.g. as for a TM mode on a single wire transmission line or a "spoof plasmon" on an artificial impedance surface). The scattering elements 102*a*, 102*b* may include scattering elements that are embedded within, positioned on a surface of, or positioned within an evanescent proximity of, the wave-propagation structure 104. For example, the scattering elements can include complementary metamaterial elements such as those presented in D. R. Smith et al, "Metamaterials for surfaces and waveguides," U.S. Patent Application Publication No. 2010/0156573, and A. Bily et al, "Surface scattering antennas," U.S. Patent Application Publication No. 2012/0194399, each of which is herein incorporated by reference. As another example, the scattering elements can include patch elements, as discussed below.

The surface scattering antenna also includes at least one feed connector 106 that is configured to couple the wave-propagation structure 104 to a feed structure 108. The feed structure 108 (schematically depicted as a coaxial cable) may be a transmission line, a waveguide, or any other structure capable of providing an electromagnetic signal that may be launched, via the feed connector 106, into a guided wave or surface wave 105 of the wave-propagating structure 104. The feed connector 106 may be, for example, a coaxial-to-microstrip connector (e.g. an SMA-to-PCB adapter), a coaxial-to-waveguide connector, a mode-matched transition section, etc. While FIG. 1 depicts the feed connector in an "end-launch" configuration, whereby the guided wave or surface wave 105 may be launched from a peripheral region of the wave-propagating structure (e.g. from an end of a microstrip or from an edge of a parallel plate waveguide), in other embodiments the feed structure may be attached to a non-peripheral portion of the wave-propagating structure, whereby the guided wave or surface wave 105 may be launched from that non-peripheral portion of the wave-propagating structure (e.g. from a midpoint of a microstrip or through a hole drilled in a top or bottom plate of a parallel plate waveguide); and yet other embodiments may provide a plurality of feed connectors attached to the wave-propagating structure at a plurality of locations (peripheral and/or non-peripheral).

The scattering elements 102*a*, 102*b* are adjustable scattering elements having electromagnetic properties that are adjustable in response to one or more external inputs. Various embodiments of adjustable scattering elements are described, for example, in D. R. Smith et al, previously cited, and further in this disclosure. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include non-linear magnetic materials), mechanical inputs (e.g. MEMS, actuators, hydraulics), etc. In the schematic example of FIG. 1, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties. Moreover, the particular pattern of adjustment that is depicted in FIG. 1 (i.e. the alternating arrangement of elements 102*a* and 102*b*) is only an exemplary configuration and is not intended to be limiting.

In the example of FIG. 1, the scattering elements 102*a*, 102*b* have first and second couplings to the guided wave or surface wave 105 that are functions of the first and second electromagnetic properties, respectively. For example, the first and second couplings may be first and second polarizabilities of the scattering elements at the frequency or frequency band of the guided wave or surface wave. In one approach the first coupling is a substantially nonzero coupling whereas the second coupling is a substantially zero coupling. In another approach both couplings are substantially nonzero but the first coupling is substantially greater than (or less than) than the second coupling. On account of the first and second couplings, the first and second scattering elements 102*a*, 102*b* are responsive to the guided wave or surface wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as a plane wave 110 that radiates from the surface scattering antenna 100.

The emergence of the plane wave may be understood by regarding the particular pattern of adjustment of the scattering elements (e.g. an alternating arrangement of the first and second scattering elements in FIG. 1) as a pattern that defines a grating that scatters the guided wave or surface wave 105 to produce the plane wave 110. Because this pattern is adjustable, some embodiments of the surface scattering antenna may provide adjustable gratings or, more generally, holograms, where the pattern of adjustment of the scattering elements may be selected according to principles of holography. Suppose, for example, that the guided wave or surface wave may be represented by a complex scalar input wave $\Psi_{in}$ that is a function of position along the wave-propagating structure 104, and it is desired that the surface scattering antenna produce an output wave that may be represented by another complex scalar wave $\Psi_{out}$. Then a pattern of adjustment of the scattering elements may be selected that corresponds to an interference pattern of the input and output waves along the wave-propagating structure. For example, the scattering elements may be adjusted to provide couplings to the guided wave or surface wave that are functions of (e.g. are proportional to, or step-functions of) an interference term given by $\mathrm{Re}[\Psi_{out}\Psi_{in}^*]$. In this way, embodiments of the surface scattering antenna may be adjusted to provide arbitrary antenna radiation patterns by identifying an output wave $\Psi_{out}$ corresponding to a selected beam pattern, and then adjusting the scattering elements accordingly as above. Embodiments of the surface scattering antenna may therefore be adjusted to provide, for example, a selected beam direction (e.g. beam steering), a selected beam width or shape (e.g. a fan or pencil beam having a broad or narrow beamwidth), a selected arrangement of nulls (e.g. null steering), a selected arrangement of multiple beams, a selected polarization state (e.g. linear, circular, or elliptical polarization), a selected overall phase, or any combination thereof. Alternatively or additionally, embodiments of the surface scattering antenna may be adjusted to provide a selected near field radiation profile, e.g. to provide near-field focusing and/or near-field nulls.

Because the spatial resolution of the interference pattern is limited by the spatial resolution of the scattering elements, the scattering elements may be arranged along the wave-propagating structure with inter-element spacings that are much less than a free-space wavelength corresponding to a highest operating frequency of the device (for example, less than one-third, one-fourth, or one-fifth of this free-space wavelength). In some approaches, the operating frequency is a microwave frequency, selected from frequency bands such as L, S, C, X, Ku, K, Ka, Q, U, V, E, W, F, and D, corresponding to frequencies ranging from about 1 GHz to 170 GHz and free-space wavelengths ranging from millimeters to tens of centimeters. In other approaches, the operating frequency is an RF frequency, for example in the range of about 100 MHz to 1 GHz. In yet other approaches, the operating frequency is a millimeter-wave frequency, for example in the range of about 170 GHz to 300 GHz. These ranges of length scales admit the fabrication of scattering elements using conventional printed circuit board or lithographic technologies.

Figure 2A:
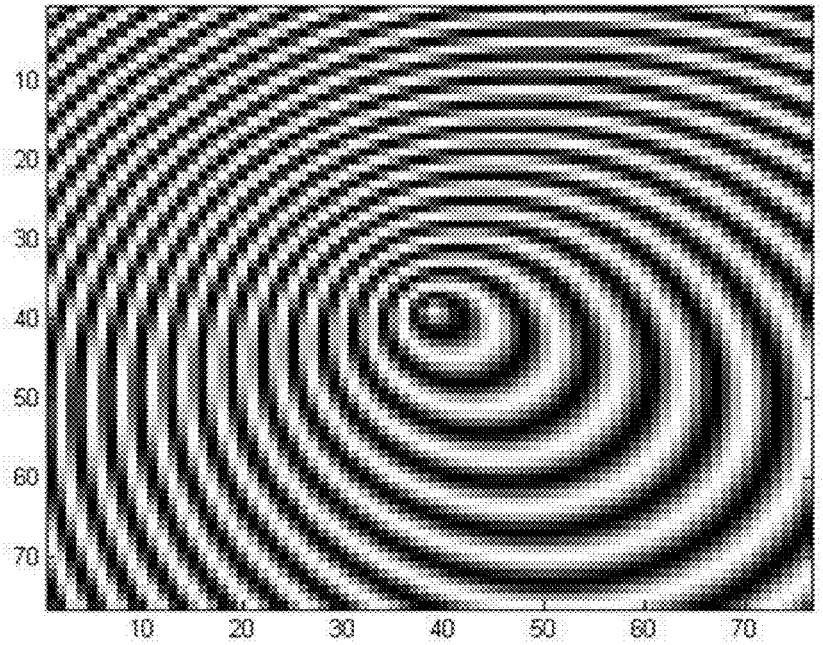
FIGS. 2A and 2B respectively depict an exemplary adjustment pattern and corresponding beam pattern for a surface scattering antenna.
Figure 2B:
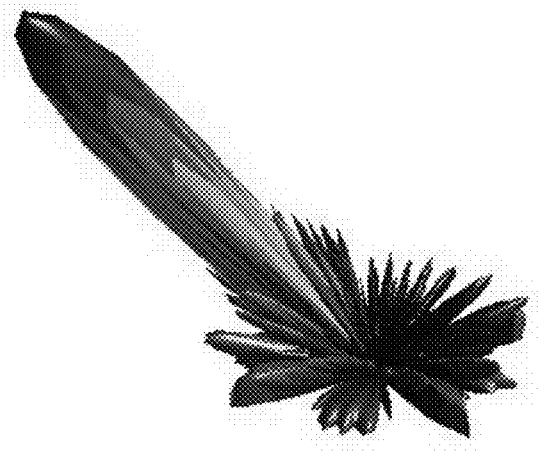
Figure 3A:
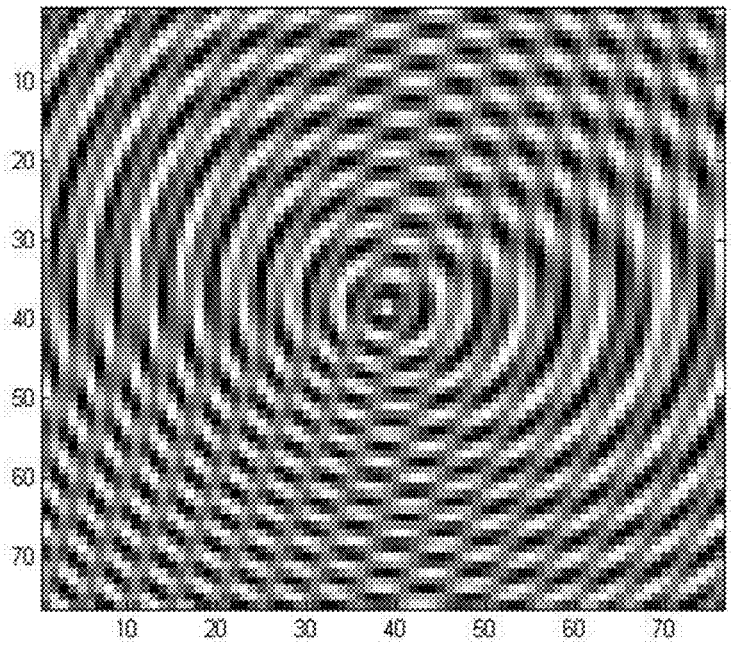
FIGS. 3A and 3B respectively depict another exemplary adjustment pattern and corresponding beam pattern for a surface scattering antenna.
Figure 3B:
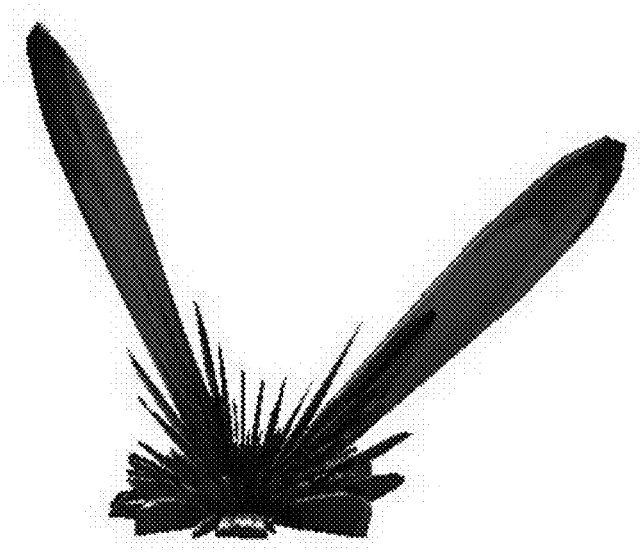
Figure 4A:
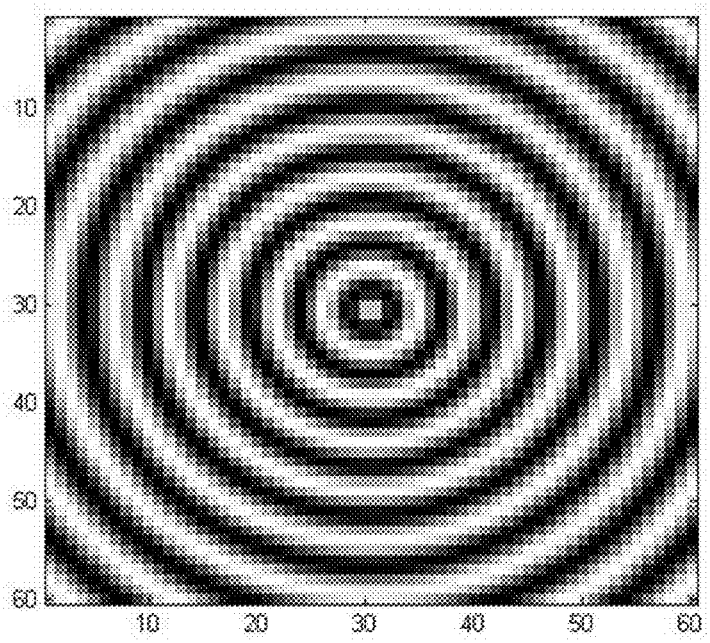
FIGS. 4A and 4B respectively depict another exemplary adjustment pattern and corresponding field pattern for a surface scattering antenna.
Figure 4B:
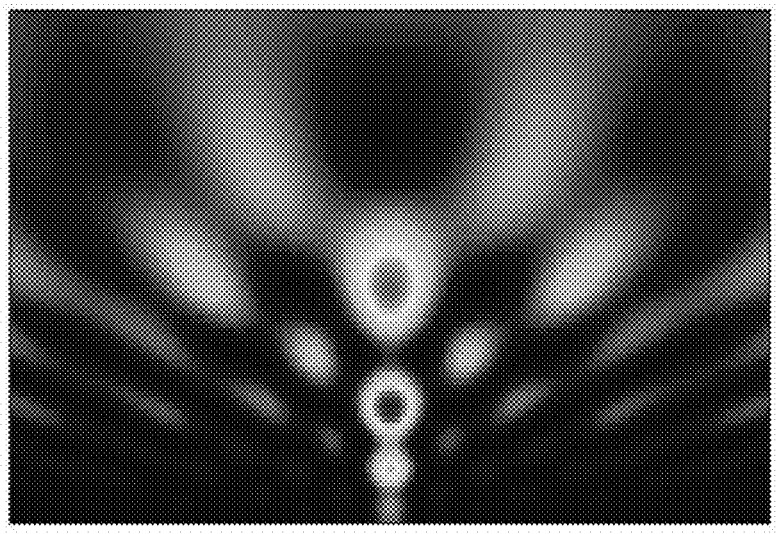

In some approaches, the surface scattering antenna includes a substantially one-dimensional wave-propagating structure 104 having a substantially one-dimensional arrangement of scattering elements, and the pattern of adjustment of this one-dimensional arrangement may provide, for example, a selected antenna radiation profile as a function of zenith angle (i.e. relative to a zenith direction that is parallel to the one-dimensional wave-propagating structure). In other approaches, the surface scattering antenna includes a substantially two-dimensional wave-propagating structure 104 having a substantially two-dimensional arrangement of scattering elements, and the pattern of adjustment of this two-dimensional arrangement may provide, for example, a selected antenna radiation profile as a function of both zenith and azimuth angles (i.e. relative to a zenith direction that is perpendicular to the two-dimensional wave-propagating structure). Exemplary adjustment patterns and beam patterns for a surface scattering antenna that includes a two-dimensional array of scattering elements distributed on a planar rectangular wave-propagating structure are depicted in FIGS. 2A-4B. In these exemplary embodiments, the planar rectangular wave-propagating structure includes a monopole antenna feed that is positioned at the geometric center of the structure. FIG. 2A presents an adjustment pattern that corresponds to a narrow beam having a selected zenith and azimuth as depicted by the beam pattern diagram of FIG. 2B. FIG. 3A presents an adjustment pattern that corresponds to a dual-beam far field pattern as depicted by the beam pattern diagram of FIG. 3B. FIG. 4A presents an adjustment pattern that provides near-field focusing as depicted by the field intensity map of FIG. 4B (which depicts the field intensity along a plane perpendicular to and bisecting the long dimension of the rectangular wave-propagating structure).

In some approaches, the wave-propagating structure is a modular wave-propagating structure and a plurality of modular wave-propagating structures may be assembled to compose a modular surface scattering antenna. For example, a plurality of substantially one-dimensional wave-propagating structures may be arranged, for example, in an interdigital fashion to produce an effective two-dimensional arrangement of scattering elements. The interdigital arrangement may comprise, for example, a series of adjacent linear structures (i.e. a set of parallel straight lines) or a series of adjacent curved structures (i.e. a set of successively offset curves such as sinusoids) that substantially fills a two-dimensional surface area. These interdigital arrangements may include a feed connector having a tree structure, e.g. a binary tree providing repeated forks that distribute energy from the feed structure 108 to the plurality of linear structures (or the reverse thereof). As another example, a plurality of substantially two-dimensional wave-propagating structures (each of which may itself comprise a series of one-dimensional structures, as above) may be assembled to produce a larger aperture having a larger number of scattering elements; and/or the plurality of substantially two-dimensional wave-propagating structures may be assembled as a three-dimensional structure (e.g. forming an A-frame structure, a pyramidal structure, or other multi-faceted structure). In these modular assemblies, each of the plurality of modular wave-propagating structures may have its own feed connector(s) 106, and/or the modular wave-propagating structures may be configured to couple a guided wave or surface wave of a first modular wave-propagating structure into a guided wave or surface wave of a second modular wave-propagating structure by virtue of a connection between the two structures.

In some applications of the modular approach, the number of modules to be assembled may be selected to achieve an aperture size providing a desired telecommunications data capacity and/or quality of service, and/or a three-dimensional arrangement of the modules may be selected to reduce potential scan loss. Thus, for example, the modular assembly could comprise several modules mounted at various locations/orientations flush to the surface of a vehicle such as an aircraft, spacecraft, watercraft, ground vehicle, etc. (the modules need not be contiguous). In these and other approaches, the wave-propagating structure may have a substantially non-linear or substantially non-planar shape whereby to conform to a particular geometry, therefore providing a conformal surface scattering antenna (conforming, for example, to the curved surface of a vehicle).

More generally, a surface scattering antenna is a reconfigurable antenna that may be reconfigured by selecting a pattern of adjustment of the scattering elements so that a corresponding scattering of the guided wave or surface wave produces a desired output wave. Suppose, for example, that the surface scattering antenna includes a plurality of scattering elements distributed at positions $\{r_j\}$ along a wave-propagating structure 104 as in FIG. 1 (or along multiple wave-propagating structures, for a modular embodiment) and having a respective plurality of adjustable couplings $\{\alpha_j\}$ to the guided wave or surface wave 105. The guided wave or surface wave 105, as it propagates along or within the (one or more) wave-propagating structure(s), presents a wave amplitude $A_j$ and phase $\varphi_j$ to the jth scattering element; subsequently, an output wave is generated as a superposition of waves scattered from the plurality of scattering elements:

$$E(\theta,\phi)=\sum_j R_j(\theta,\phi)\alpha_j A_j e^{i\varphi_j} e^{i(k(\theta,\phi)\cdot r_j)}, \tag{1}$$

where $E(\theta,\phi)$ represents the electric field component of the output wave on a far-field radiation sphere, $R_j(\theta,\phi)$ represents a (normalized) electric field pattern for the scattered wave that is generated by the jth scattering element in response to an excitation caused by the coupling $\alpha_j$, and $k(\theta,\phi)$ represents a wave vector of magnitude $\omega/c$ that is perpendicular to the radiation sphere at $(\theta,\phi)$. Thus, embodiments of the surface scattering antenna may provide a reconfigurable antenna that is adjustable to produce a desired output wave $E(\theta,\phi)$ by adjusting the plurality of couplings $\{\alpha_j\}$ in accordance with equation (1).

The wave amplitude $A_j$ and phase $\varphi_j$ of the guided wave or surface wave are functions of the propagation characteristics of the wave-propagating structure 104. These propagation characteristics may include, for example, an effective refractive index and/or an effective wave impedance, and these effective electromagnetic properties may be at least partially determined by the arrangement and adjustment of the scattering elements along the wave-propagating structure. In other words, the wave-propagating structure, in combination with the adjustable scattering elements, may provide an adjustable effective medium for propagation of the guided wave or surface wave, e.g. as described in D. R. Smith et al, previously cited. Therefore, although the wave amplitude $A_j$ and phase $\varphi_j$ of the guided wave or surface wave may depend upon the adjustable scattering element couplings $\{\alpha_j\}$ (i.e. $A_i=A_i(\{\alpha_j\})$, $\varphi_i=\varphi_i(\{\alpha_j\})$), in some embodiments these dependencies may be substantially predicted according to an effective medium description of the wave-propagating structure.

In some approaches, the reconfigurable antenna is adjustable to provide a desired polarization state of the output wave $E(\theta,\phi)$. Suppose, for example, that first and second subsets $LP^{(1)}$ and $LP^{(2)}$ of the scattering elements provide (normalized) electric field patterns $R^{(1)}(\theta,\phi)$ and $R^{(2)}(\theta,\phi)$, respectively, that are substantially linearly polarized and substantially orthogonal (for example, the first and second subjects may be scattering elements that are perpendicularly oriented on a surface of the wave-propagating structure 104). Then the antenna output wave $E(\theta,\phi)$ may be expressed as a sum of two linearly polarized components:

$$E(\theta,\phi)=E^{(1)}(\theta,\phi)+E^{(2)}(\theta,\phi)=\Lambda^{(1)}R^{(1)}(\theta,\phi)+\Lambda^{(2)}R^{(2)}(\theta,\phi), \tag{2}$$

where $$\Lambda^{(1,2)}(\theta,\phi)=\sum_{j\in LP^{(1,2)}}\alpha_j A_j e^{i\varphi_j} e^{i(k(\theta,\phi)\cdot r_j)} \tag{3}$$

are the complex amplitudes of the two linearly polarized components. Accordingly, the polarization of the output wave $E(\theta,\phi)$ may be controlled by adjusting the plurality of couplings $\{\alpha_j\}$ In accordance with equations (2)-(3), e.g. to provide an output wave with any desired polarization (e.g. linear, circular, or elliptical).

Alternatively or additionally, for embodiments in which the wave-propagating structure has a plurality of feeds (e.g. one feed for each "finger" of an interdigital arrangement of one-dimensional wave-propagating structures, as discussed above), a desired output wave $E(\theta,\phi)$ may be controlled by adjusting gains of individual amplifiers for the plurality of feeds. Adjusting a gain for a particular feed line would correspond to multiplying the $A_j$'s by a gain factor G for those elements j that are fed by the particular feed line. Especially, for approaches in which a first wave-propagating structure having a first feed (or a first set of such structures/feeds) is coupled to elements that are selected from $LP^{(1)}$ and a second wave-propagating structure having a second feed (or a second set of such structures/feeds) is coupled to elements that are selected from $LP^{(2)}$, depolarization loss (e.g., as a beam is scanned off-broadside) may be compensated by adjusting the relative gain(s) between the first feed(s) and the second feed(s).

Figure 10:
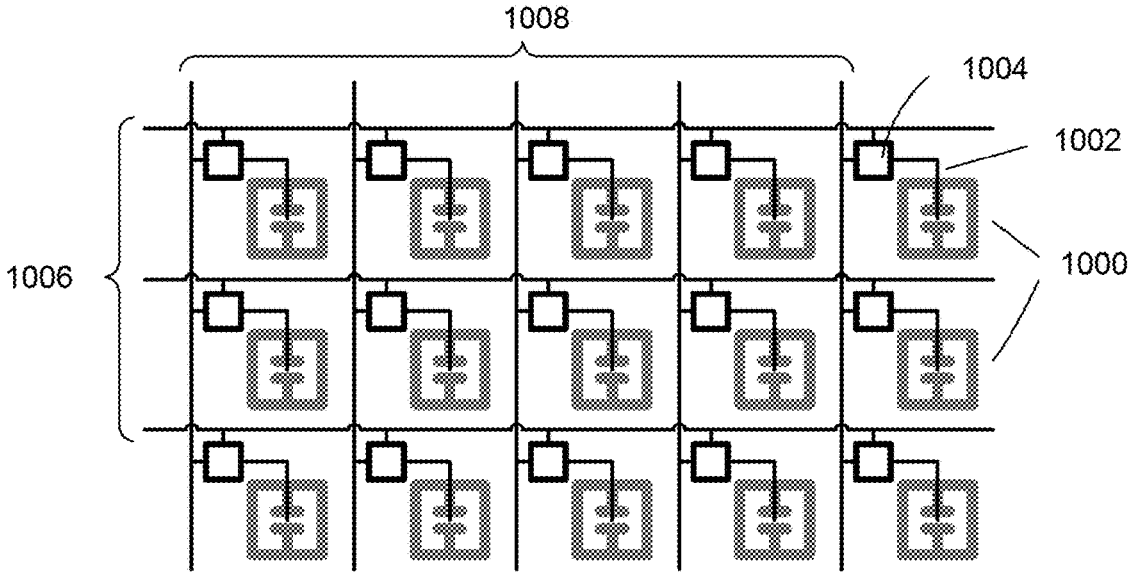
FIG. 10 depicts a surface scattering antenna with matrix addressing of the scattering elements.

As mentioned previously in the context of FIG. 1, in some approaches the surface scattering antenna 100 includes a wave-propagating structure 104 that may be implemented as a closed waveguide (or a plurality of closed waveguides); and in these approaches, the scattering elements may include complementary metamaterial elements or patch elements. Exemplary closed waveguides that include complementary metamaterial elements are depicted in FIGS. 10 and 11 of A. Bily et al, previously cited. Another exemplary closed waveguide embodiment that includes patch elements is presently depicted in FIG. 5. In this embodiment, a closed waveguide with a rectangular cross section is defined by a trough 502 and a first printed circuit board 510 having three layers: a lower conductor 512, a middle dielectric 514, and an upper conductor 516. The upper and lower conductors may be electrically connected by stitching vias (not shown). The trough 502 can be implemented as a piece of metal that is milled or cast to provide the "floor and walls" of the closed waveguide, with the first printed circuit board 510 providing the waveguide "ceiling." Alternatively, the trough 502 may be implemented with an epoxy laminate material (such as FR-4) in which the waveguide channel is routed or machined and then plated (e.g. with copper) using a process similar to a standard PCB through hole/via process. Overlaid on the first printed circuit board 510 are a dielectric spacer 520 and second printed circuit board 530. As the unit cell cutaway shows, the conducting surface 516 has an iris 518 that permits coupling between a guided wave and the resonator element 540, which in this case is a rectangular patch element disposed on the lower surface of the second printed circuit board 530. A via 536 through the dielectric layer 534 of the second printed circuit board 530 can be used to connect a bias voltage line 538 to the patch element 540. The patch element 540 may be optionally bounded by collonades of vias 550 extended through the dielectric layer 534 to reduce coupling or crosstalk between adjacent unit cells. The dielectric spacer 520 includes a cutout region 525 between the iris 518 and the patch 540, and this cutout region is filled with an electrically tunable medium (such as a liquid crystal medium) to accomplish tuning of the cell resonance.

Figure 5:
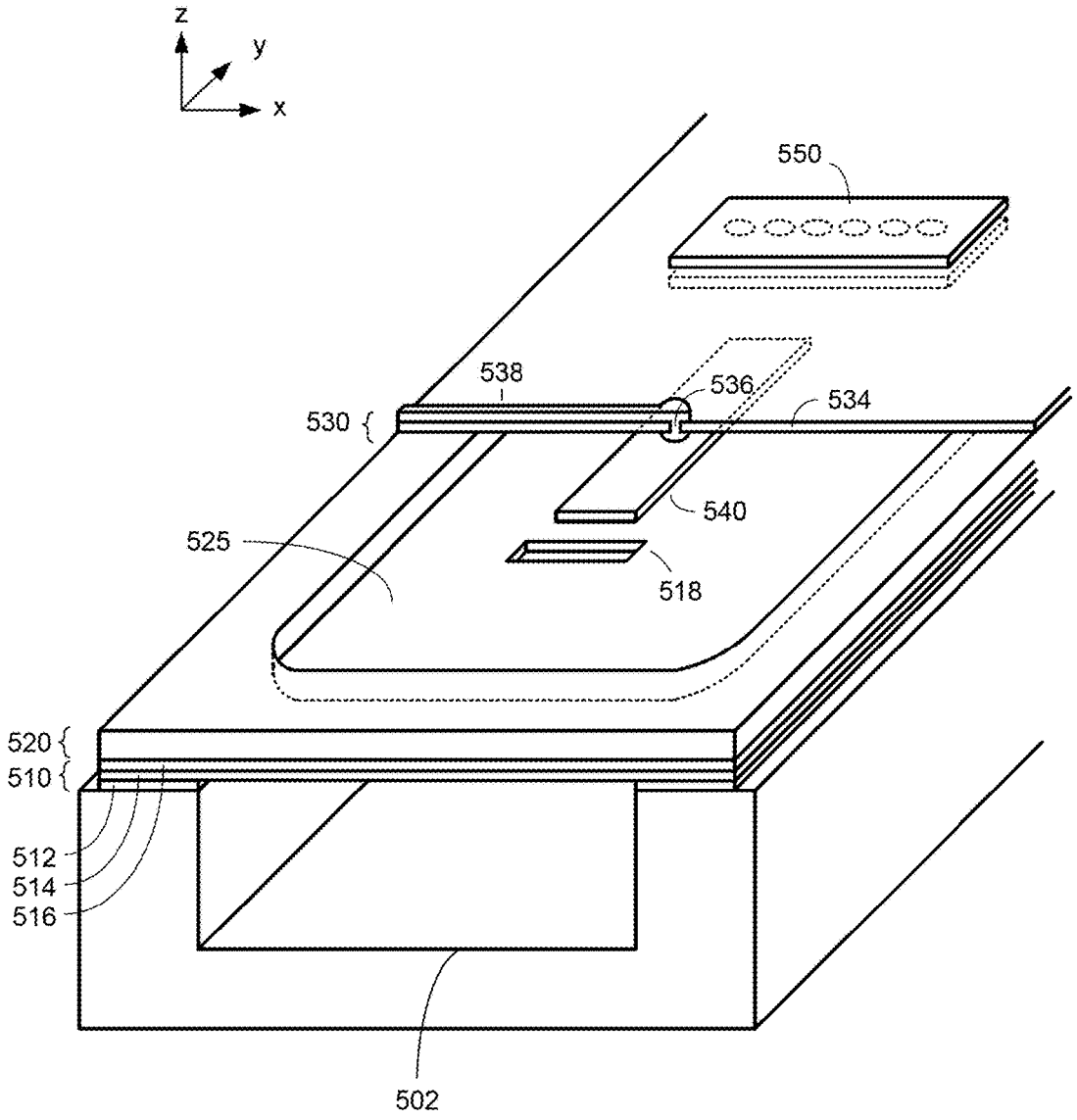
FIG. 5 depicts an embodiment of a surface scattering antenna including a patch element.

While the waveguide embodiment of FIG. 5 provides a waveguide having a simple rectangular cross section, in some approaches the waveguide may include one or more ridges (as in a double-ridged waveguide). Ridged waveguides can provide greater bandwidth than simple rectangular waveguides and the ridge geometries (widths/heights) can be varied along the length of the waveguide to control the couplings to the scattering elements (e.g. to enhance aperture efficiency and/or control aperture tapering of the beam profile) and/or to provide a smooth impedance transition (e.g. from an SMA connector feed). Alternatively or additionally, the waveguide may be loaded with a dielectric material (such as PTFE). This dielectric material can occupy all or a portion of the waveguide cross section, and the amount of the cross section that is occupied can also be tapered along the length of the waveguide.

Figure 6A:
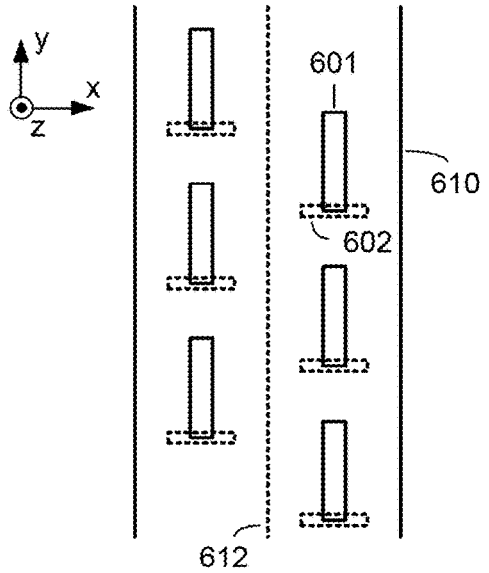
FIGS. 6A and 6B depict examples of patch elements on a waveguide.
Figure 6B:
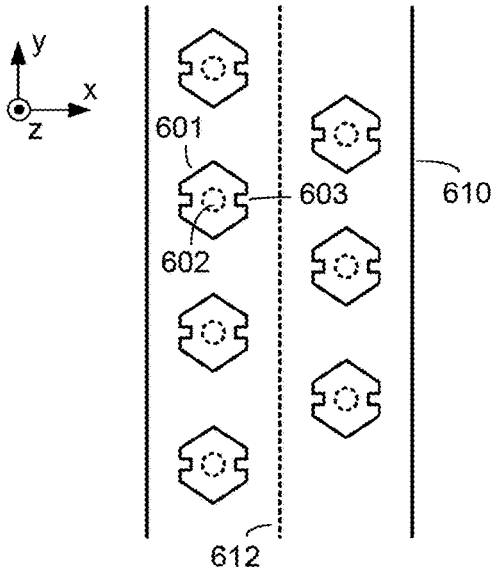

While the example of FIG. 5 depicts a rectangular patch 540 fed by a narrow iris 518, a variety of patch and iris geometries may be used, with exemplary configurations depicted in FIG. 6A-6B. These figures depict the placement of patches 601 and irises 602 when viewed looking down upon a closed waveguide 610 having a center axis 612. FIG. 6A shows rectangular patches 601 oriented along the y-direction and edge-fed by slit-like irises 602 oriented along the x-direction. FIG. 6B shows hexagonal patches 601 center-fed by circular irises 602. The hexagonal patches may include notches 603 to adjust the resonant frequencies of the patches. It will be appreciated that the irises and patches can take a variety of other shapes including rectangles, squares, ellipses, circles, or polygons, with or without notches or tabs to adjust resonant frequencies, and that the relative lateral (x and/or y) position between patch and iris may be adjusted to achieve a desired patch response, e.g. edge-fed or center-fed. For example, an offset feed may be used to stimulate circularly polarization radiation. The positions, shapes, and/or sizes of the irises and/or patches can be gradually adjusted or tapered along the length of the waveguide, to control the waveguide couplings to the patch elements (e.g. to enhance overall aperture efficiency and/or control aperture tapering of the beam profile).

Figure 6C:
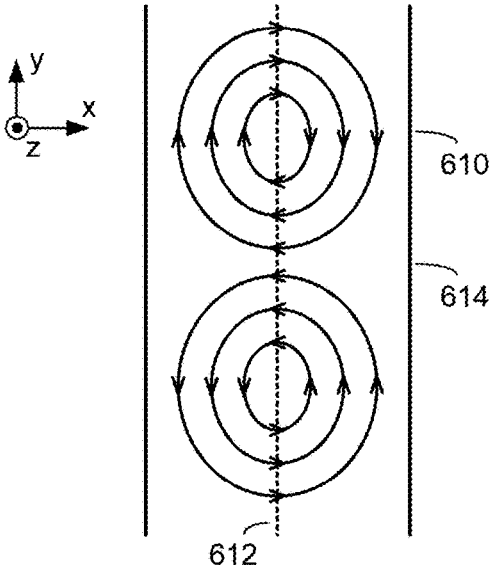
FIG. 6C depicts field lines for a waveguide mode.

Because the irises 602 couple the patches 601 to the guided wave mode by means of the H-field that is present at the upper surface of the waveguide, the irises can be particularly positioned along the y-direction (perpendicular to the waveguide) to exploit the pattern of this H-field at the upper surface of the waveguide. FIG. 6C depicts this H-field pattern for the dominant TE10 mode of a rectangular waveguide. On the center axis 612 of the waveguide, the H-field is entirely directed along the x-direction, whereas at the edge 614 of the waveguide, the H-field is entirely directed along the y-direction. For a slit-like iris oriented along the x-direction, the iris-mediated coupling between the patch and the waveguide can be adjusted by changing the x-position of the iris; thus, for example, slit-like irises can be positioned equidistant from the center axis 612 on left and right sides of the waveguide for equal coupling, as in FIG. 6A. This x-positioning of the irises can also be gradually adjusted or tapered along the length of the waveguide, to control the couplings to the patch elements (e.g. to enhance overall aperture efficiency and/or control aperture tapering of the beam profile).

For positions intermediate between the center axis 612 and the edge 614 in FIG. 6C, the H-field has both x and y components and sweeps out an ellipse at a fixed iris location as the guided wave mode propagates along the waveguide. Thus, the iris-mediated coupling between the patch and the waveguide can be adjusted by changing the x-position of the iris: changing the distance from the center axis 612 adjusts the eccentricity of the coupled H-field, which switching from one side of the center axis to the other side reverses the direction of rotation of the coupled H-field.

In one approach, the rotation of the H-field for a fixed position away from the center axis 612 of the waveguide can be exploited to provide a beam that is circularly polarized by virtue of this H-field rotation. A patch with two resonant modes having mutually orthogonal polarization states can leverage the rotation of the H-field excitation to result in a circular or elliptical polarization. For example, for a guided wave TE10 mode that propagates in the +y direction of FIG. 6C, positioning an iris and center-fed square or circular patch halfway between the center axis and the left edge of the waveguide will yield a right-circular-polarized radiation pattern for the patch, while positioning the iris and center-fed square or circular patch halfway between the center axis and the right edge of the waveguide will yield a left-circular-polarized radiation pattern for the patch. Thus, the antenna may be switched between polarization states by switching from active elements on the left half of the waveguide to active elements on the right half of the waveguide or vice versa, or by reversing the direction of propagation of the guided wave TE10 mode (e.g. by feeding the waveguide from the opposite end).

Alternatively, for scattering elements that yield linear polarization patterns, as for the configuration of FIG. 6A, the linear polarization may be converted to circular polarization by placing a linear-to-circular polarization conversion structure above the scattering elements. For example, a quarter-wave plate or meander-line structure may be positioned above the scattering elements. Quarter-wave plates may include anisotropic dielectric materials (see, e.g., H. S. Kirschbaum and S. Chen, "A Method of Producing Broad-Band Circular Polarization Employing an Anisotropic Dielectric," IRE Trans. Micro. Theory. Tech., Vol. 5, No. 3, pp. 199-203, 1957; J. Y. Chin et al, "An efficient broadband metamaterial wave retarder," Optics Express, Vol. 17, No. 9, pp. 7640-7647, 2009), and/or may also be implemented as artificial magnetic materials (see, e.g., Dunbao Yan et al, "A Novel Polarization Convert Surface Based on Artificial Magnetic Conductor," Asia-Pacific Microwave Conference Proceedings, 2005). Meander-line polarizers typically consist of two, three, four, or more layers of conducting meander line arrays (e.g. copper on a thin dielectric substrate such as Duroid), with interleaved spacer layers (e.g. closed-cell foam). Meander-line polarizers may be designed and implemented according to known techniques, for example as described in Young, et. al., "Meander-Line Polarizer," IEEE Trans. Ant. Prop., pp. 376-378, May 1973 and in R. S. Chu and K. M. Lee, "Analytical Model of a Multilayered Meander-Line Polarizer Plate with Normal and Oblique Plane-Wave Incidence," IEEE Trans. Ant. Prop., Vol. AP-35, No. 6, pp. 652-661, June 1987. In embodiments that include a linear-to-circular polarization conversion structure, the conversion structure may be incorporated into, or may function as, a radome providing environmental insulation for the antenna. Moreover, the conversion structure may be flipped over to reverse the polarization state of the transmitted or received radiation.

The electrically tunable medium that occupies the cutaway region 125 between the iris 118 and patch 140 in FIG. 6 may include a liquid crystal. Liquid crystals have a permittivity that is a function of orientation of the molecules comprising the liquid crystal; and that orientation may be controlled by applying a bias voltage (equivalently, a bias electric field) across the liquid crystal; accordingly, liquid crystals can provide a voltage-tunable permittivity for adjustment of the electromagnetic properties of the scattering element. Exemplary liquid crystals that may be deployed in various embodiments include 4-Cyano-4'-pentylbiphenyl and high birefringence eutectic LC mixtures such as LCMS-107 (LC Matter) or GT3-23001 (Merck).

Some approaches may utilize dual-frequency liquid crystals. In dual-frequency liquid crystals, the liquid crystal director aligns substantially parallel to an applied bias field at a lower frequencies, but substantially perpendicular to an applied bias field at higher frequencies. Accordingly, for approaches that deploy these dual-frequency liquid crystals, tuning of the scattering elements may be accomplished by adjusting the frequency of the applied bias voltage signals.

Other approaches may deploy polymer network liquid crystals (PNLCs) or polymer dispersed liquid crystals (PDLCs), which generally provide much shorter relaxation/switching times for the liquid crystal. An example is a thermal or UV cured mixture of a polymer (such as BPA-dimethacrylate) in a nematic LC host (such as LCMS-107); cf. Y. H. Fan et al, "Fast-response and scattering-free polymer network liquid crystals for infrared light modulators," *Applied Physics Letters* 84, 1233-35 (2004), herein incorporated by reference. Whether the polymer-liquid crystal mixture is described as a PNLC or a PDLC depends upon the relative concentration of polymer and liquid crystal, the latter having a higher concentration of polymer whereby the LC is confined in the polymer network as droplets.

Some approaches may include a liquid crystal that is embedded within an interstitial medium. An example is a porous polymer material (such as a PTFE membrane) impregnated with a nematic LC (such as LCMS-107); cf. T. Kuki et al, "Microwave variable delay line using a membrane impregnated with liquid crystal," *Microwave Symposium Digest,* 2002 *IEEE MTT-S International*, vol. 1, pp. 363-366 (2002), herein incorporated by reference.

The interstitial medium is preferably a porous material that provides a large surface area for strong surface alignment of the unbiased liquid crystal. Examples of such porous materials include ultra high molecular weight polyethylene (UHMW-PE) and expanded polytetraflouroethylene (ePTFE) membranes that have been treated to be hydrophilic. Specific examples of such interstitial media include Advantec MFS Inc., Part # H020A047A (hydrophilic ePTFE) and DeWal Industries 402P (UHMW-PE).

Figure 7:
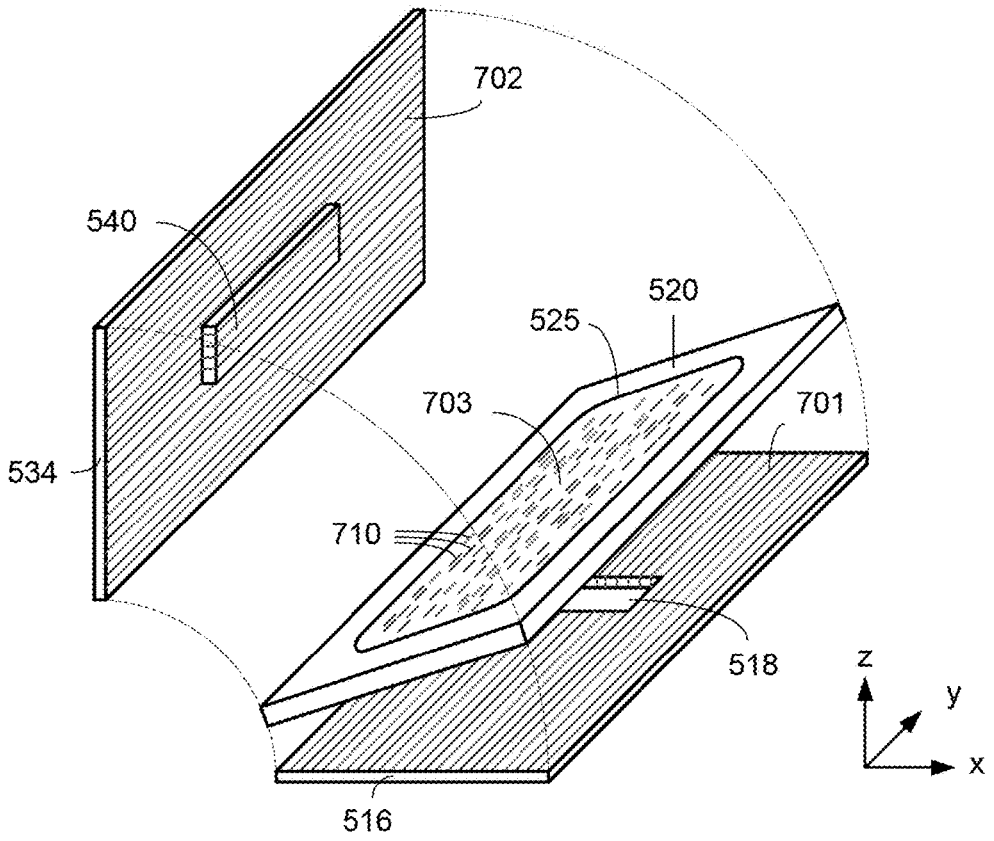
FIG. 7 depicts a liquid crystal arrangement.

In the patch arrangement of FIG. 5, it may be seen that the voltage biasing of the patch antenna relative to the conductive surface 516 containing the iris 518 will induce a substantially vertical (z-direction) alignment of the liquid crystal that occupies the cutaway region 525. Accordingly, to enhance the tuning effect, it may be desirable to arrange the interstitial medium and/or alignment layers to provide an unbiased liquid crystal alignment that is substantially horizontal (e.g. in the y direction). An example of such an arrangement is depicted in FIG. 7, which shows an exploded diagram of the same elements as in FIG. 5. In this example, the upper conductor 516 of the lower circuit board presents a lower alignment layer 701 that is aligned along the y-direction. This alignment layer may be implemented by, for example, coating the lower circuit board with a polyimide layer and rubbing or otherwise patterning (e.g. by machining or photolithography) the polyimide layer to introduce microscopic grooves that run parallel to the y-direction. Similarly, the upper dielectric 534 and patch 540 present an upper alignment layer 702 that is also aligned along the y-direction. A liquid-crystal-impregnated interstitial medium 703 fills the cutaway region 525 of the spacer layer 520; as depicted schematically in the figure, the interstitial medium may be designed and arranged to include microscopic pores 710 that extend along the y-direction to present a large surface area for the liquid crystal that is substantially along the y-direction.

In some approaches, it may be desirable to introduce one or more counter-electrodes into the unit cell, so that the unit cell can provide both a first biasing that aligns the liquid crystal substantially parallel to the electric field lines of the unit cell resonance mode, and a second biasing ("counter-biasing") that aligns the liquid crystal substantially perpendicular to the electric field lines of the unit cell resonance mode. One advantage of introducing counter-biasing is that that the unit cell tuning speed is then no longer limited by a passive relaxation time of the liquid crystal.

For purposes of characterizing counter-electrode arrangements, it is useful to distinguish between in-plane switching schemes, where the resonators are defined by conducting islands coplanar with a ground plane (e.g. as with the so-called "CELC" resonators, such as those described in A. Bily et al, previously cited), and vertical switching schemes, where the resonators are defined by patches positioned vertically above a ground plane containing irises (e.g. as in FIG. 5).

Figure 8A:
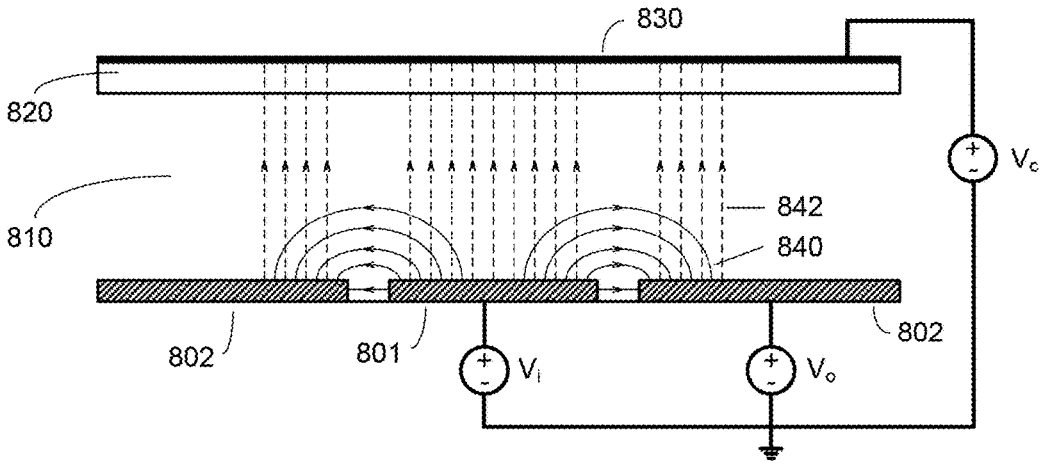
FIGS. 8A and 8B depict exemplary counter-electrode arrangements.

A counter-electrode arrangement for an in-plane switching scheme is depicted in FIG. 8A, which shows a unit cell resonator defined by an inner electrode or conducting island 801 and an outer electrode or ground plane 802. The liquid crystal material 810 is enclosed above the resonator by an enclosing structure 820, e.g. a polycarbonate container. In the exemplary counter-electrode arrangement of FIG. 8A, the counter-electrode is provided as a very thin layer 830 of a conducting material such as chromium or titanium, deposited on the upper surface of the enclosing structure 820. The layer is thin enough (e.g. 10-30 nm) to introduce only small loss at antenna operating frequencies, but sufficiently conductive that the (1/RC) charging rate is small compared to the unit cell update rate. In other approaches, the conducting layer is an organic conductor such as polyacetylene, which can be spin-coated on the enclosing structure 820. In yet other approaches, the conducting layer is an anisotropic conducting layer, i.e. having two conductivities $\sigma_1$ and $\sigma_2$ for two orthogonal directions along the layer, and the anisotropic conducting layer may be aligned relative to the unit cell resonator so that the effective conductivity seen by the unit cell resonator is minimized. For example, the anisotropic conducting layer may consist of wires or stripes that are aligned substantially perpendicular to the electric field lines of the unit cell resonance mode.

By applying a first bias corresponding to a voltage differential $V_i-V_o$ between the inner electrode 801 and outer electrode 802, a first (substantially horizontal) bias electric field 840 is established, substantially parallel to electric field lines of the unit cell resonance mode. On the other hand, by applying a second bias corresponding to a voltage differential $V_c-V_i=V_c-V_o$ between the counter-electrode 830 and the inner and outer electrodes 801 and 802, a second (substantially vertical) bias electric field 842 is established, substantially perpendicular to electric field lines of the unit cell resonance mode.

In some approaches, the second bias may be applied for a duration shorter than a relaxation time of the liquid crystal; for example, the second bias may be applied for less than one-half or one-third of this relaxation time. One advantage of this approach is that while the application of the second bias seeds the relaxation of the liquid crystal, it may be preferable to have the liquid crystal then relax to an unbiased state rather than align according to the bias electric field.

Figure 8B:
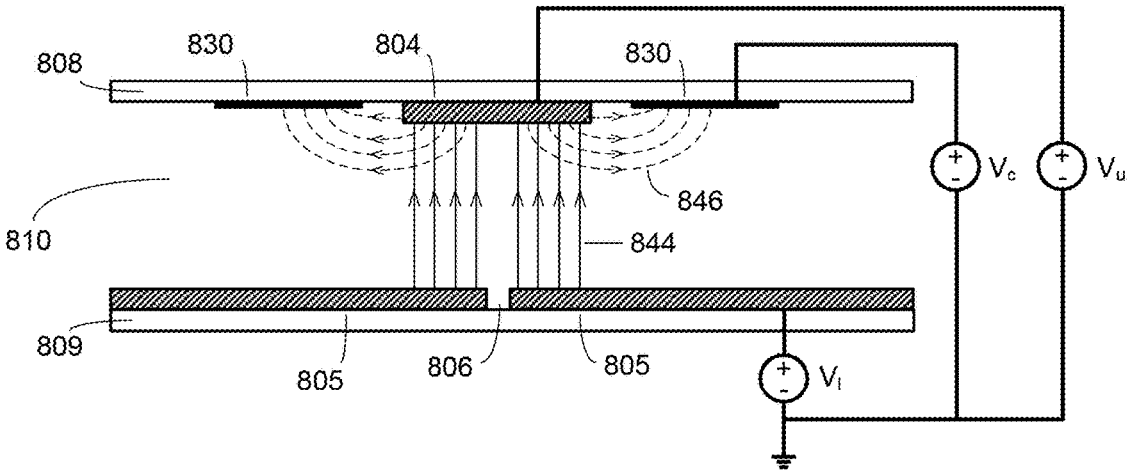

A counter-electrode arrangement for a vertical switching scheme is depicted in FIG. 8B, which shows a unit cell resonator defined by an upper patch 804 and a lower ground plane 805 containing an iris 806. The liquid crystal material 810 is enclosed within the region between the upper dielectric layer 808 (supporting the upper patch 804) and the lower dielectric layer 809 (supporting the lower ground plane 805). In the exemplary counter-electrode arrangement of FIG. 8B, the counter-electrode is provided as a very thin layer 830 of a conducting material such as chromium or titanium, deposited on the lower surface of the upper dielectric layer 808. The layer is thin enough (e.g. 10-30 nm) to introduce only small loss at antenna operating frequencies, but sufficiently conductive that the (1/RC) charging rate is small compared to the unit cell update rate. Other approaches may use organic conductors or anisotropic conducting layers, as described above.

By applying a first bias corresponding to a voltage differential $V_u-V_l=V_c-V_l$ between the upper and counter electrodes 804 and 830 and lower electrode 805, a first (substantially vertical) bias electric field 844 is established, substantially parallel to electric field lines of the unit cell resonance mode. On the other hand, by applying a second bias corresponding to a voltage differential $V_c-V_u$ between the counter electrode 830 and the upper electrode 804, a second (substantially horizontal) bias electric field 846 is established, substantially perpendicular to electric field lines of the unit cell resonance mode. Again, in some approaches, the second bias may be applied for a duration shorter than a relaxation time of the liquid crystal, for the same reason as discussed above for horizontal switching. In various embodiments of the vertical switching scheme, the counter-electrode 830 may constitute a pair of electrodes on opposite sides of the patch 804, or a U-shaped electrode that surrounds three sides of the patch 804, or a closed loop that surrounds all four sides of the patch 804.

Figure 9:
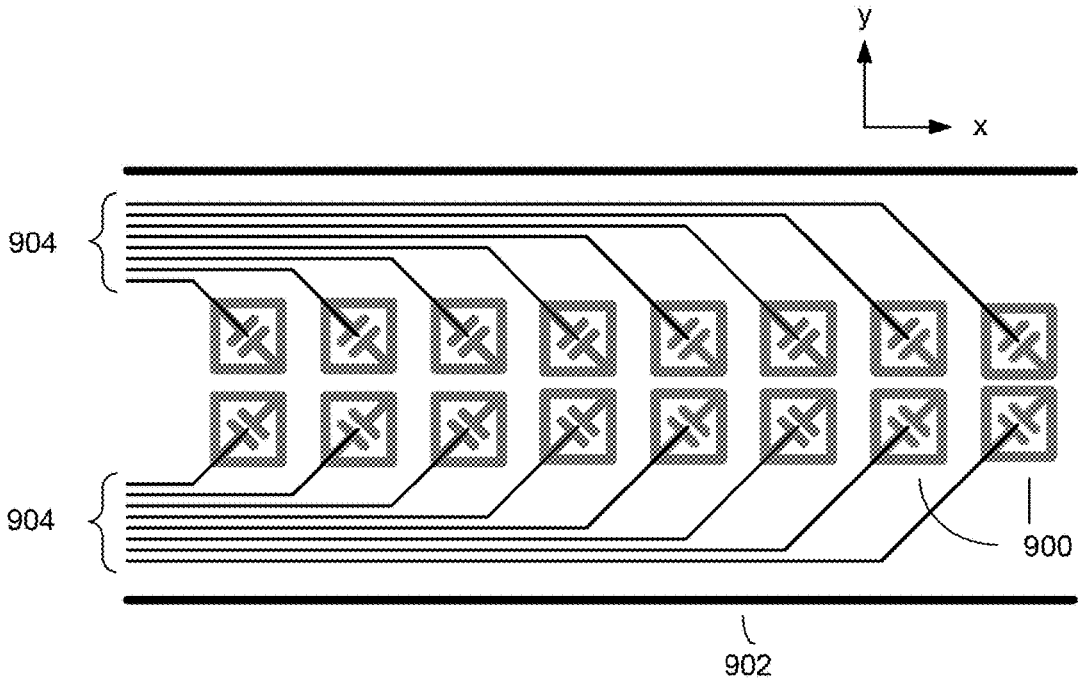
FIG. 9 depicts a surface scattering antenna with direct addressing of the scattering elements.

In various approaches, the bias voltage lines may be directly addressed, e.g. by extending a bias voltage line for each scattering element to a pad structure for connection to antenna control circuitry, or matrix addressed, e.g. by providing each scattering element with a voltage bias circuit that is addressable by row and column. FIG. 9 depicts an example of a configuration that provides direct addressing for an arrangement of scattering elements 900, in which a plurality of bias voltage lines 904 deliver individual bias voltages to the scattering elements. FIG. 10 depicts an example of a configuration that provides matrix addressing for an arrangement of scattering elements 1000, where each scattering element is connected by a bias voltage line 1002 to a biasing circuit 1004 addressable by row inputs 1006 and column inputs 1008 (note that each row input and/or column input may include one or more signals, e.g. each row or column may be addressed by a single wire or a set of parallel wires dedicated to that row or column). Each biasing circuit may contain, for example, a switching device (e.g. a transistor), a storage device (e.g. a capacitor), and/or additional circuitry such as logic/multiplexing circuitry, digital-to-analog conversion circuitry, etc. This circuitry may be readily fabricated using monolithic integration, e.g. using a thin-film transistor (TFT) process, or as a hybrid assembly of integrated circuits that are mounted on the wave-propagating structure, e.g. using surface mount technology (SMT). Although FIGS. 9 and 10 depict the scattering elements as "CELC" resonators, this depiction is intended to represent generic scattering elements, and the direct or matrix addressing schemes of FIGS. 9 and 10 are applicable to other unit cell designs (such as the patch element).

For approaches that use liquid crystal as a tunable medium for the unit cell, it may be desirable to provide unit cell bias voltages that are AC signals with a minimal DC component. Prolonged DC operation can cause electrochemical reactions that significantly reduce the usable lifespan of the liquid crystal as a tunable medium. In some approaches, a unit cell may be tuned by adjusting the amplitude of an AC bias signal. In other approaches, a unit cell may be tuned by adjusting the pulse width of an AC bias signal, e.g. using pulse width modulation (PWM). In yet other approaches, a unit cell may be tuned by adjusting both the amplitude and pulse with of an AC bias signal. Various liquid crystal drive schemes have been extensively explored in the liquid crystal display literature, for example as described in Robert Chen, *Liquid Crystal Displays*, Wiley, N.J., 2011, and in Willem den Boer, *Active Matrix Liquid Crystal Displays*, Elsevier, Burlington, Mass. 2009.

Figure 11A:
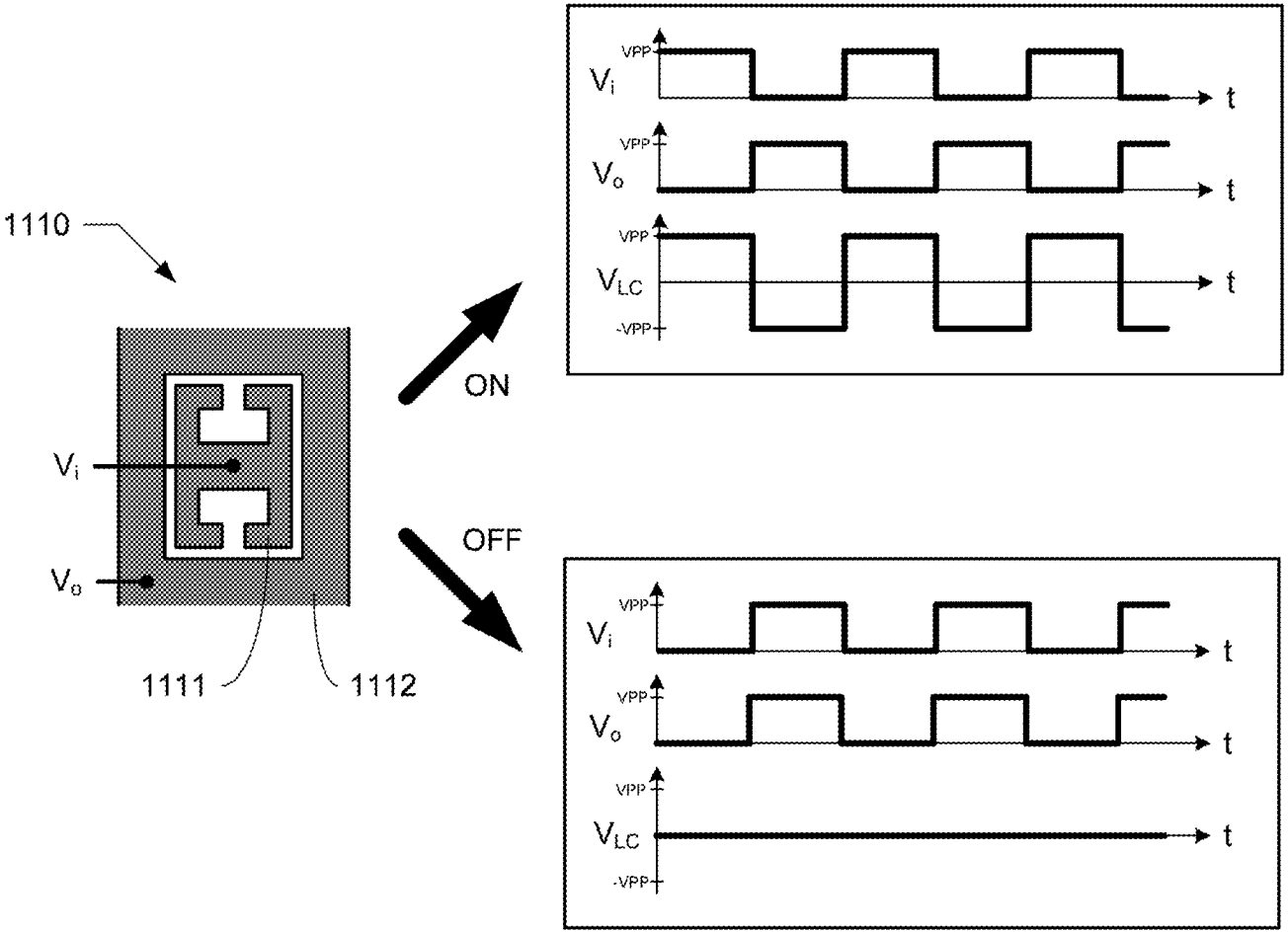
FIGS. 11A, 12A, and 13 depict various bias voltage drive schemes.

Exemplary waveforms for a binary (ON-OFF) bias voltage adjustment scheme are depicted in FIG. 11A. In this binary scheme, a first square wave voltage $V_i$ is applied to inner electrode 1111 of a unit cell 1110, and a second square wave voltage $V_o$ is applied to outer electrode 1112 of the unit cell. Although the figure depicts a "CELC" resonator defined by a conducting island (inner electrode) coplanar with a ground plane (outer electrode), this depiction is intended to represent a generic unit cell, and the drive scheme is applicable to other unit cell designs. For example, for a "patch" resonator defined by a conducting patch positioned vertically above an iris in a ground plane, the first square wave voltage $V_i$ may be applied to the patch, while the second square wave voltage $V_o$ may be applied to the ground plane.

In the binary scheme of FIG. 11A, the unit cell is biased "ON" when the two square waves are 180° out of phase with each other, with the result that the potential applied to the liquid crystal, $V_{LC}=V_i-V_o$, is a square wave with zero DC offset, as shown in the top right panel of the figure. On the other hand, the unit cell is biased "OFF" when the two square waves are in phase with each other, with the result that $V_{LC}=0$, as shown in the bottom right panel of the figure. The square wave amplitude VPP is a voltage large enough to effect rapid alignment of the liquid crystal, typically in the range of 10-100 volts. The square wave frequency is a "drive" frequency that is large compared to both the desired antenna switching rate and liquid crystal relaxation rates. The drive frequency can range from as low as 10 Hz to as high as 100 kHz.

Figure 11B:
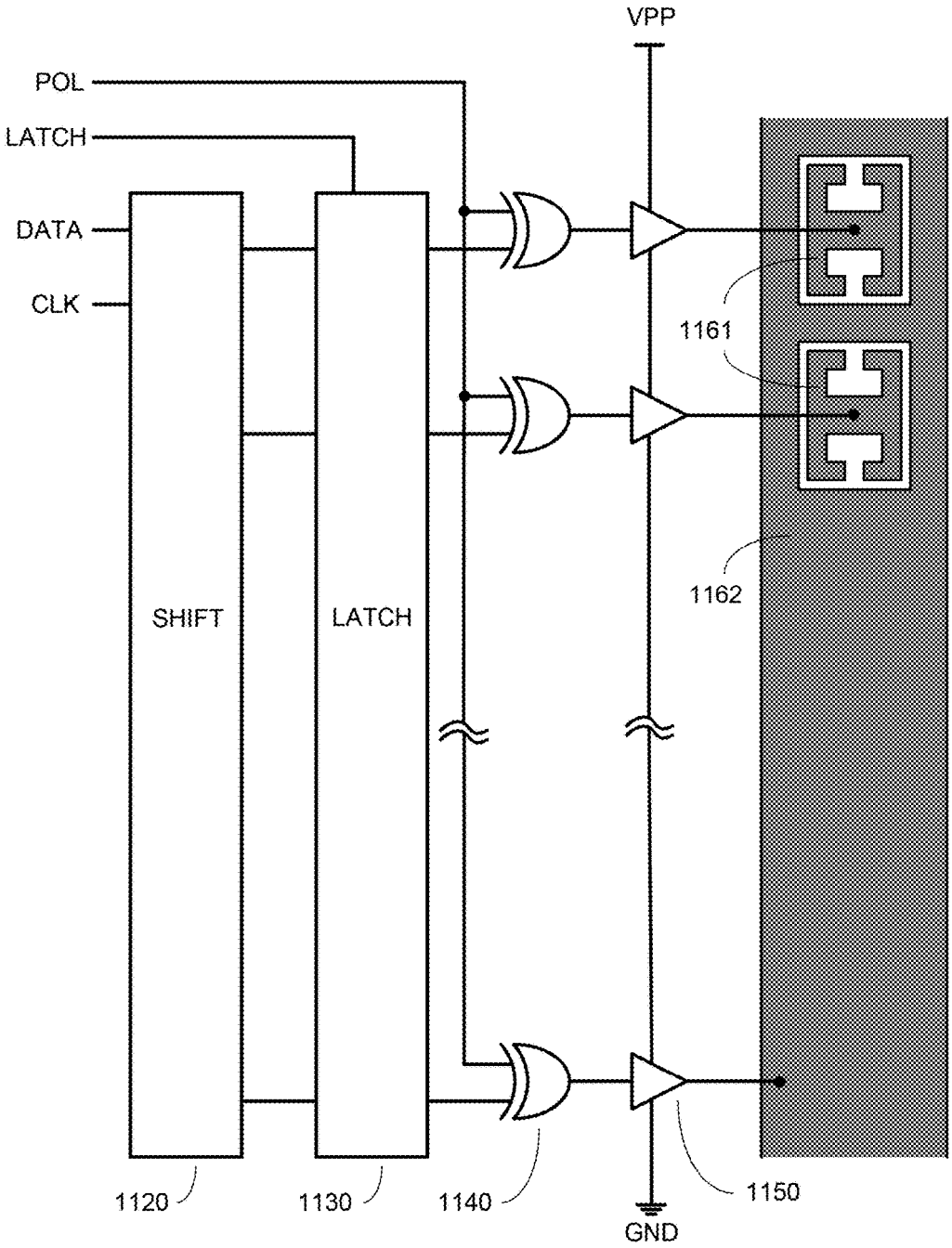
FIGS. 11B and 12B depict bias voltage drive circuitry.

Exemplary circuitry providing the waveforms of FIG. 11A to a plurality of unit cells is depicted in FIG. 11B. In this example, bits representing the "ON" or "OFF" states of the unit cells are read into a N-bit serial-to-parallel shift register 1120 using the DATA and CLK signals. When this serial read-in is complete, the LATCH signal is triggered to store these bits in an N-bit latch 1130. The N-bit latch outputs, which may be toggled with XOR gates 1140 via the POL signal, provide the inputs for high-voltage push-pull amplifiers 1150 that deliver the waveforms to the unit cells. Note that one or more bits of the shift register may be reserved to provide the waveform for the common outer electrode 1162, while the remaining bits of the shift register provide the individual waveforms for the inner electrodes 1161 of the unit cells. Alternatively, the entire shift register may be used for inner electrodes 1161, and a separate push-pull amplifier may be used for the outer electrode 1162. Square waves may be produced at the outputs of the push-pull amplifiers 1150 by either (1) toggling the XOR gates at the drive frequency (i.e. with a POL signal that is a square wave at the drive frequency) or (2) latching at twice the drive frequency (i.e. with a LATCH signal that is a square wave at twice the drive frequency) while reading in complementary bits during the second half-cycle of each drive period. Under the latter approach, because there is an N-bit read-in during each half-cycle of the drive period, the serial input data is clocked at a frequency not less than 2×N×f, where f is the drive frequency. The N-bit shift register may address all of the unit cells that compose the antenna, or several N-bit shift registers may be used, each addressing a subset of the unit cells.

The binary scheme of FIG. 11A applies voltage waveforms to both the inner and outer electrode of the unit cell. In another approach, shown in FIG. 12A, the outer electrode is grounded and a voltage waveform is applied only to the inner electrode of the unit cell. In this single-ended drive approach, the unit cell is biased "ON" when a square wave with zero DC offset is applied to the inner electrode 1111 (as shown in the top right panel of FIG. 12A) and biased "OFF" when a zero voltage is applied to the inner electrode (as shown in the bottom right panel of FIG. 12A).

Figure 12A:
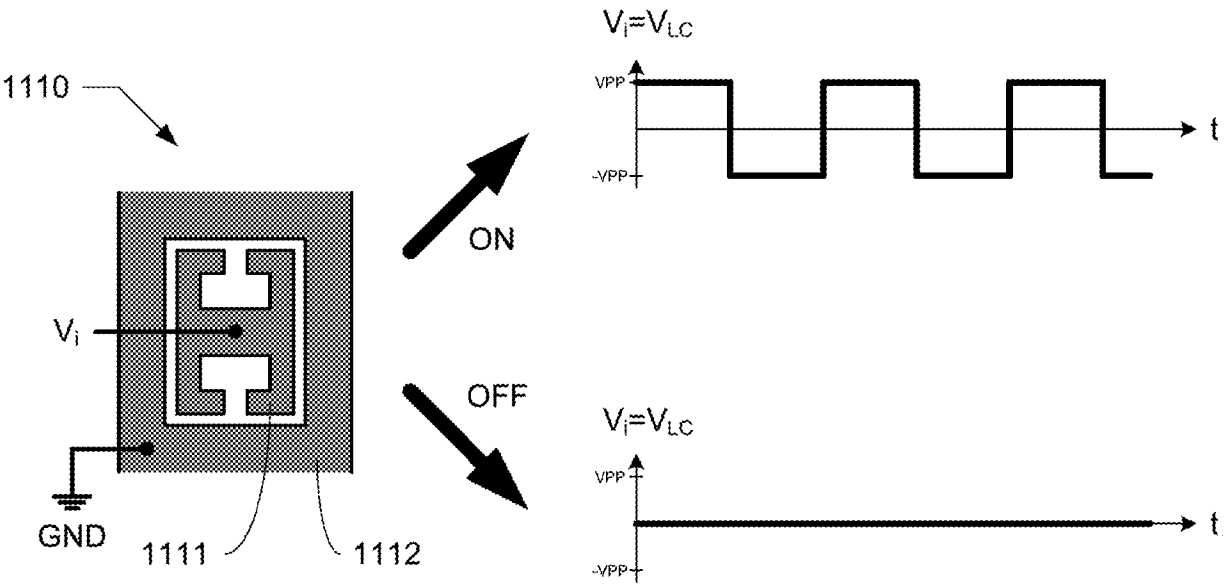
Figure 12B:
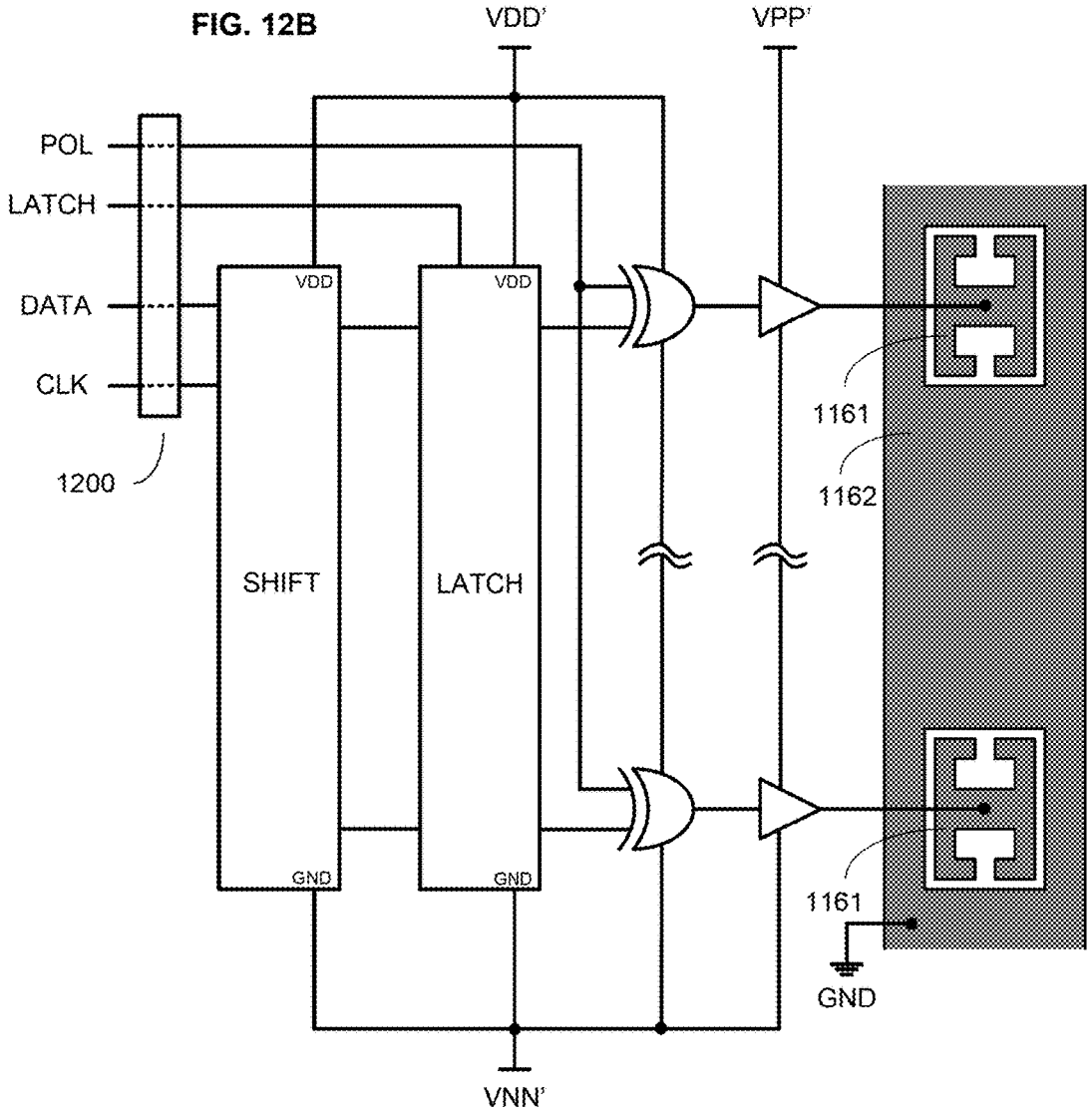

Exemplary circuitry providing the waveforms of FIG. 12A to a plurality of unit cells is depicted in FIG. 12B. The circuitry is similar to that of FIG. 11B, except that the common outer electrode is now grounded, and new oscillating power supply voltages VPP' and VDD' are used for the high-voltage circuits and the digital circuits, respectively, with the ground terminals of these circuits being connected to a new negative oscillating power supply voltage VNN'. Exemplary waveforms for these oscillating power supply voltages are shown in the lower panel of the figure. Note that these oscillating power supply voltages preserve the voltage differentials VPP'−VNN'=VPP and VDD'−VNN'=VDD, where VPP is the desired amplitude of the voltage $V_{LC}$ applied to the liquid crystal, and VDD is the power supply voltage for the digital circuitry. For the digital inputs to operate properly with these oscillating power supplies, the single-ended drive circuitry also includes voltage-shifting circuitry 1200 presenting these digital inputs as signals relative to VNN' rather than GND.

Figure 13:
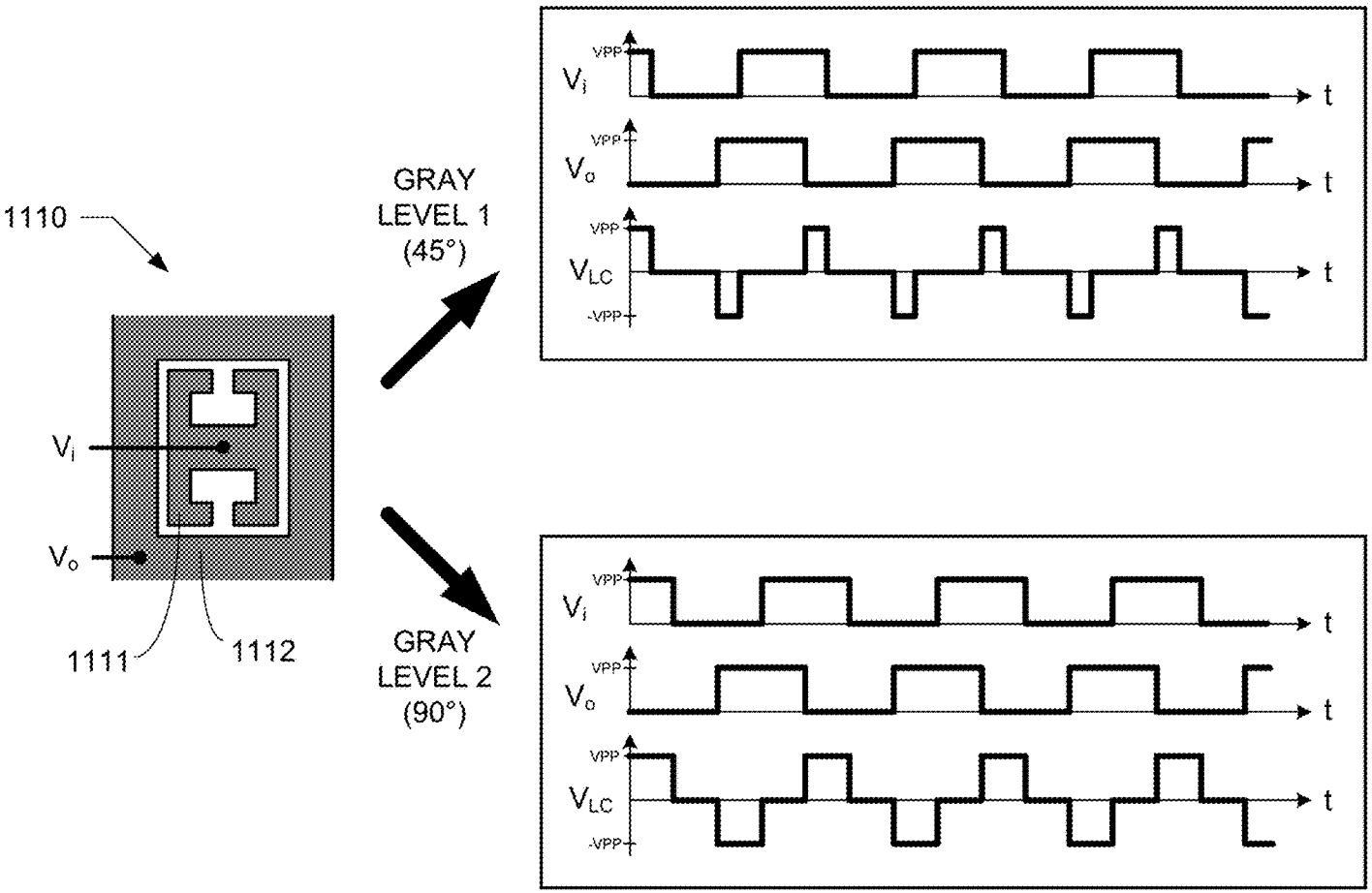

Exemplary waveforms for a grayscale voltage adjustment scheme are depicted in FIG. 13. In this grayscale scheme, a first square wave voltage $V_i$ is again applied to inner electrode 1111 of a unit cell 1110 and a second square wave voltage $V_o$ is again applied to outer electrode 1112 of the unit cell. A desired gray level is then achieved by selecting a phase difference between the two square waves. In one approach, as shown in FIG. 13, the drive period is divided into a discrete set of time slices corresponding to a discrete set of phase differences between the two square waves. In the nonlimiting example of FIG. 13, there are eight (8) time slices, providing five (5) gray levels corresponding to phase differences of 0°, 45°, 90°, 135°, and 180°. The figure depicts two gray level examples: for a phase difference of 45°, as shown in the upper right panel of the figure, the potential applied to the liquid crystal, $V_{LC}=V_i-V_o$, is an alternating pulse train with zero DC offset and an RMS voltage of VPP/4; for a phase difference of 90°, as shown in the lower right panel of the figure, $V_{LC}$ is an alternating pulse train with zero DC offset and an RMS voltage of VPP/2. Thus, the gray level scheme of FIG. 13 provides a pulse-width modulated (PWM) liquid crystal waveform with zero DC offset and an adjustable RMS voltage.

The drive circuitry of FIG. 11B may be used to provide the grayscale waveforms of FIG. 13 to a plurality of unit cells. However, for a grayscale implementation, an N-bit read-in is completed during each time slice of the drive period. Thus, for an implementation with T time slices (corresponding to (T/2)+1 gray levels), the serial input data is clocked at a frequency not less than T×N×f, where f is the drive frequency (it will be appreciated that T=2 corresponds to the binary drive scheme of FIG. 11A).

Figure 12B:
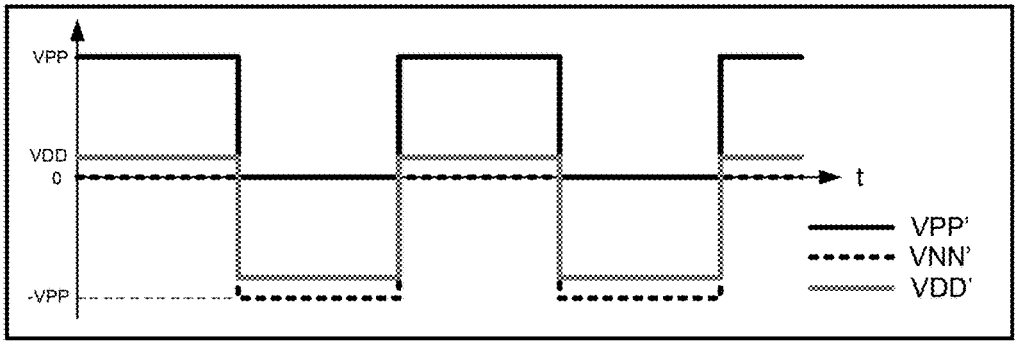
Figure 14:
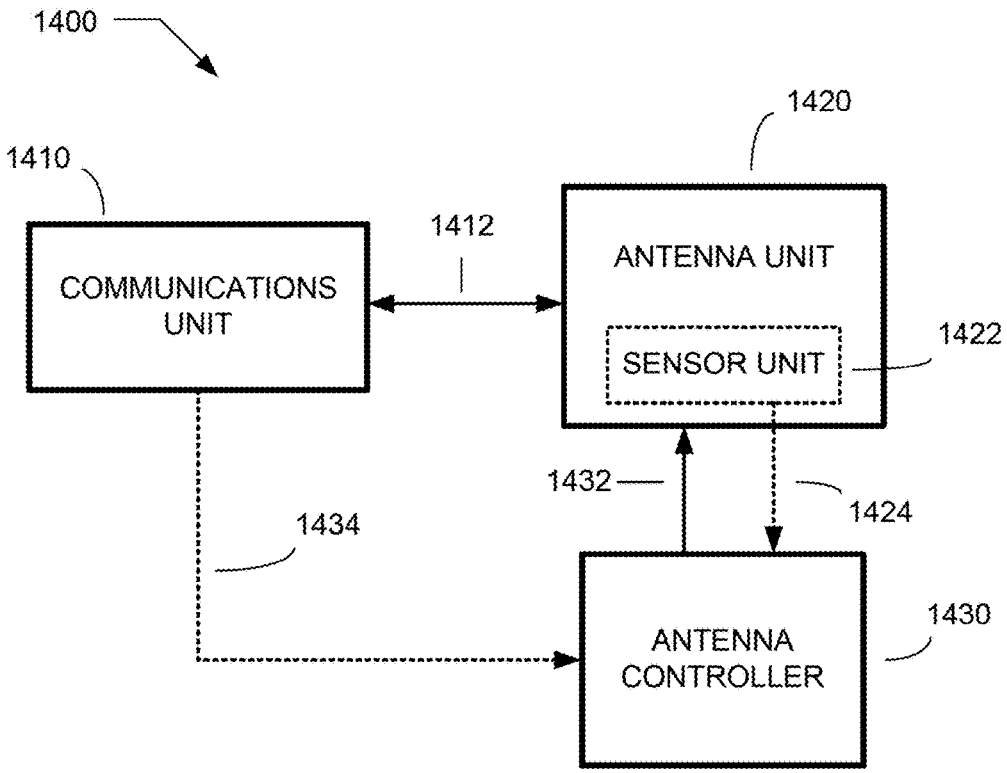
FIG. 14 depicts a system block diagram.

With reference now to FIG. 14, an illustrative embodiment is depicted as a system block diagram. The system 1400 include a communications unit 1410 coupled by one or more feeds 1412 to an antenna unit 1420. The communications unit 1410 might include, for example, a mobile broadband satellite transceiver, or a transmitter, receiver, or transceiver module for a radio or microwave communications system, and may incorporate data multiplexing/demultiplexing circuitry, encoder/decoder circuitry, modulator/demodulator circuitry, frequency upconverters/downconverters, filters, amplifiers, diplexes, etc. The antenna unit includes at least one surface scattering antenna, which may be configured to transmit, receive, or both; and in some approaches the antenna unit 1420 may comprise multiple surface scattering antennas, e.g. first and second surface scattering antennas respectively configured to transmit and receive. For embodiments having a surface scattering antenna with multiple feeds, the communications unit may include MIMO circuitry. The system 1400 also includes an antenna controller 1430 configured to provide control input(s) 1432 that determine the configuration of the antenna. For example, the control inputs(s) may include inputs for each of the scattering elements (e.g. for a direct addressing configuration such as depicted in FIG. 12), row and column inputs (e.g. for a matrix addressing configuration such as that depicted in FIG. 13), adjustable gains for the antenna feeds, etc.

In some approaches, the antenna controller 1430 includes circuitry configured to provide control input(s) 1432 that correspond to a selected or desired antenna radiation pattern. For example, the antenna controller 1430 may store a set of configurations of the surface scattering antenna, e.g. as a lookup table that maps a set of desired antenna radiation patterns (corresponding to various beam directions, beams widths, polarization states, etc. as discussed earlier in this disclosure) to a corresponding set of values for the control input(s) 1432. This lookup table may be previously computed, e.g. by performing full-wave simulations of the antenna for a range of values of the control input(s) or by placing the antenna in a test environment and measuring the antenna radiation patterns corresponding to a range of values of the control input(s). In some approaches the antenna controller may be configured to use this lookup table to calculate the control input(s) according to a regression analysis; for example, by interpolating values for the control input(s) between two antenna radiation patterns that are stored in the lookup table (e.g. to allow continuous beam steering when the lookup table only includes discrete increments of a beam steering angle). The antenna controller 1430 may alternatively be configured to dynamically calculate the control input(s) 1432 corresponding to a selected or desired antenna radiation pattern, e.g. by computing a holographic pattern corresponding to an interference term $\mathrm{Re}[\Psi_{out}\Psi_{in}^{*}]$ (as discussed earlier in this disclosure), or by computing the couplings $\{\alpha_j\}$ (corresponding to values of the control input(s)) that provide the selected or desired antenna radiation pattern in accordance with equation (1) presented earlier in this disclosure.

In some approaches the antenna unit 1420 optionally includes a sensor unit 1422 having sensor components that detect environmental conditions of the antenna (such as its position, orientation, temperature, mechanical deformation, etc.). The sensor components can include one or more GPS devices, gyroscopes, thermometers, strain gauges, etc., and the sensor unit may be coupled to the antenna controller to provide sensor data 1424 so that the control input(s) 1432 may be adjusted to compensate for translation or rotation of the antenna (e.g. if it is mounted on a mobile platform such as an aircraft) or for temperature drift, mechanical deformation, etc.

In some approaches the communications unit may provide feedback signal(s) 1434 to the antenna controller for feedback adjustment of the control input(s). For example, the communications unit may provide a bit error rate signal and the antenna controller may include feedback circuitry (e.g. DSP circuitry) that adjusts the antenna configuration to reduce the channel noise. Alternatively or additionally, for pointing or steering applications the communications unit may provide a beacon signal (e.g. from a satellite beacon) and the antenna controller may include feedback circuitry (e.g. pointing lock DSP circuitry for a mobile broadband satellite transceiver).

Figure 15:
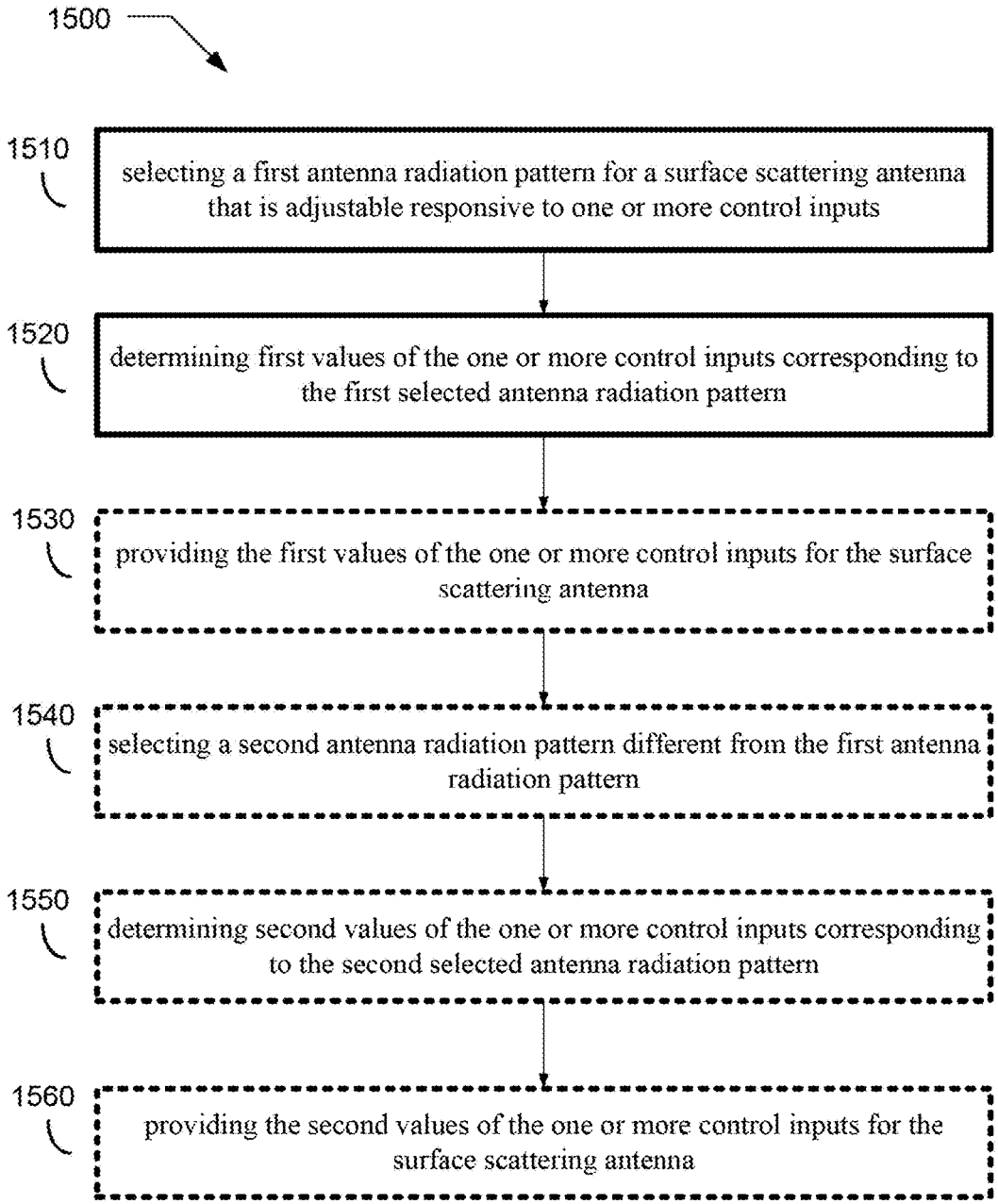
FIGS. 15 and 16 depict flow diagrams.

An illustrative embodiment is depicted as a process flow diagram in FIG. 15. Flow 1500 includes operation 1510—selecting a first antenna radiation pattern for a surface scattering antenna that is adjustable responsive to one or more control inputs. For example, an antenna radiation pattern may be selected that directs a primary beam of the radiation pattern at the location of a telecommunications satellite, a telecommunications base station, or a telecommunications mobile platform. Alternatively or additionally, an antenna radiation pattern may be selected to place nulls of the radiation pattern at desired locations, e.g. for secure communications or to remove a noise source. Alternatively or additionally, an antenna radiation pattern may be selected to provide a desired polarization state, such as circular polarization (e.g. for Ka-band satellite communications) or linear polarization (e.g. for Ku-band satellite communications). Flow 1500 includes operation 1520—determining first values of the one or more control inputs corresponding to the first selected antenna radiation pattern. For example, in the system of FIG. 14, the antenna controller 1430 can include circuitry configured to determine values of the control inputs by using a lookup table, or by computing a hologram corresponding to the desired antenna radiation pattern. Flow 1500 optionally includes operation 1530—providing the first values of the one or more control inputs for the surface scattering antenna. For example, the antenna controller 1430 can apply bias voltages to the various scattering elements, and/or the antenna controller 1430 can adjust the gains of antenna feeds. Flow 1500 optionally includes operation 1540—selecting a second antenna radiation pattern different from the first antenna radiation pattern. Again, this can include selecting, for example, a second beam direction or a second placement of nulls. In one application of this approach, a satellite communications terminal can switch between multiple satellites, e.g. to optimize capacity during peak loads, to switch to another satellite that may have entered service, or to switch from a primary satellite that has failed or is off-line. Flow 1500 optionally includes operation 1550—determining second values of the one or more control inputs corresponding to the second selected antenna radiation pattern. Again this can include, for example, using a lookup table or computing a holographic pattern. Flow 1500 optionally includes operation 1560—providing the second values of the one or more control inputs for the surface scattering antenna. Again this can include, for example, applying bias voltages and/or adjusting feed gains.

Figure 16:
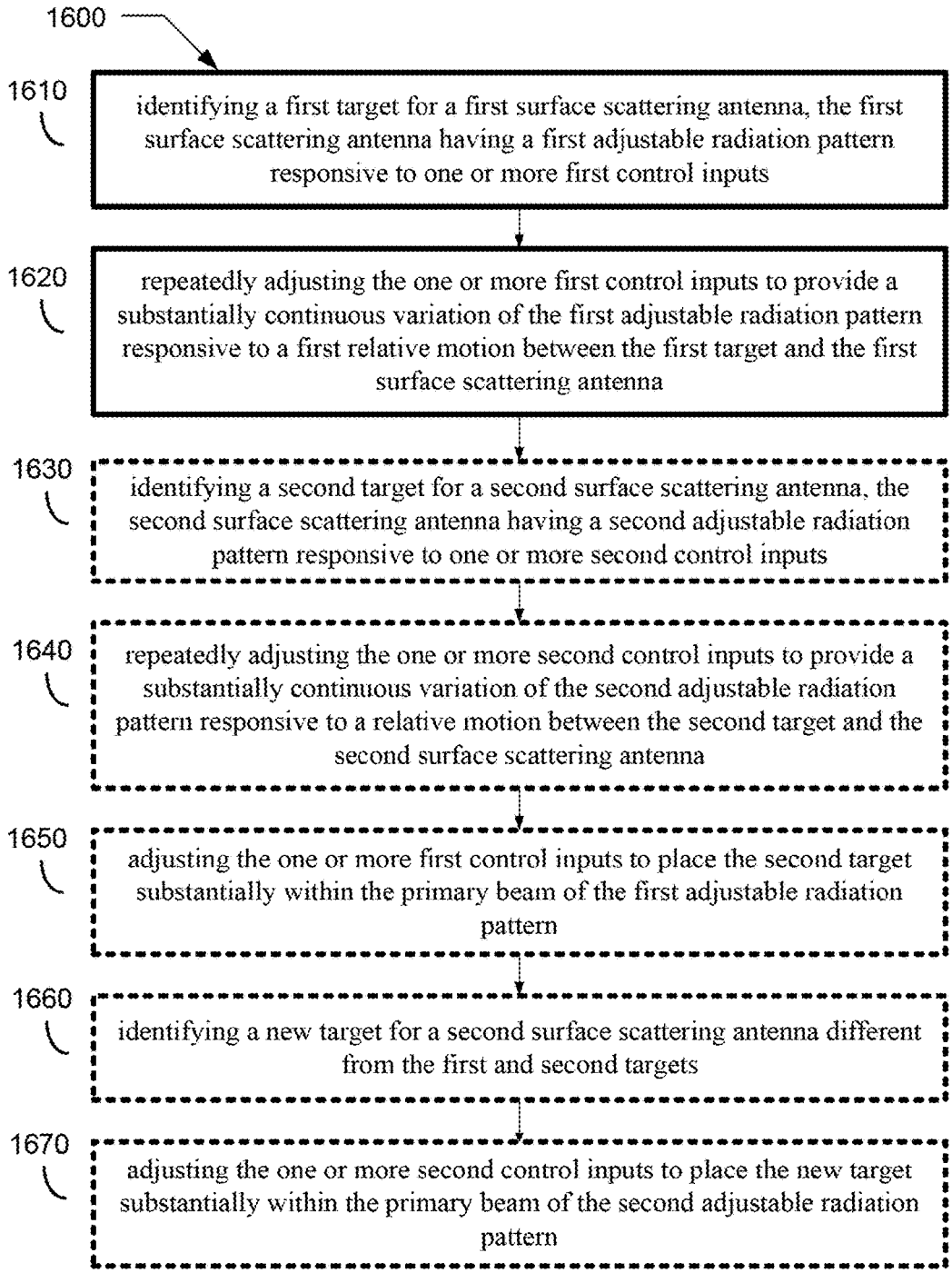

Another illustrative embodiment is depicted as a process flow diagram in FIG. 16. Flow 1600 includes operation 1610—identifying a first target for a first surface scattering antenna, the first surface scattering antenna having a first adjustable radiation pattern responsive to one or more first control inputs. This first target could be, for example, a telecommunications satellite, a telecommunications base station, or a telecommunications mobile platform. Flow 1600 includes operation 1620—repeatedly adjusting the one or more first control inputs to provide a substantially continuous variation of the first adjustable radiation pattern responsive to a first relative motion between the first target and the first surface scattering antenna. For example, in the system of FIG. 14, the antenna controller 1430 can include circuitry configured to steer a radiation pattern of the surface scattering antenna, e.g. to track the motion of a non-geostationary satellite, to maintain pointing lock with a geostationary satellite from a mobile platform (such as an airplane or other vehicle), or to maintain pointing lock when both the target and the antenna are moving. Flow 1600 optionally includes operation 1630—identifying a second target for a second surface scattering antenna, the second surface scattering antenna having a second adjustable radiation pattern responsive to one or more second control inputs; and flow 1600 optionally includes operation 1640—repeatedly adjusting the one or more second control inputs to provide a substantially continuous variation of the second adjustable radiation pattern responsive to a relative motion between the second target and the second surface scattering antenna. For example, some applications may deploy both a primary antenna unit, tracking a first object (such as a first non-geostationary satellite), and a secondary or auxiliary antenna unit, tracking a second object (such as a second non-geostationary satellite). In some approaches the auxiliary antenna unit may include a smaller-aperture antenna (tx and/or rx) primarily used to track the location of the secondary object (and optionally to secure a link to the secondary object at a reduced quality-of-service (QoS)). Flow 1600 optionally includes operation 1650—adjusting the one or more first control inputs to place the second target substantially within the primary beam of the first adjustable radiation pattern. For example, in an application in which the first and second antennas are components of a satellite communications terminal that interacts with a constellation of non-geostationary satellites, the first or primary antenna may track a first member of the satellite constellation until the first member approaches the horizon (or the first antenna suffers appreciable scan loss), at which time a "handoff" is accomplished by switching the first antenna to track the second member of the satellite constellation (which was being tracked by the second or auxiliary antenna). Flow 1600 optionally includes operation 1660—identifying a new target for a second surface scattering antenna different from the first and second targets; and flow 1600 optionally includes operation 1670—adjusting the one or more second control inputs to place the new target substantially within the primary beam of the second adjustable radiation pattern. For example, after the "handoff," the secondary or auxiliary antenna can initiate a link with a third member of the satellite constellation (e.g. as it rises above the horizon).

Figure 17:
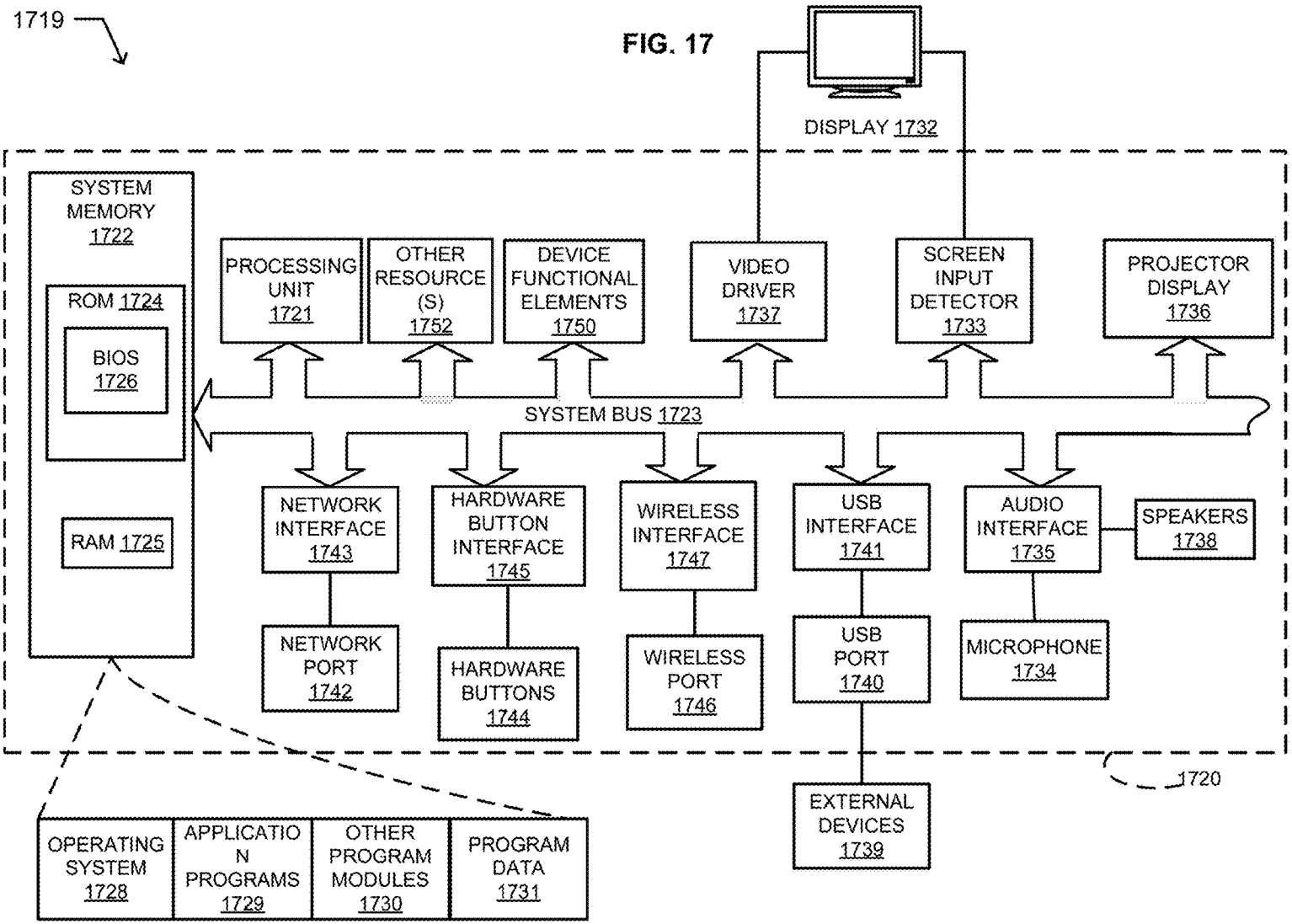
FIG. 17 illustrates an example embodiment of an environment 1719 that includes a thin computing device 1720 in which embodiments may be implemented.
Figure 18:
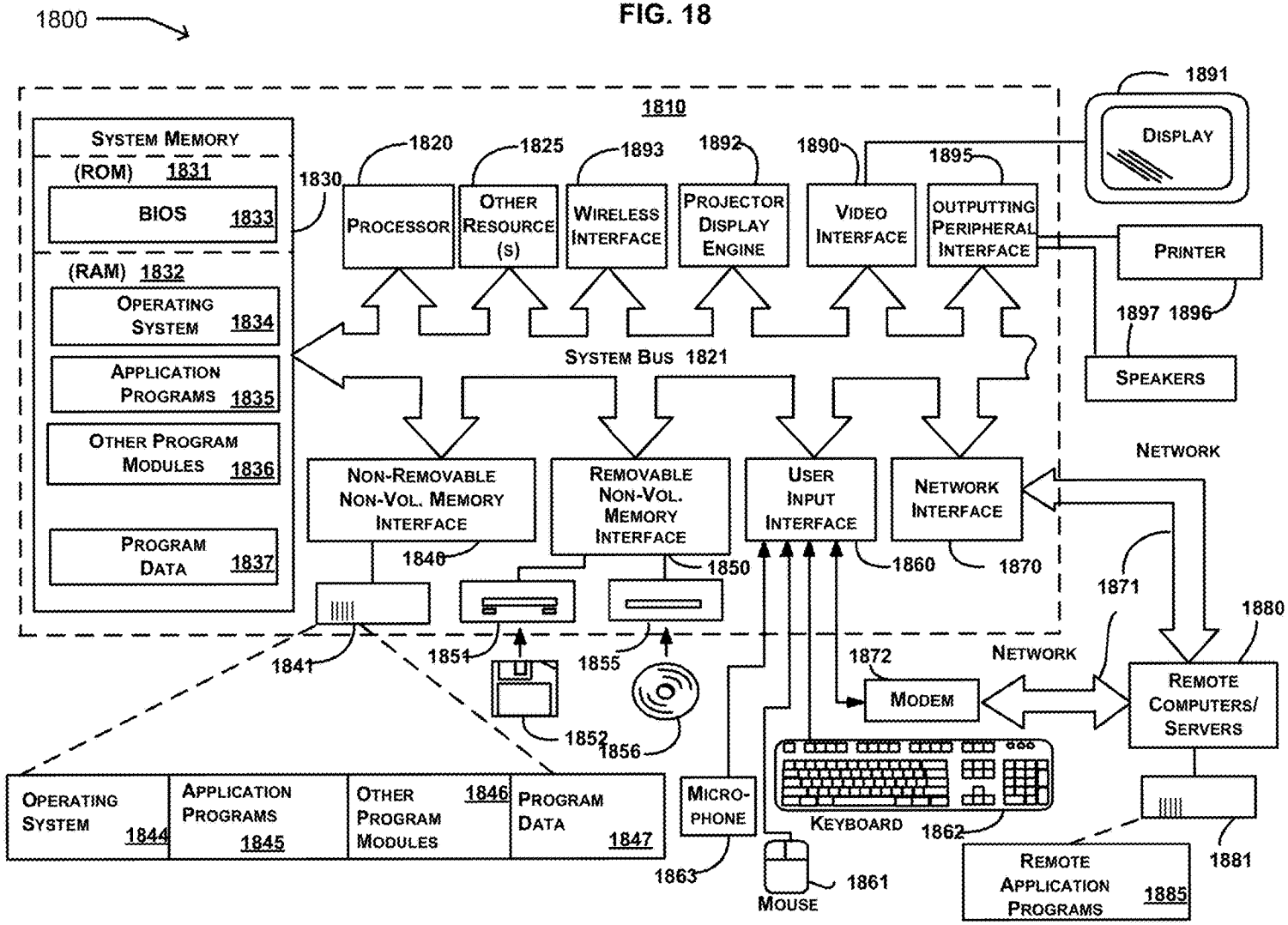
FIG. 18 illustrates an example embodiment of an environment 1800 that includes a general-purpose computing system 1810 in which embodiments may be implemented.

FIGS. 17 and 18 provide respective general descriptions of several environments in which implementations may be implemented.

FIG. 17 and the following discussion are intended to provide a brief, general description of a thin computing environment 1719 in which embodiments may be implemented. FIG. 17 illustrates an example system that includes a thin computing device 1720, which may be included or embedded in an electronic device that also includes a device functional element 1750. For example, the electronic device may include any item having electrical or electronic components playing a role in a functionality of the item, such as for example, a refrigerator, a car, a digital image acquisition device, a camera, a cable modem, a printer an ultrasound device, an x-ray machine, a non-invasive imaging device, or an airplane. For example, the electronic device may include any item that interfaces with or controls a functional element of the item. In another example, the thin computing device may be included in an implantable medical apparatus or device. In a further example, the thin computing device may be operable to communicate with an implantable or implanted medical apparatus. For example, a thin computing device may include a computing device having limited resources or limited processing capability, such as a limited resource computing device, a wireless communication device, a mobile wireless communication device, a smart phone, an electronic pen, a handheld electronic writing device, a scanner, a cell phone, a smart phone (such as an Android® or iPhone® based device), a tablet device (such as an iPad®) or a Blackberry® device. For example, a thin computing device may include a thin client device or a mobile thin client device, such as a smart phone, tablet, notebook, or desktop hardware configured to function in a virtualized environment.

The thin computing device 1720 includes a processing unit 1721, a system memory 1722, and a system bus 1723 that couples various system components including the system memory 1722 to the processing unit 1721. The system bus 1723 may be any of several types of bus structures including a memory bus or memory controller, a peripheral bus, and a local bus using any of a variety of bus architectures. The system memory includes read-only memory (ROM) 1724 and random access memory (RAM) 1725. A basic input/output system (BIOS) 1726, containing the basic routines that help to transfer information between subcomponents within the thin computing device 1720, such as during start-up, is stored in the ROM 1724. A number of program modules may be stored in the ROM 1724 or RAM 1725, including an operating system 1728, one or more application programs 1729, other program modules 1730 and program data 1731.

A user may enter commands and information into the computing device 1720 through one or more input interfaces. An input interface may include a touch-sensitive screen or display surface, or one or more switches or buttons with suitable input detection circuitry. A touch-sensitive screen or display surface is illustrated as a touch-sensitive display 1732 and screen input detector 1733. One or more switches or buttons are illustrated as hardware buttons 1744 connected to the system via a hardware button interface 1745. The output circuitry of the touch-sensitive display 1732 is connected to the system bus 1723 via a video driver 1737. Other input devices may include a microphone 1734 connected through a suitable audio interface 1735, or a physical hardware keyboard (not shown). Output devices may include the display 1732, or a projector display 1736.

In addition to the display 1732, the computing device 1720 may include other peripheral output devices, such as at least one speaker 1738. Other external input or output devices 1739, such as a joystick, game pad, satellite dish, scanner or the like may be connected to the processing unit 1721 through a USB port 1740 and USB port interface 1741, to the system bus 1723. Alternatively, the other external input and output devices 1739 may be connected by other interfaces, such as a parallel port, game port or other port. The computing device 1720 may further include or be capable of connecting to a flash card memory (not shown) through an appropriate connection port (not shown). The computing device 1720 may further include or be capable of connecting with a network through a network port 1742 and network interface 1743, and through wireless port 1746 and corresponding wireless interface 1747 may be provided to facilitate communication with other peripheral devices, including other computers, printers, and so on (not shown). It will be appreciated that the various components and connections shown are examples and other components and means of establishing communication links may be used.

The computing device 1720 may be primarily designed to include a user interface. The user interface may include a character, a key-based, or another user data input via the touch sensitive display 1732. The user interface may include using a stylus (not shown). Moreover, the user interface is not limited to an actual touch-sensitive panel arranged for directly receiving input, but may alternatively or in addition respond to another input device such as the microphone 1734. For example, spoken words may be received at the microphone 1734 and recognized. Alternatively, the computing device 1720 may be designed to include a user interface having a physical keyboard (not shown).

The device functional elements 1750 are typically application specific and related to a function of the electronic device, and are coupled with the system bus 1723 through an interface (not shown). The functional elements may typically perform a single well-defined task with little or no user configuration or setup, such as a refrigerator keeping food cold, a cell phone connecting with an appropriate tower and transceiving voice or data information, a camera capturing and saving an image, or communicating with an implantable medical apparatus.

In certain instances, one or more elements of the thin computing device 1720 may be deemed not necessary and omitted. In other instances, one or more other elements may be deemed necessary and added to the thin computing device.

FIG. 18 and the following discussion are intended to provide a brief, general description of an environment in which embodiments may be implemented. FIG. 18 illustrates an example embodiment of a general-purpose computing system in which embodiments may be implemented, shown as a computing system environment 1800. Components of the computing system environment 1800 may include, but are not limited to, a general purpose computing device 1810 having a processor 1820, a system memory 1830, and a system bus 1821 that couples various system components including the system memory to the processor 1820. The system bus 1821 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus, also known as Mezzanine bus.

The computing system environment 1800 typically includes a variety of computer-readable media products. Computer-readable media may include any media that can be accessed by the computing device 1810 and include both volatile and nonvolatile media, removable and non-removable media. By way of example, and not of limitation, computer-readable media may include computer storage media. By way of further example, and not of limitation, computer-readable media may include a communication media.

Computer storage media includes volatile and nonvolatile, removable and non-removable media implemented in any method or technology for storage of information such as computer-readable instructions, data structures, program modules, or other data. Computer storage media includes, but is not limited to, random-access memory (RAM), read-only memory (ROM), electrically erasable programmable read-only memory (EEPROM), flash memory, or other memory technology, CD-ROM, digital versatile disks (DVD), or other optical disk storage, magnetic cassettes, magnetic tape, magnetic disk storage, or other magnetic storage devices, or any other medium which can be used to store the desired information and which can be accessed by the computing device 1810. In a further embodiment, a computer storage media may include a group of computer storage media devices. In another embodiment, a computer storage media may include an information store. In another embodiment, an information store may include a quantum memory, a photonic quantum memory, or atomic quantum memory. Combinations of any of the above may also be included within the scope of computer-readable media. Computer storage media is a non-transitory computer-readable media.

Communication media may typically embody computer-readable instructions, data structures, program modules, or other data in a modulated data signal such as a carrier wave or other transport mechanism and include any information delivery media. The term "modulated data signal" means a signal that has one or more of its characteristics set or changed in such a manner as to encode information in the signal. By way of example, and not limitation, communications media may include wired media, such as a wired network and a direct-wired connection, and wireless media such as acoustic, RF, optical, and infrared media. Communication media is a transitory computer-readable media.

The system memory 1830 includes computer storage media in the form of volatile and nonvolatile memory such as ROM 1831 and RAM 1832. A RAM may include at least one of a DRAM, an EDO DRAM, a SDRAM, a RDRAM, a VRAM, or a DDR DRAM. A basic input/output system (BIOS) 1833, containing the basic routines that help to transfer information between elements within the computing device 1810, such as during start-up, is typically stored in ROM 1831. RAM 1832 typically contains data and program modules that are immediately accessible to or presently being operated on by the processor 1820. By way of example, and not limitation, FIG. 18 illustrates an operating system 1834, application programs 1835, other program modules 1836, and program data 1837. Often, the operating system 1834 offers services to applications programs 1835 by way of one or more application programming interfaces (APIs) (not shown). Because the operating system 1834 incorporates these services, developers of applications programs 1835 need not redevelop code to use the services. Examples of APIs provided by operating systems such as Microsoft's "WINDOWS"® are well known in the art.

The computing device 1810 may also include other removable/non-removable, volatile/nonvolatile computer storage media products. By way of example only, FIG. 18 illustrates a non-removable non-volatile memory interface (hard disk interface) 1840 that reads from and writes for example to non-removable, non-volatile magnetic media. FIG. 18 also illustrates a removable non-volatile memory interface 1850 that, for example, is coupled to a magnetic disk drive 1851 that reads from and writes to a removable, non-volatile magnetic disk 1852, or is coupled to an optical disk drive 1855 that reads from and writes to a removable, non-volatile optical disk 1856, such as a CD ROM. Other removable/non-removable, volatile/non-volatile computer storage media that can be used in the example operating environment include, but are not limited to, magnetic tape cassettes, memory cards, flash memory cards, DVDs, digital video tape, solid state RAM, and solid state ROM. The hard disk drive 1841 is typically connected to the system bus 1821 through a non-removable memory interface, such as the interface 1840, and magnetic disk drive 1851 and optical disk drive 1855 are typically connected to the system bus 1821 by a removable non-volatile memory interface, such as interface 1850.

The drives and their associated computer storage media discussed above and illustrated in FIG. 18 provide storage of computer-readable instructions, data structures, program modules, and other data for the computing device 1810. In FIG. 18, for example, hard disk drive 1841 is illustrated as storing an operating system 1844, application programs 1845, other program modules 1846, and program data 1847. Note that these components can either be the same as or different from the operating system 1834, application programs 1835, other program modules 1836, and program data 1837. The operating system 1844, application programs 1845, other program modules 1846, and program data 1847 are given different numbers here to illustrate that, at a minimum, they are different copies.

A user may enter commands and information into the computing device 1810 through input devices such as a microphone 1863, keyboard 1862, and pointing device 1861, commonly referred to as a mouse, trackball, or touch pad. Other input devices (not shown) may include at least one of a touch-sensitive screen or display surface, joystick, game pad, satellite dish, and scanner. These and other input devices are often connected to the processor 1820 through a user input interface 1860 that is coupled to the system bus, but may be connected by other interface and bus structures, such as a parallel port, game port, or a universal serial bus (USB).

A display 1891, such as a monitor or other type of display device or surface may be connected to the system bus 1821 via an interface, such as a video interface 1890. A projector display engine 1892 that includes a projecting element may be coupled to the system bus. In addition to the display, the computing device 1810 may also include other peripheral output devices such as speakers 1897 and printer 1896, which may be connected through an output peripheral interface 1895.

The computing system environment 1800 may operate in a networked environment using logical connections to one or more remote computers, such as a remote computer 1880. The remote computer 1880 may be a personal computer, a server, a router, a network PC, a peer device, or other common network node, and typically includes many or all of the elements described above relative to the computing device 1810, although only a memory storage device 1881 has been illustrated in FIG. 18. The network logical connections depicted in FIG. 18 include a local area network (LAN) and a wide area network (WAN), and may also include other networks such as a personal area network (PAN) (not shown). Such networking environments are commonplace in offices, enterprise-wide computer networks, intranets, and the Internet.

When used in a networking environment, the computing system environment 1800 is connected to the network 1871 through a network interface, such as the network interface 1870, the modem 1872, or the wireless interface 1893. The network may include a LAN network environment, or a WAN network environment, such as the Internet. In a networked environment, program modules depicted relative to the computing device 1810, or portions thereof, may be stored in a remote memory storage device. By way of example, and not limitation, FIG. 18 illustrates remote application programs 1885 as residing on memory storage device 1881. It will be appreciated that the network connections shown are examples and other means of establishing a communication link between the computers may be used.

In certain instances, one or more elements of the computing device 1810 may be deemed not necessary and omitted. In other instances, one or more other elements may be deemed necessary and added to the computing device.

Figure 19:
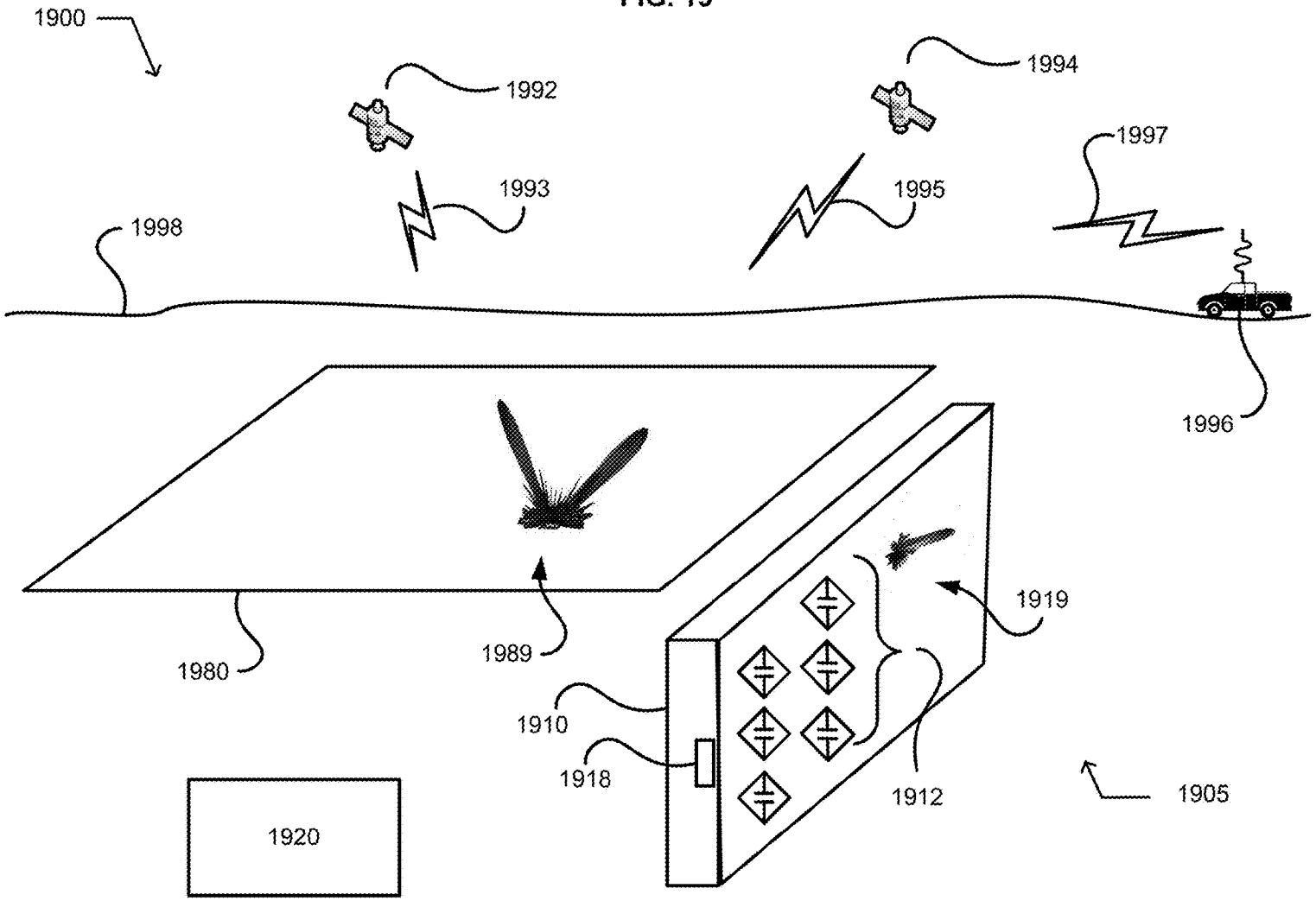
FIG. 19 illustrates an environment 1900 in which embodiments may be implemented.

FIG. 19 illustrates an environment 1900 in which embodiments may be implemented. The environment includes a horizon 1998 (which may be the earth's horizon), at least two spaceborne sources transmitting a target signal, illustrated by spaceborne sources 1992 and 1994 respectively transmitting target signals 1993 and 1995. The environment includes a terrestrial source transmitting a possible interfering signal, illustrated by vehicle 1996 transmitting possible interfering signal 1997. The environment includes an antenna system 1905, and an associated antenna 1980.

The antenna system 1905 includes a surface scattering antenna 1910. The surface scattering antenna includes an electromagnetic waveguide structure 1918 and a plurality of electromagnetic wave scattering elements 1912 distributed along the waveguide structure. The wave scattering elements have an inter-element spacing that is substantially less than a free-space wavelength of a highest operating frequency of the surface scattering antenna. Each electromagnetic wave scattering element of the plurality of electromagnetic wave scattering elements has a respective activatable electromagnetic response to a guided wave propagating in the waveguide structure. The plurality of electromagnetic wave scattering elements are operable in combination to produce a controllable radiation pattern, illustrated by a radiation pattern 1919. In an embodiment, the controllable radiation pattern includes a controllable gain pattern. In an embodiment, a radiation pattern refers to a distribution of gain in an antenna. The antenna system includes antenna system components 1920.

Figure 20:
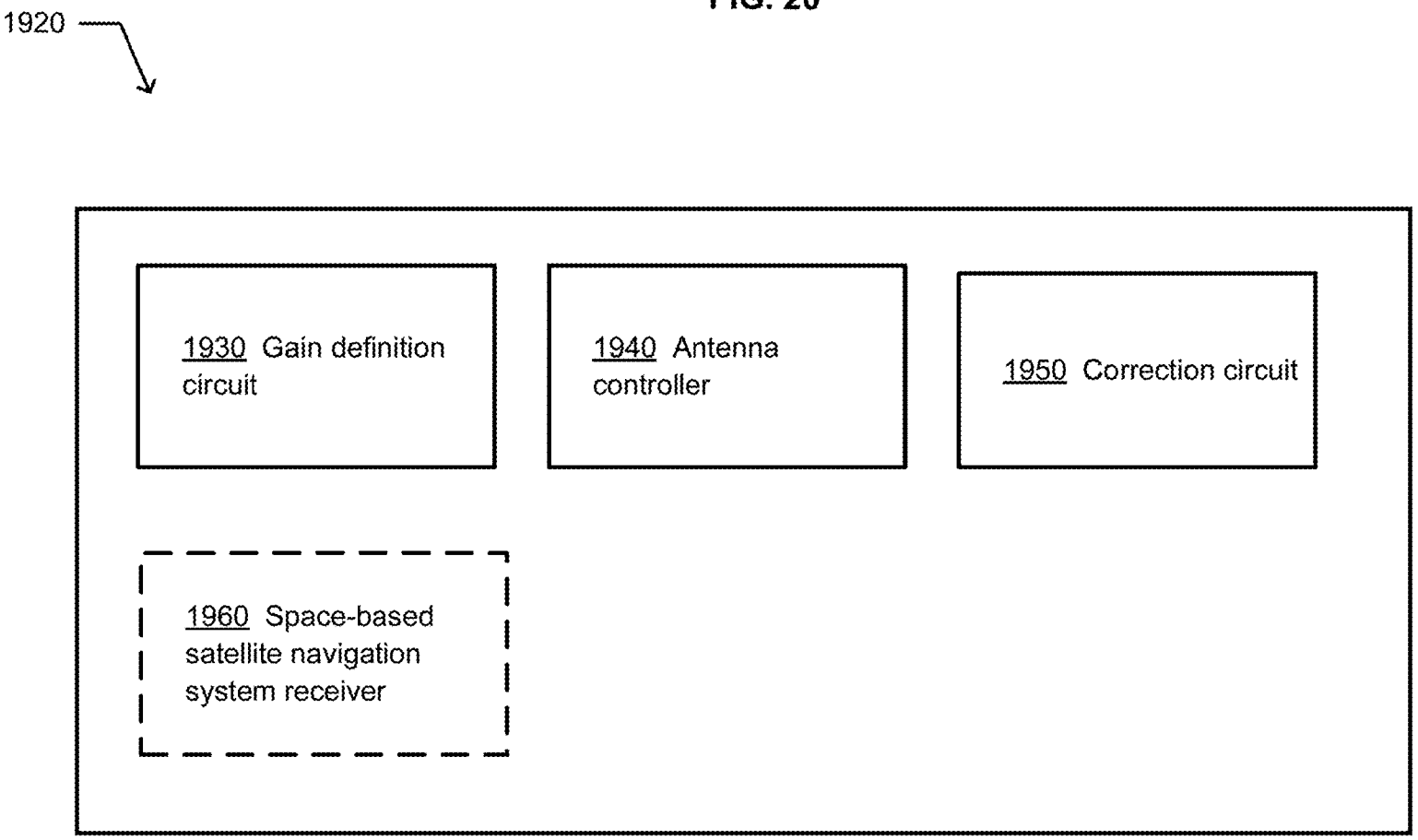
FIG. 20 schematically illustrates components 1920 of the antenna system 1905.
Figure 21:
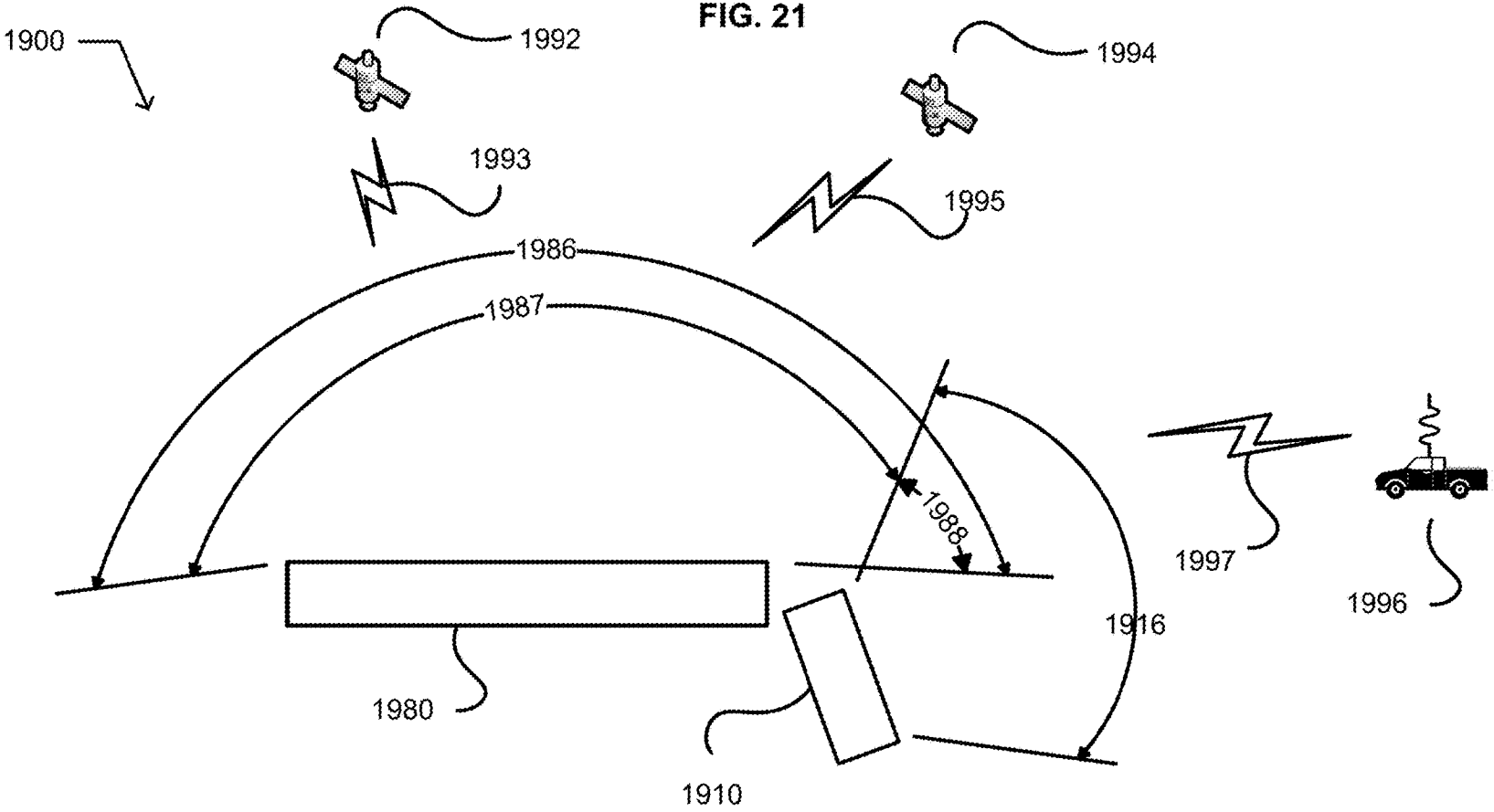
FIG. 21 schematically illustrates fields of view of the surface scattering antenna 1910 and the associated antenna 1980.

FIG. 20 schematically illustrates components 1920 of the antenna system 1905. The components include a gain definition circuit 1930 configured to define a radiation pattern 1919 configured to receive a possible interfering signal 1997 transmitted within an operating frequency band of an associated antenna 1980. FIG. 21 schematically illustrates fields of view of the surface scattering antenna 1910 and the associated antenna. The associated antenna has a field of view 1986 that includes a desired field of view 1987 and an undesired field of view 1988. The surface scattering antenna has a field of view 1916 that includes or covers at least a portion of the undesired field of view of the associated antenna. The defined antenna radiation pattern includes a field of view covering or including at least a portion of the undesired field of view of the associated antenna.

Returning to FIG. 20, the components 1920 of the antenna system 1905 include an antenna controller 1940 configured to establish the defined radiation pattern 1919 in the surface scattering antenna 1910 by activating the respective electromagnetic response of selected electromagnetic wave scattering elements of the plurality of electromagnetic wave scattering elements 1912. In an embodiment, the activating the respective electromagnetic response of selected electromagnetic wave scattering elements may be considered as establishing a hologram corresponding to the defined radiation pattern. The components of the antenna system include a correction circuit 1950 configured to reduce an influence of the received possible interfering signal 1997 in a contemporaneously received signal 1993 by the associated antenna 1980.

In an embodiment, the surface scattering antenna 1910 includes a surface scattering antenna having a thin or narrow planar dimension relative to a planar dimension of the associated antenna 1980. For example, a major planar dimension of the surface scattering antenna may be less than 20% of a major planar dimension of the associated antenna. In an embodiment, the aperture of the surface scattering antenna is less than 50% of the aperture of the associated antenna. In an embodiment, the aperture of the surface scattering antenna is less than 25% of the aperture of the associated antenna. In an embodiment, the surface scattering antenna includes a surface scattering antenna configured to generate an adjustable or reconfigurable radiation pattern 1919. In an embodiment, the surface scattering antenna includes an omnidirectional or bidirectional surface scattering antenna. In an embodiment, the surface scattering antenna includes a planar surface scattering antenna. In an embodiment, the surface scattering antenna includes a non-planar surface scattering antenna.

In an embodiment, the electromagnetic wave scattering elements 1912 include discrete electromagnetic wave scattering elements. In an embodiment, the electromagnetic wave scattering elements include electromagnetic wave scattering or radiating elements. In an embodiment, the electromagnetic wave scattering elements include metamaterial wave scattering elements. In an embodiment, the electromagnetic wave scattering elements include electromagnetic wave transmitting elements. In an embodiment, the electromagnetic wave scattering elements include electromagnetic wave receiving elements. In an embodiment, the electromagnetic wave scattering elements are exposed to a propagation path of the electromagnetic waveguide structure 1918. In an embodiment, the electromagnetic wave scattering elements include electromagnetic wave scattering elements respectively having at least two individually adjustable electromagnetic responses to a guided wave propagating in the waveguide structure. In an embodiment, the inter-element spacing of the electromagnetic scattering elements includes at least three electromagnetic scattering elements per the free-space wavelength. In an embodiment, the inter-element spacing of the electromagnetic scattering elements includes at least five electromagnetic scattering elements per the free-space wavelength.

In an embodiment, the plurality of electromagnetic wave scattering elements 1912 are operable in combination to produce a dynamically controllable radiation pattern 1919. In an embodiment, the plurality of electromagnetic wave scattering elements are operable in combination to produce a variable radiation pattern providing localization on the possible interfering signal 1997. In an embodiment, the plurality of electromagnetic wave scattering elements are operable in combination to produce a controllable radiation envelope. In an embodiment, the plurality of electromagnetic wave scattering elements are operable in combination to produce a controllable radiation pattern in response to a control signal.

In an embodiment, the gain definition circuit 1930 includes a gain definition circuit configured to define an antenna radiation pattern 1919 with a field of view 1916 shaped to facilitate searching at least a portion of the undesired field of view 1988 of the associated antenna 1980 for the possible interfering signal 1997. In an embodiment, the gain definition circuit includes a gain definition circuit configured to define a series of antenna radiation patterns with fields of view shaped to facilitate searching at least a portion of the undesired field of view of the associated antenna for the possible interfering signal. In an embodiment, the gain definition circuit includes a gain definition circuit configured to define an antenna radiation pattern with a field of view shaped to localize at least a portion of the undesired field of view of the associated antenna for the possible interfering signal. In an embodiment, the gain definition circuit is further configured to instruct the antenna controller 1940 to implement the defined radiation pattern. In an embodiment, the defined radiation pattern is selected based on trial and error. In an embodiment, the defined radiation pattern is selected from a library of potential radiation patterns. In an embodiment, the defined radiation pattern is selected from a history of radiation patterns previously established in the surface scattering antenna 1910. In an embodiment, the undesired field of view of the associated antenna includes a terrestrial or low altitude region. For example, the undesired field of view may include a field of view below 20 degrees zenith. For example, the undesired field of view may include below the earth's horizon. In an embodiment, the undesired field of view of the associated antenna includes a field of view away from a source of a target signal. For example, such as away from one or more orbiting objects, such as the spaceborne sources 1992 and 1994, or away from a likely direction of a terrestrial target. In an embodiment, the desired field of view of the associated antenna includes a skyward or hemispherical view. For example, a skyward or hemispherical field of view may include a field of view likely to be occupied by an orbiting object, a neighboring satellite in an intra-satellite communication system, or a likely direction of a terrestrial target. In an embodiment, the desired field of view of the associated antenna includes a field of view that includes a source of the target signal.

In an embodiment, the antenna controller 1940 is further configured to implement the defined radiation pattern 1919. In an embodiment, the antenna controller is configured to establish at least two radiation patterns in the surface scattering antenna 1910 by dynamically controlling the respective electromagnetic responses of the electromagnetic wave scattering elements of the plurality of electromagnetic wave scattering elements 1912. In an embodiment, the antenna controller is configured to establish the defined radiation pattern in the surface scattering antenna by applying a bias activating the respective electromagnetic response of the electromagnetic wave scattering elements of the plurality of electromagnetic wave scattering elements. In an embodiment, the bias includes a bias voltage, bias field, bias current, or biasing mechanical inputs.

In an embodiment, the correction circuit 1950 is further configured to detect the possible interfering signal 1997. In an embodiment, the associated antenna 1980 includes an associated skyward or hemispherically sensitive antenna configured to receive electromagnetic signals transmitted by an airborne or spaceborne source. For example, an airborne or spaceborne source includes a source flying or orbing above the horizon 1998 of the earth.

In an embodiment, the possible interfering signal 1997 includes a possible jamming signal. In an embodiment, the possible interfering signal includes a possible spoofing signal. In an embodiment, the possible interfering signal includes a possible malicious signal. In an embodiment, the possible interfering signal includes a possible intentionally interfering signal. In an embodiment, the possible interfering signal includes a possible unintentionally interfering signal.

In an embodiment, the correction circuit 1950 is configured to cancel a component of the received possible interfering signal 1996 in the contemporaneously received signal 1993 by the associated antenna 1980. In an embodiment, the gain definition circuit 1930 is further configured to maximize a received strength of the possible interfering signal by establishing the antenna radiation pattern 1919 in response to data received from the correction circuit. In an embodiment, the correction circuit is configured to subtract the possible interfering signal from the contemporaneously received signal by the associated antenna. In an embodiment, the correction circuit includes a variable attenuator configured to adjust the signal strength of a received possible interfering signal, and is configured to subtract or offset the possible interfering signal at the adjusted strength level from the contemporaneously received signal by the associated antenna.

In an embodiment, the correction circuit 1950 includes an adaptive correction circuit. In an embodiment, the adaptive correction circuit is configured to determine phases and amplitudes of the received possible interfering signal 1997 and the contemporaneously received signal 1993. The adaptive correction circuit is further configured to combine the possible interfering signal and the contemporaneously received signal to produce a reduction of an influence of the received possible interfering signal in the contemporaneously received signal. In an embodiment, the adaptive correction circuit includes use of space-time adaptive processing in reducing an influence of the received possible interfering signal in the contemporaneously received signal.

In an embodiment, the correction circuit includes a correction circuit configured to using a signal-processing technique to reduce an influence of the received possible interfering signal in the contemporaneously received signal. For example, the correction circuit may employ analog phase shifting and summing at the received frequency. For example, the correction circuit may employ analog phase shifting and summing at a baseband or IF frequency. For example, the correction circuit may employ A/D conversion and digital combining.

In an embodiment, the gain definition circuit 1930 is further configured to facilitate detection of the possible interfering signal 1997 by adaptively varying a radiation pattern 1919 of the surface scattering antenna 1910 to home in on the possible interfering signal. For example, the homing in thereby producing a higher fidelity reception of the possible interfering signal for use in signal cancellation.

In an embodiment of the system 1905, a peripheral portion of the associated antenna 1980 includes the surface scattering antenna 1910. In an embodiment, the peripheral portion of the associated antenna includes an electromagnetic wave deflecting structure configured to direct an arriving electromagnetic wave into the defined radiation pattern of the surface scattering antenna. In an embodiment, the wave deflecting structure includes a wave reflecting structure. In an embodiment, the wave deflecting structure includes a lens structure. For example, the lens structure may include a metamaterial lens structure. In an embodiment, the wave deflecting structure includes a prism structure. For example, the prism structure may include a metamaterial prism structure.

In an embodiment, the system 1905 includes the associated antenna 1980 with the desired field of view 1987. In an embodiment, the surface scattering antenna 1910 is configured to be mounted on an airborne vehicle. For example, an airborne vehicle may include a fixed or rotary winged aircraft. For example, a fixed wing aircraft may include a drone. In an embodiment, the surface scattering antenna is configured to be mounted on a missile. For example, a missile may include a ground-to-ground missile, an air-to-ground missile, or a ballistic missile. In an embodiment, the surface scattering antenna is configured to be mounted on a terrestrial vehicle. In an embodiment, the system includes a space-based satellite navigation system receiver 1960. For example, the receiver may include a GPS receiver.

Figure 22:
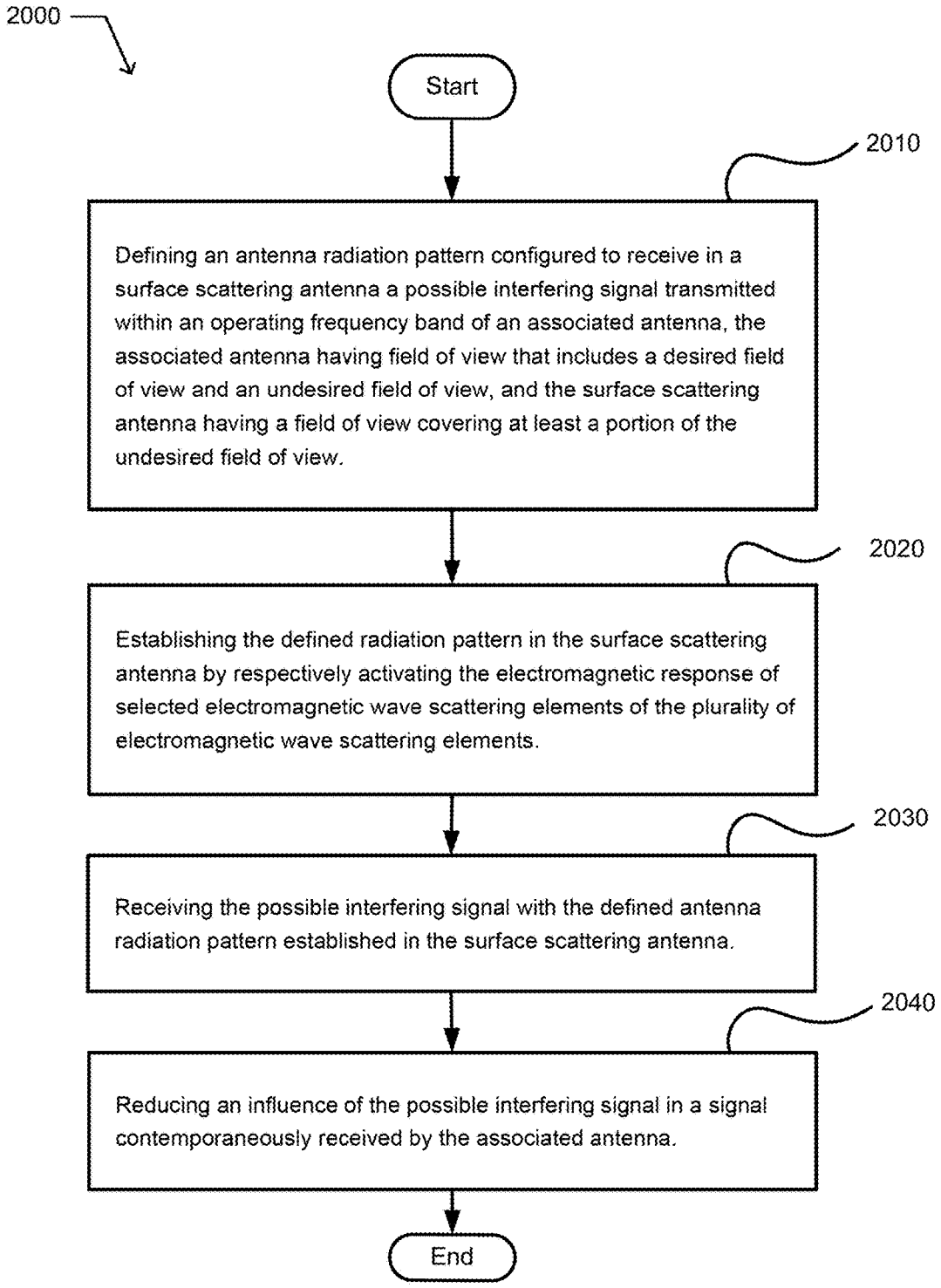
FIG. 22 illustrates an example operational flow 2000.

FIG. 22 illustrates an example operational flow 2000. After a start operation, the operational flow includes a gain characterization operation 2010. The gain characterization operation includes defining an antenna radiation pattern configured to receive in a surface scattering antenna a possible interfering signal transmitted within an operating frequency band of an associated antenna. The associated antenna having field of view that includes a desired field of view and an undesired field of view, and the surface scattering antenna having a field of view covering at least a portion of the undesired field of view. In an embodiment, the gain characterization operation may be implemented using the gain definition circuit 1930 described in conjunction with FIG. 20. A beam-forming operation 2020 includes establishing the defined radiation pattern in the surface scattering antenna by respectively activating the electromagnetic response of selected electromagnetic wave scattering elements of the plurality of electromagnetic wave scattering elements. In an embodiment, the beam-forming operation may be implemented by the antenna controller 1940 respectively activating the electromagnetic response of selected electromagnetic wave scattering elements of the plurality of electromagnetic wave scattering elements 1912 of the surface scattering antenna 1910 described in conjunction with FIGS. 21-22. A signal acquisition operation 2030 includes receiving the possible interfering signal with the defined antenna radiation pattern established in the surface scattering antenna. For example, the signal acquisition operation may be implemented by the surface scattering antenna 1910 receiving the possible interfering signal 1997 described in conjunction with FIG. 19. A signal processing operation 2040 includes reducing an influence of the possible interfering signal in a contemporaneously received signal by the associated antenna. In an embodiment, the signal processing operation may be implemented by the correction circuit 1950 offsetting the possible interfering signal 1197 from the contemporaneously received signal 1993 by the associated antenna 1980 described in conjunction with FIGS. 21-22. The operational flow includes an end operation. The surface scattering antenna includes an electromagnetic waveguide structure and the plurality of electromagnetic wave scattering elements distributed along the waveguide structure. The plurality of waveguides have an inter-element spacing substantially less than a free-space wavelength of a highest operating frequency of the surface scattering antenna. Each electromagnetic wave scattering element of the plurality of electromagnetic wave scattering elements have a respective activatable electromagnetic response to a guided wave propagating in the waveguide structure. The plurality of electromagnetic wave scattering elements are operable in combination to produce a controllable radiation pattern.

In an embodiment, the operation flow 2000 may include a second iteration operation. The second iteration operation includes reshaping the antenna radiation pattern established in the surface scattering antenna in response to an aspect of the received possible interfering signal. The second iteration operation includes receiving another instance of the possible interfering signal on the operating frequency of the another antenna with the reshaped antenna radiation pattern established in the surface scattering antenna. The second iteration operation may include the signal processing operation 2040 reducing an influence of the possible interfering signal in a contemporaneously received signal by the associated antenna based upon the received another instance of the possible interfering signal.

Figure 23:
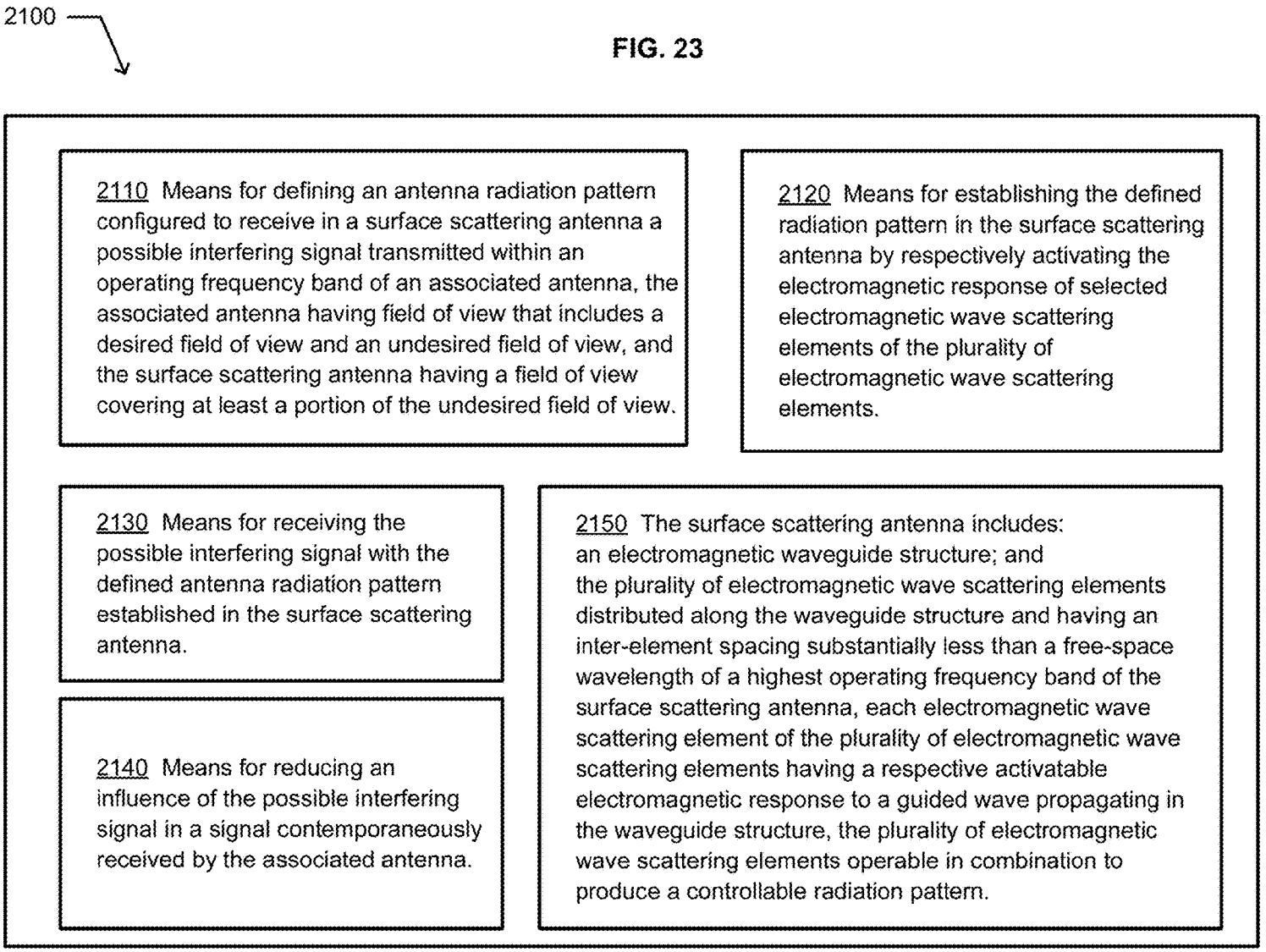
FIG. 23 illustrates an example system 2100.

FIG. 23 illustrates an example system 2100. The example system includes means 2110 for defining an antenna radiation pattern configured to receive in a surface scattering antenna a possible interfering signal transmitted within an operating frequency band of an associated antenna. The associated antenna having field of view that includes a desired field of view and an undesired field of view, and the surface scattering antenna having a field of view covering at least a portion of the undesired field of view. The example system includes means 2120 for establishing the defined radiation pattern in the surface scattering antenna by respectively activating the electromagnetic response of selected electromagnetic wave scattering elements of the plurality of electromagnetic wave scattering elements. The system includes means 2130 for receiving the possible interfering signal with the defined antenna radiation pattern established in the surface scattering antenna. The system includes means 2140 for reducing an influence of the possible interfering signal in a signal contemporaneously received by the associated antenna. The surface scattering antenna 2150 includes an electromagnetic waveguide structure, and the plurality of electromagnetic wave scattering elements distributed along the waveguide structure. The electromagnetic wave scattering elements have an inter-element spacing substantially less than a free-space wavelength of a highest operating frequency of the surface scattering antenna. Each electromagnetic wave scattering element of the plurality of electromagnetic wave scattering elements have a respective activatable electromagnetic response to a guided wave propagating in the waveguide structure, the plurality of electromagnetic wave scattering elements operable in combination to produce a controllable radiation pattern.

Figure 24:
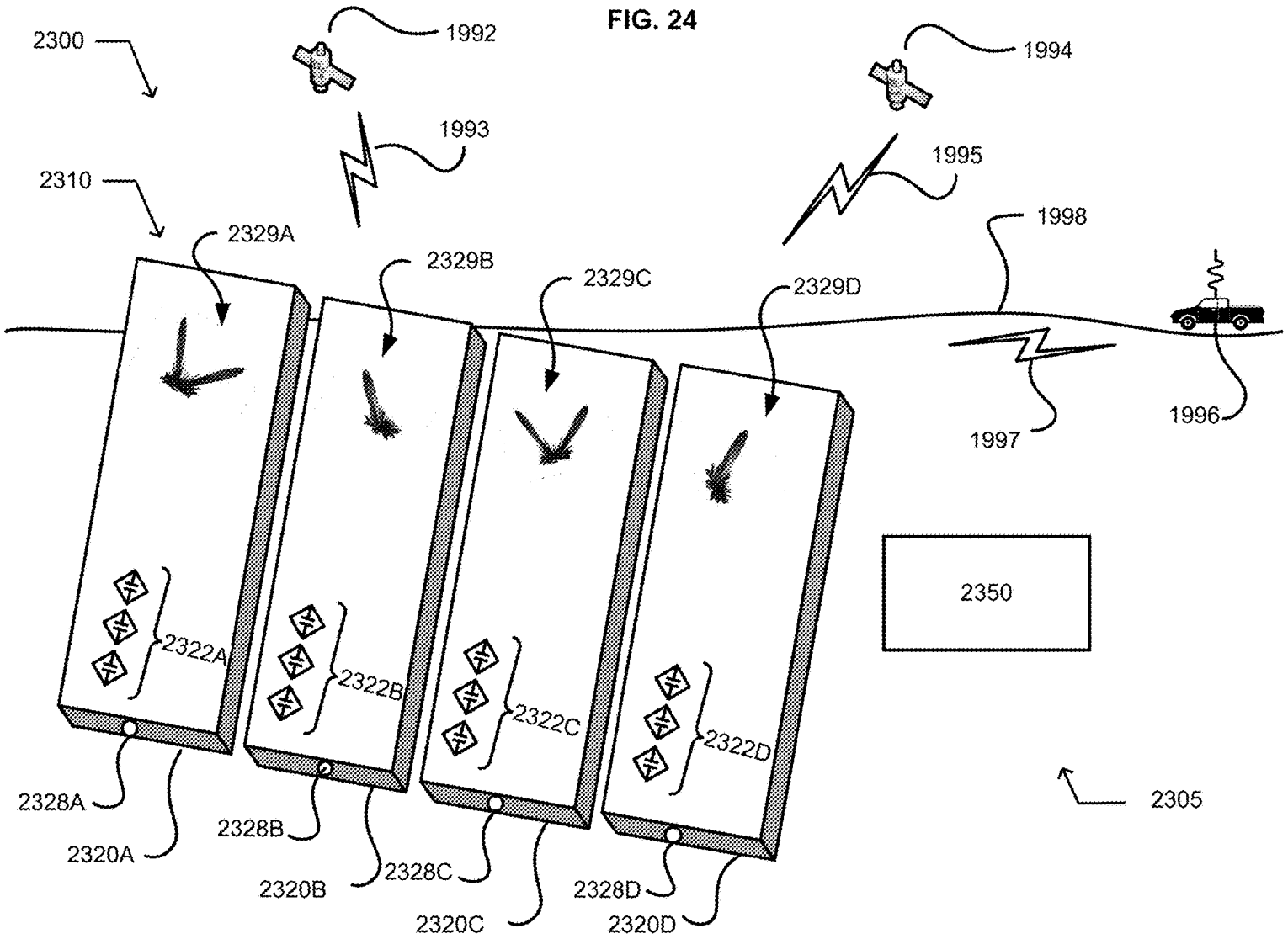
FIG. 24 illustrates an environment 2300 in which embodiments may be implemented.

FIG. 24 illustrates an environment 2300 in which embodiments may be implemented. The environment includes the horizon 1998, at least two spaceborne sources transmitting a target signal, illustrated by the spaceborne sources 1992 and 1994 respectively transmitting the target signals 1993 and 1995. The environment includes a terrestrial source transmitting the possible interfering signal, illustrated by the vehicle 1996 transmitting the possible interfering signal 1997. The environment includes an antenna system 2305.

The antenna system 2305 includes an antenna assembly 2310 and components 2350. The antenna assembly includes at least two surface scattering antenna segments, which are illustrated as the surface scattering antenna segments 2320A-2320D. Each segment of the at least two surface scattering antenna segments includes a respective electromagnetic waveguide structure, which are illustrated as waveguide structures 2328A-2328D, and a respective plurality of electromagnetic wave scattering elements, which are illustrated as a plurality of electromagnetic wave scattering elements 2320A-2320D. The plurality of electromagnetic wave scattering elements are distributed along the waveguide structure and have an inter-element spacing substantially less than a free-space wavelength of a highest operating frequency of the antenna segment. Each electromagnetic wave scattering element of the plurality of electromagnetic wave scattering elements has a respective activatable electromagnetic response to a guided wave propagating in their respective waveguide structure. The plurality of electromagnetic wave scattering elements of each antenna segment are operable in combination to produce a controllable radiation pattern, which are illustrated as respective radiation patterns 2329A-2329D. Furthermore, the at least two surface scattering antennas are operable in combination to produce a controllable radiation pattern. In an embodiment, the at least two surface scattering antenna segments include at least two surface scattering antenna apertures.

Figure 25:
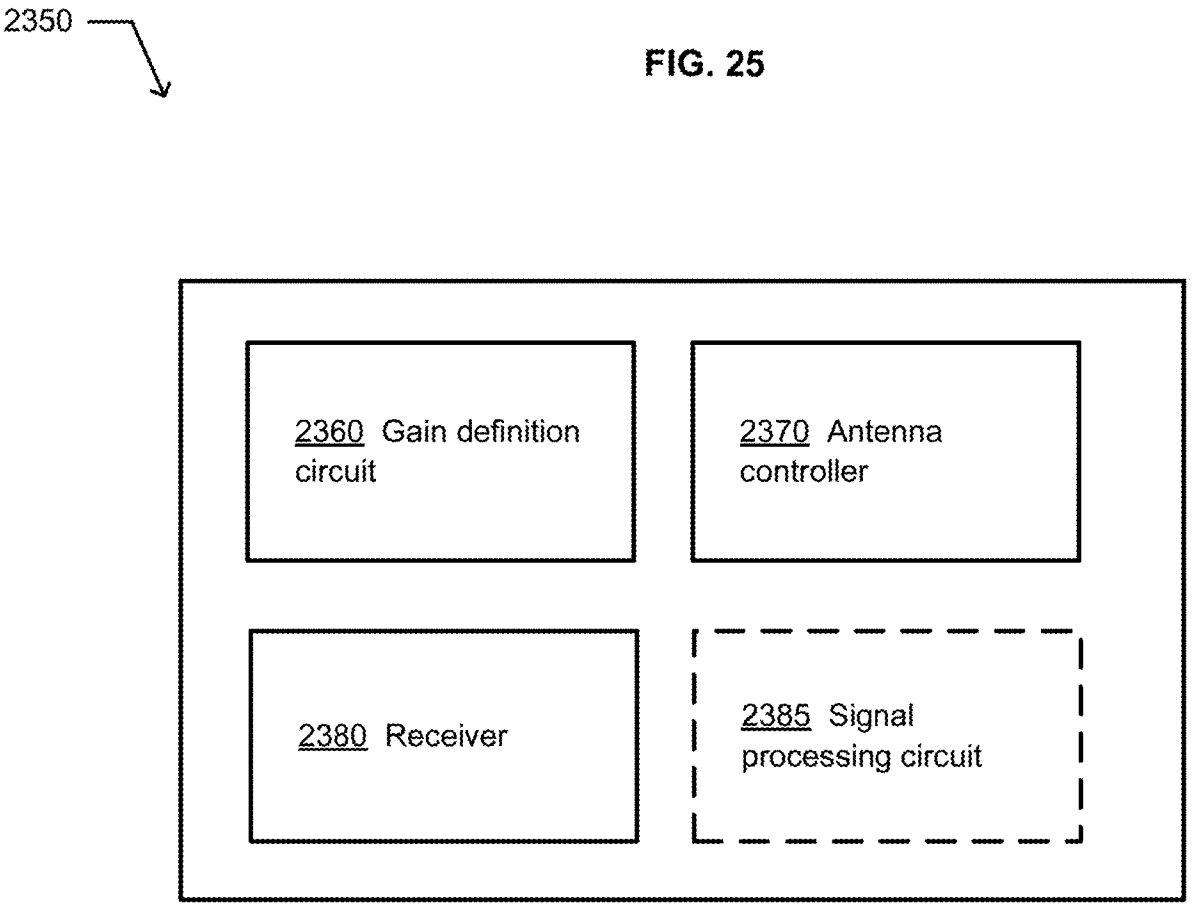
FIG. 25 illustrates the components 2350 of the antenna system 2305.

FIG. 25 illustrates the components 2350 of the antenna system 2305. The components 2350 of the antenna system include a gain definition circuit 2360 configured to define a series of at least two radiation patterns implementable by the at least two surface scattering antenna segments. The series of at least two respective radiation patterns is selected to facilitate a convergence on an antenna radiation pattern that maximizes a radiation performance metric that includes reception of a signal from a desired field of view or rejection of a signal from an undesired field of view. In an embodiment, the signal from a desired field of view includes a desired signal. In an embodiment, the signal from the undesired field of view includes a possible interfering signal. The antenna system includes an antenna controller 2370 configured to sequentially establish each radiation pattern of the series of at least two radiation patterns by activating the respective electromagnetic response of selected electromagnetic wave scattering elements of the plurality of electromagnetic wave scattering elements of the at least two surface scattering antenna segments. The antenna system includes a receiver 2380 configured to receive signals from the desired field of view and signals from the undesired field of view.

For example, in operation, the gain definition circuit 2360 and the antenna controller 2370 are configured to initially look for a signal from a desired field of view, illustrated as the signal 1193 from the spaceborne source 1992. If in the course of receiving the signal from the desired field of view, a possible malicious signal from a low zenith source, illustrated as the signal 1997 from the possible interfering signal 1996 is also received, the gain definition circuit 2360 and the antenna controller 2370 iteratively tune the fringes of the radiation pattern of at least one segment of the at least two segments 2320A-2320D to see what happens with the received lower zenith signal. For example, the antenna controller may see what happens to the fringes on one or two segments are shifted in a direction by ½ wavelength. The antenna controller looks to see if the combination of the signal strength of the undesired field of view is reduced or not. The antenna controller keeps iteratively tuning until an acceptably low or minimum combination of the signal strength of the undesired field of view results, and then the receiver 2380 processes the combined signals.

In an embodiment, the antenna assembly 2310 includes an at least substantially planar arrangement having the at least two antenna segments. In an embodiment, the antenna assembly includes a conformal arrangement of the at least two antenna segments. For example, the conformal arrangement may be configured to be mounted on or carried by an exterior surface of an aircraft or missile. In an embodiment, the antenna assembly includes a first substantially planar antenna segment physically joined with a second substantially planar antenna segment. In an embodiment, the aperture planes may be collinear or non-collinear. In an embodiment, the antenna assembly includes a first substantially planar antenna segment physically abutting or contiguous with a second substantially planar antenna segment. In an embodiment, the antenna assembly includes a first antenna segment 2320A optimized in area, orientation, or mounting for scattering to or receiving signals from a specific set or distribution of objects. For example, the first antenna segment may be optimized for receiving a signal transmitted by a space-based satellite navigation system. For example, a second antenna segment 2320B may be optimized with a relatively small aperture for a field of view that includes near-zenith angles. In an embodiment, a first segment of the at least two segments includes a receiving aperture that is larger than a receiving aperture of a second segment of the at least two segments. In an embodiment, the receiving aperture of a first segment of the at least two segments and a receiving aperture of a second segment of the at least two segments are substantially equal.

In an embodiment, the undesired field of view signal includes a possible interfering signal. In an embodiment, the desired field of view signal includes a possible target or desired signal. In an embodiment, the series of at least two radiation patterns is defined in advance.

In an embodiment, the series of at least two radiation patterns is defined on the fly. In an embodiment, the series of at least two radiation patterns is incrementally defined based on trial and error. In an embodiment, the series of at least two radiation patterns is incrementally and adaptively defined based on trial and error. In an embodiment, the series of the at least two radiation patterns is selected from a library of potential radiation patterns. In an embodiment, the series of the at least two radiation patterns is selected randomly from radiation patterns implementable by the at least two antenna segments. In an embodiment, the series of at least two radiation patterns is estimated or projected to facilitate the convergence. In an embodiment, the radiation performance metric includes optimizing a combined signal strength received from the desired field of view and minimizing a combined signal strength from an undesired field of view. In an embodiment, the radiation performance metric includes maximizing a combined signal strength received from a desired field of view and minimizing a combined signal strength received from a undesired field of view. In an embodiment, the radiation performance metric includes a weighted combination of one or more antenna reception performance factors, subject to at least one constraint. In an embodiment, an antenna reception radiation performance factor includes an amplitude of the signal received from the desired field of view, or an amplitude of the signal received from the undesired field of view. In an embodiment, an antenna reception radiation performance factor includes antenna gain for one or more desired directions or angular regions, or antenna gain for one or more undesired directions or angular regions. In an embodiment, an antenna reception radiation performance factor includes signal to noise ratio, signal to interference ratio, signal to clutter ratio, channel capacity, data rate, or error rate. In an embodiment, the constraint of the antenna radiation performance metric includes a constraint on amplitude of the signal received from the desired field of view, or on an amplitude of the signal received from the undesired field of view. In an embodiment, the constraint of the antenna radiation performance metric includes a constraint on antenna gain for one or more desired directions or angular regions, or antenna gain for one or more undesired directions or angular regions. In an embodiment, the constraint of the antenna radiation performance metric includes a constraint on signal to noise ratio, signal to interference ratio, signal to clutter ratio, channel capacity, data rate, or error rate. In an embodiment, the optimized combined signal strength received from a desired field of view includes a combined desired field of view signal optimized for processing by the receiver circuit.

In an embodiment, the gain definition circuit 2360 includes an adaptive gain definition circuit configured to define a second radiation pattern of the at least two radiation patterns responsive to a combined signal received from a desired field of view and a combined signal received from a undesired field of view with the at least two antenna segments configured in a first radiation pattern of the at least two radiation patterns. In an embodiment, the series of at least two radiation patterns are defined to adjust an amplitude or phase of the undesired field of view signal received by a first antenna segment relative to an amplitude or phase of the undesired field of view signal received by a second antenna segment of the at least two segments of the antenna assembly in a manner predicted to minimize the combined signal received from the undesired field of view by the first segment and the second segment. For example, the radiation patterns of the two individual segments are adjusted for the desired field of view signals to remain substantially in phase and for the undesired field of view signals to become substantially out of phase and self-cancelling. In an embodiment, the adaptive gain definition circuit is configured to define the second radiation pattern of the series of at least two radiation patterns by modifying a previously implemented first radiation pattern of the series of at least two radiation patterns. In an embodiment, the adaptive gain definition circuit is configured to define the series of at least two respective radiation patterns in response to a library of at least three potential radiation patterns. In an embodiment, the adaptive gain definition circuit is configured to define the series of at least two respective radiation patterns in response to a library of at least three potential radiation patterns and a parameter of the undesired field of view signal. In an embodiment, the adaptive gain definition circuit is configured to define the series of at least two radiation patterns in response to a selection algorithm. In an embodiment, the adaptive gain definition circuit is configured to make at least two successive iterations of defining the set of at least two respective radiation patterns during a course of facilitating a convergence on an optimized combined signal strength received from the desired field of view and a minimized combined signal strength received from the undesired field of view.

In an embodiment, the series of at least two radiation patterns is defined to: (a) adjust an amplitude or phase of the undesired field of view signal received by the first antenna segment relative to an amplitude or phase of the undesired field of view signal received by the second antenna segment of the at least two segments of the antenna assembly in a manner predicted to increase a degradation in the combined signals received from the undesired field of view by the first segment and the second segment; and (b) adjust an amplitude or phase of the desired field of view signal received by a first antenna segment relative to an amplitude or phase of the desired field of view signal received by a second antenna segment of the at least two segments of the antenna assembly in a manner predicted to minimize any degradation in the combined signals received from the desired field of view by the first segment and the second segment. For example, in an embodiment, the amplitude or phase of the desired field of view signal source may be degraded less than 10% while the amplitude or phase of the undesired field of view may be degraded by at least about 50%. In an embodiment, the series of at least two radiation patterns are defined to respectively adjust an amplitude or phase the desired field of view and of the undesired field of view signals received by the at least two segments of the antenna assembly in a manner predicted to minimize the combined signal received from the undesired field of view while substantially maintaining the combined signal received from the desired field of view. In an embodiment, the adaptive gain definition circuit is configured to define a second radiation pattern of the series of at least two radiation patterns in response to an amplitude or phase of a received desired field of view signal with the antenna segments configured in a first radiation pattern of the series of at least two radiation patterns. For example, the adaptive gain definition circuit may be configured to iteratively define the second radiation pattern. In an embodiment, the adaptive gain definition circuit is configured to define a second radiation pattern of the series of at least two radiation patterns in response to an amplitude or phase of a received undesired field of view signal with the antenna segments configured in a first radiation pattern of the series of at least two radiation patterns. In an embodiment, the adaptive gain definition circuit is configured to define a second radiation pattern of the series of at least two radiation patterns in response to an amplitude or phase of a received desired field of view signal, and an amplitude or phase of a received undesired field of view signal, both received with the antenna segments configured a first radiation pattern of the series of at least two radiation patterns.

In an embodiment, the at least two surface scattering antenna segments, for example segments 2320C and 2320D, may be physically contiguous or non-contiguous. For example, the at least two surface scattering antenna segments may or may not share driver circuitry. For example, the at least two surface scattering antenna segments are only required to be separate RF apertures.

In an embodiment, the antenna assembly 2310 includes at least one respective electromagnetic waveguide structure for each segment of the at least two segments. For example, the surface scattering antenna 2320B includes a waveguide structure 2328B, and the surface scattering antenna 2320C includes a waveguide structure 2328C. In an embodiment, the electromagnetic waveguide structure is configured to generate at least one beam. In an embodiment, the components 2350 of the antenna system 2305 further includes a signal processing circuit 2385 configured to combine signals received from the at least two antenna segments and provide a cancellation of the signal from the undesired field of view. In an embodiment, the signal processing circuit is further configured to combine signals received from two or more antenna segments for increased gain. In an embodiment, the receiver 2380 includes a space-based satellite navigation system receiver.

FIG. 26 illustrates an example operational flow 2400. After a start operation, the operational flow includes a first gain characterization operation 2410. The first gain characterization operation includes defining a first-iteration radiation pattern implementable by a first surface scattering antenna segment and another first-iteration radiation pattern implementable by a second surface scattering antenna segment of at least two surface scattering antenna segments of an antenna assembly. In an embodiment, the first gain characterization operation may be implemented using the gain definition circuit 2360 described in conjunction with FIG. 25. A first beam-forming operation 2420 includes implementing the first-iteration radiation pattern in the first surface scattering antenna segment and the another first-iteration radiation pattern in the second surface scattering antenna segment. The first-iteration radiation patterns are established by activating respective electromagnetic responses of selected electromagnetic wave scattering elements of a plurality of electromagnetic wave scattering elements in each of the first and the second surface scattering antenna segments. In an embodiment, the first-beam forming operation may be implemented by the antenna controller 2370 respectively activating the electromagnetic response of selected electromagnetic wave scattering elements of the first and the second surface scattering antenna segments, such as scattering elements 2322B of surface scattering antenna segment 2320B and scattering elements 2322C of surface scattering segment 2320C, described in conjunction with FIGS. 26 and 27. A first signal acquisition operation 2430 includes receiving a combined signal in a desired field of view and a combined signal from an undesired field of view with the first and second antenna segments configured in the first-iteration radiation patterns. In an embodiment, the first signal acquisition operation may be implemented using the receiver 2380 described in conjunction with FIG. 25. A second gain characterization operation 2440 includes defining a second-iteration radiation pattern implementable by the first surface scattering antenna segment and another second-iteration radiation pattern implementable by the second surface scattering antenna segment. The second-iteration patterns are selected in response to an aspect of the received signal in the desired field of view or the received signal from the undesired field of view, and configured to facilitate a convergence on an antenna radiation pattern that maximizes a radiation performance metric. In an embodiment, the second characterization pattern may be implemented using the gain definition circuit 2360 described in conjunction with FIG. 25. A second beam-forming operation 2450 includes implementing the second-iteration radiation pattern in the first surface scattering antenna segment and the another second-iteration radiation pattern in a second surface scattering antenna segment. The second-iteration radiation patterns established by activating respective electromagnetic response of selected electromagnetic wave scattering elements of a plurality of electromagnetic wave scattering elements in each of the first and second surface scattering antenna segments. In an embodiment, the second-beam forming operation may be implemented by the antenna controller 2370 respectively activating the electromagnetic response of selected electromagnetic wave scattering elements of the first and the second surface scattering antenna segments, such as scattering elements 2322B of surface scattering antenna segment 2320B and scattering elements 2322C of surface scattering segment 2320C, described in conjunction with FIGS. 26 and 27. A second signal acquisition operation 2460 includes receiving the combined signal in a desired field of view and the combined signal from an undesired field of view with the first and second antenna segments configured in the second-iteration radiation patterns in accordance with the maximized performance metric. In an embodiment, the second signal acquisition operation may be implemented using the receiver 2380 described in conjunction with FIG. 25. A communication operation 2470 includes outputting the combined signal in a desired field of view and the combined signal from an undesired field of view received in accordance with the maximized performance metric. The operational flow includes an end operation. The antenna assembly includes at least two surface scattering antenna segments. Each segment of the at least two surface scattering antenna segments includes a respective electromagnetic waveguide structure, and a respective a plurality of electromagnetic wave scattering elements. The plurality of electromagnetic wave scattering elements are distributed along the waveguide structure and have an inter-element spacing substantially less than a free-space wavelength of a highest operating frequency of the antenna segment. Each electromagnetic wave scattering element of the plurality of electromagnetic wave scattering elements has a respective activatable electromagnetic response to a guided wave propagating in their respective waveguide structure, and the plurality of electromagnetic wave scattering elements operable in combination to produce a controllable radiation pattern.

In an embodiment, a radiation pattern includes a far field response pattern. For example, a far field response pattern may include a gain response or a phase response. In an embodiment of the first gain characterization operation 2410, the first-iteration radiation pattern and the another first-iteration radiation pattern have an at least substantially similar far field response pattern. In an embodiment of the first gain characterization operation, the first-iteration radiation pattern and the another first-iteration radiation pattern have a substantially dissimilar far field response pattern. For example, a substantially dissimilar far field response pattern may include greater than a 20 dB gain difference at a point in the far field response pattern, or greater than a 10 degree phase shift.

In an embodiment of the second gain characterization operation 2440, the second-iteration radiation pattern and the first-iteration radiation pattern have a substantially similar far field response pattern. In an embodiment of the second gain characterization operation, the first-iteration radiation pattern and the second-iteration radiation pattern have a substantially dissimilar far field response pattern. In an embodiment of the second gain characterization operation, the second-iteration radiation pattern and the another second-iteration radiation pattern have a substantially dissimilar far field response pattern. For example, a substantially dissimilar far field response pattern may include greater than a 20 dB gain difference at a point in the far field response pattern, or greater than a 10 degree phase shift. In an embodiment of the second gain characterization operation, the aspect of the received desired field of view signal and the undesired field of view signal includes a direction of the desired field of view signal and a direction the undesired field of view signal relative to a plane formed by the first surface scattering antenna or the second surface scattering antenna. In an embodiment of the second gain characterization operation, the aspect of the received desired field of view signal and the undesired field of view signal includes a phase of the desired field of view signal or a phase the undesired field of view signal.

FIG. 27 illustrates an example system 2500. The system includes means 2510 for defining a first-iteration radiation pattern implementable by a first surface scattering antenna segment and another first-iteration radiation pattern implementable by a second surface scattering antenna segment of the at least two surface scattering antenna segments of an antenna assembly. The system includes means 2520 for implementing the first-iteration radiation pattern in the first surface scattering antenna segment and the another first-iteration radiation pattern in the second surface scattering antenna segment. The first-iteration radiation patterns established by activating respective electromagnetic response of selected electromagnetic wave scattering elements of a plurality of electromagnetic wave scattering elements in each of the first and the second surface scattering antenna segments. The system includes means 2530 for receiving a combined signal from a desired field of view and a combined signal from an undesired field of view with the first and second antenna segments configured in the first-iteration radiation patterns. The system includes means 2540 for defining a second-iteration radiation pattern implementable by the first surface scattering antenna segment and another second-iteration radiation pattern implementable by the second surface scattering antenna segment. The second-iteration patterns are selected in response to an aspect of the received signal from the desired field of view or the received signal from the undesired field of view, and configured to facilitate a convergence on an antenna radiation pattern that maximizes a radiation performance metric. The system includes means 2550 for implementing the second-iteration radiation pattern in the first surface scattering antenna segment and the another second-iteration radiation pattern in a second surface scattering antenna segment. The second-iteration radiation patterns established by activating respective electromagnetic response of selected electromagnetic wave scattering elements of a plurality of electromagnetic wave scattering elements in each of the first and second surface scattering antenna segments. The system includes means 2560 for receiving the combined signal from a desired field of view and the combined signal from an undesired field of view with the first and second antenna segments configured in the second-iteration radiation patterns in accordance with the maximized performance metric. The system includes means 2570 for outputting the combined signal from a desired field of view and the combined signal from an undesired field of view received in accordance with the maximized performance metric.

The antenna assembly 2580 includes at least two surface scattering antenna segments. Each segment of the at least two surface scattering antenna segments respectively includes an electromagnetic waveguide structure and a plurality of electromagnetic wave scattering elements. The plurality of electromagnetic wave scattering elements distributed along the waveguide structure and having an inter-element spacing substantially less than a free-space wavelength of a highest operating frequency of the antenna segment. Each electromagnetic wave scattering element of the plurality of electromagnetic wave scattering elements has a respective activatable electromagnetic response to a guided wave propagating in their respective waveguide structure, the plurality of electromagnetic wave scattering elements operable in combination to produce a controllable radiation pattern.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof.

All references cited herein are hereby incorporated by reference in their entirety or to the extent their subject matter is not otherwise inconsistent herewith.

In some embodiments, "configured" includes at least one of designed, set up, shaped, implemented, constructed, or adapted for at least one of a particular purpose, application, or function.

It will be understood that, in general, terms used herein, and especially in the appended claims, are generally intended as "open" terms. For example, the term "including" should be interpreted as "including but not limited to." For example, the term "having" should be interpreted as "having at least." For example, the term "has" should be interpreted as "having at least." For example, the term "includes" should be interpreted as "includes but is not limited to," etc. It will be further understood that if a specific number of an introduced claim recitation is intended, such an intent will be explicitly recited in the claim, and in the absence of such recitation no such intent is present. For example, as an aid to understanding, the following appended claims may contain usage of introductory phrases such as "at least one" or "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a receiver" should typically be interpreted to mean "at least one receiver"); the same holds true for the use of definite articles used to introduce claim recitations. In addition, even if a specific number of an introduced claim recitation is explicitly recited, it will be recognized that such recitation should typically be interpreted to mean at least the recited number (e.g., the bare recitation of "at least two chambers," or "a plurality of chambers," without other modifiers, typically means at least two chambers).

In those instances where a phrase such as "at least one of A, B, and C," "at least one of A, B, or C," or "an [item] selected from the group consisting of A, B, and C," is used, in general such a construction is intended to be disjunctive (e.g., any of these phrases would include but not be limited to systems that have A alone, B alone, C alone, A and B together, A and C together, B and C together, or A, B, and C together, and may further include more than one of A, B, or C, such as $A_1$, $A_2$, and C together, A, $B_1$, $B_2$, $C_1$, and $C_2$ together, or $B_1$ and $B_2$ together). It will be further understood that virtually any disjunctive word or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The herein described aspects depict different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality. Any two components capable of being so associated can also be viewed as being "operably couplable" to each other to achieve the desired functionality. Specific examples of operably couplable include but are not limited to physically mateable or physically interacting components or wirelessly interactable or wirelessly interacting components.

With respect to the appended claims the recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Use of "Start," "End," "Stop," or the like blocks in the block diagrams is not intended to indicate a limitation on the beginning or end of any operations or functions in the diagram. Such flowcharts or diagrams may be incorporated into other flowcharts or diagrams where additional functions are performed before or after the functions shown in the diagrams of this application. Furthermore, terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An antenna system comprising:

an antenna assembly including at least two surface scattering antenna segments, each segment of the at least two surface scattering antenna segments including:

a respective electromagnetic waveguide structure; and a respective plurality of electromagnetic wave scattering elements distributed along the waveguide structure and operable in combination to produce a controllable radiation pattern;

a gain definition circuit configured to define a series of at least two radiation patterns implementable by the at least two surface scattering antenna segments, the series of at least two respective radiation patterns selected to facilitate a convergence on an antenna radiation pattern that maximizes a radiation performance metric that includes reception of a signal from a desired field of view or rejection of a signal from an undesired field of view, wherein maximizing the radiation performance metric includes optimizing a combined signal strength received from the desired field of view and minimizing a combined signal strength from an undesired field of view, wherein the radiation performance metric includes a weighted combination of one or more antenna reception performance factors, subject to at least one constraint;

an antenna controller configured to sequentially establish each radiation pattern of the series of at least two radiation patterns by activating the respective electromagnetic response of selected electromagnetic wave scattering elements of the plurality of electromagnetic wave scattering elements of the at least two surface scattering antenna segments; and a receiver configured to receive signals from the desired field of view and signals from the undesired field of view.

2. The antenna system of claim 1, wherein the respective plurality of electromagnetic wave scattering elements have an inter-element spacing substantially less than a free-space wavelength of a highest operating frequency of the antenna segment, and each electromagnetic wave scattering element of the plurality of electromagnetic wave scattering elements has a respective activatable electromagnetic response to a guided wave propagating in their respective waveguide structure.

3. The antenna system of claim 1, wherein the antenna assembly includes an at least substantially planar arrangement having the at least two antenna segments.

4. The antenna system of claim 1, wherein the antenna assembly includes a conformal arrangement of the at least two antenna segments.

5. The antenna system of claim 1, wherein the antenna assembly includes a first antenna segment optimized in area, orientation, or mounting to transmit or receive signals from a specific set or distribution of objects.

6. The antenna system of claim 1, wherein a first segment of the at least two segments includes a receiving aperture that is larger than a receiving aperture of a second segment of the at least two segments.

7. The antenna system of claim 1, wherein a receiving aperture of a first segment of the at least two segments and a receiving aperture of a second segment of the at least two segments are substantially equal.

8. The antenna system of claim 1, wherein the undesired field of view signal includes a possible interfering signal.

9. The antenna system of claim 1, wherein the desired field of view signal includes a possible target or desired signal.

10. The antenna system of claim 1, wherein the series of at least two radiation patterns is defined in advance.

11. The antenna system of claim 1, wherein the series of at least two radiation patterns is defined on the fly.

12. The antenna system of claim 1, wherein the series of the at least two radiation patterns is selected randomly from radiation patterns implementable by the at least two antenna segments.

13. The antenna system of claim 1, wherein the series of at least two radiation patterns are estimated or projected to facilitate the convergence.

14. The antenna system of claim 1, wherein the radiation performance metric includes maximizing a combined signal strength received from a desired field of view and minimizing a combined signal strength received from an undesired field of view.

15. The antenna system of claim 1, wherein an antenna reception radiation performance factor includes an amplitude of the signal received from the desired field of view, or an amplitude of the signal received from the undesired field of view.

16. The antenna system of claim 1, wherein an antenna reception radiation performance factor includes antenna gain for one or more desired directions or angular regions, or antenna gain for one or more undesired directions or angular regions.

17. The antenna system of claim 1, wherein the constraint of the antenna radiation performance metric includes a constraint on amplitude of the signal received from the desired field of view, or on an amplitude of the signal received from the undesired field of view.

18. The antenna system of claim 1, wherein the constraint of the antenna radiation performance metric includes a constraint on signal to noise ratio, signal to interference ratio, signal to clutter ratio, channel capacity, data rate, or error rate.

19. The antenna system of claim 1, wherein the optimized combined signal strength received from a desired field of view includes a maximum combined signal strength received from a desired field of view.

20. The antenna system of claim 1, wherein the gain definition circuit includes an adaptive gain definition circuit configured to define a second radiation pattern of the at least two radiation patterns responsive to a combined signal received from a desired field of view and a combined signal received from a undesired field of view with the at least two antenna segments configured in a first radiation pattern of the at least two radiation patterns.

21. The antenna system of claim 20, wherein the adaptive gain definition circuit is configured to define the a second radiation pattern of the series of at least two radiation patterns by modifying a previously implemented first radiation pattern of the series of at least two radiation patterns.

22. The antenna system of claim 20, wherein the adaptive gain definition circuit is configured to define the series of at least two radiation patterns in response to a selection algorithm.

23. The antenna system of claim 20, wherein the adaptive gain definition circuit is configured to define a second radiation pattern of the series of at least two radiation patterns in response to an amplitude or phase of a received desired field of view signal with the antenna segments configured in a first radiation pattern of the series of at least two radiation patterns.

24. The antenna system of claim 20, wherein the adaptive gain definition circuit is configured to define a second radiation pattern of the series of at least two radiation patterns in response to an amplitude or phase of a received undesired field of view signal with the antenna segments configured in a first radiation pattern of the series of at least two radiation patterns.

25. The antenna system of claim 20, wherein the adaptive gain definition circuit is configured to define the series of at least two respective radiation patterns in response to a library of at least three potential radiation patterns.

26. The antenna system of claim 20, wherein the adaptive gain definition circuit is configured to make at least two successive iterations of defining the set of at least two respective radiation patterns during a course of facilitating a convergence on an optimized combined signal strength received from the desired field of view and a minimized combined signal strength received from the undesired field of view.

27. The antenna system of claim 20, wherein the adaptive gain definition circuit is configured to define a second radiation pattern of the series of at least two radiation patterns in response to an amplitude or phase of a received desired field of view signal, and an amplitude or phase of a received undesired field of view signal, both received with the antenna segments configured in a first radiation pattern of the series of at least two radiation patterns.

28. The antenna system of claim 1, wherein the series of at least two radiation patterns are defined to adjust an amplitude or phase of the undesired field of view signal received by a first antenna segment relative to an amplitude or phase of the undesired field of view signal received by a second antenna segment of the at least two segments of the antenna assembly in a manner predicted to minimize the combined signal received from the undesired field of view by the first segment and the second segment.

29. The antenna system of claim 1, wherein the series of at least two radiation patterns are defined to:

a. adjust an amplitude or phase of the undesired field of view signal received by the first antenna segment relative to an amplitude or phase of the undesired field of view signal received by the second antenna segment of the of the at least two segments of the antenna assembly in a manner predicted to increase a degradation in the combined signals received from the undesired field of view by the first segment and the second segment; and b. adjust an amplitude or phase of the desired field of view signal received by a first antenna segment relative to an amplitude or phase of the desired field of view signal received by a second antenna segment of the of the at least two segments of the antenna assembly in a manner predicted to minimize any degradation in the combined signals received from the desired field of view by the first segment and the second segment.

30. The antenna system of claim 1, wherein the series of at least two radiation patterns are defined to respectively adjust an amplitude or phase the desired field of view and of the undesired field of view signals received by the at least two segments of the antenna assembly in a manner predicted to minimize the combined signal received from the undesired field of view while substantially maintaining the combined signal received from the desired field of view.

31. The antenna system of claim 1, wherein the antenna assembly includes at least one respective electromagnetic waveguide structure for each segment of the at least two segments.

32. The antenna system of claim 31, wherein the electromagnetic waveguide structure is configured to generate at least one beam.

33. The antenna system of claim 1, further comprising:

a signal processing circuit configured to combine signals received from the at least two antenna segments and provide a cancellation of the signal from the undesired field of view.

34. The antenna system of claim 1, wherein the receiver includes a space-based satellite navigation system receiver.

35. The antenna system of claim 1, wherein the antenna assembly includes a first substantially planar antenna segment physically joined with a second substantially planar antenna segment.

36. The antenna system of claim 1, wherein the antenna assembly includes a first substantially planar antenna segment physically abutting or contiguous with a second substantially planar antenna segment.

37. The antenna system of claim 1, wherein the series of at least two radiation patterns is incrementally defined based on trial and error.

38. The antenna system of claim 1, wherein the series of the at least two radiation patterns is selected from a library of potential radiation patterns.

39. The antenna system of claim 1, wherein an antenna reception radiation performance factor includes signal to noise ratio, signal to interference ratio, signal to clutter ratio, channel capacity, data rate, or error rate.

40. The antenna system of claim 1, wherein the constraint of the antenna radiation performance metric includes a constraint on antenna gain for one or more desired directions or angular regions, or antenna gain for one or more undesired directions or angular regions.

41. The antenna system of claim 1, wherein the optimized combined signal strength received from a desired field of view includes a combined desired field of view signal optimized for processing by the receiver circuit.

42. The antenna system of claim 1, wherein the at least two surface scattering antenna segments may be physically contiguous or non-contiguous.

* * * * *